US008352274B2

(12) United States Patent
Yoshizawa et al.

(10) Patent No.: US 8,352,274 B2
(45) Date of Patent: Jan. 8, 2013

(54) SOUND DETERMINATION DEVICE, SOUND DETECTION DEVICE, AND SOUND DETERMINATION METHOD FOR DETERMINING FREQUENCY SIGNALS OF A TO-BE-EXTRACTED SOUND INCLUDED IN A MIXED SOUND

(75) Inventors: Shinichi Yoshizawa, Osaka (JP); Yoshihisa Nakatoh, Kanagawa (JP)

(73) Assignee: Panasonic Corporation, Osaka (JP)

( * ) Notice: Subject to any disclaimer, the term of this patent is extended or adjusted under 35 U.S.C. 154(b) by 889 days.

(21) Appl. No.: 12/517,388

(22) PCT Filed: Aug. 25, 2008

(86) PCT No.: PCT/JP2008/002287

§ 371 (c)(1), (2), (4) Date: Jun. 3, 2009

(87) PCT Pub. No.: WO2009/034686

PCT Pub. Date: Mar. 19, 2009

(65) Prior Publication Data

US 2010/0030562 A1 Feb. 4, 2010

(30) Foreign Application Priority Data

Sep. 11, 2007 (JP) ..... 2007-235899
May 29, 2008 (JP) ..... 2008-141615

(51) Int. Cl.
*G10L 11/00* (2006.01)

(52) U.S. Cl. ..... 704/270

(58) Field of Classification Search ..... 704/270; 381/94.2

See application file for complete search history.

(56) References Cited

U.S. PATENT DOCUMENTS 6,006,175 A * 12/1999 Holzrichter ..... 704/208

(Continued)

FOREIGN PATENT DOCUMENTS

JP 5-210397 8/1993

(Continued)

OTHER PUBLICATIONS

International Search Report issued December 2, 2008 in the International (PCT) Application of which the present application is the U.S. National Stage.

(Continued)

*Primary Examiner* — Michael N Opsasnick

(74) *Attorney, Agent, or Firm* — Wenderoth, Lind & Ponack, L.L.P.

(57) ABSTRACT

A sound determination device (100) includes: an FFT unit (2402) which receives a mixed sound including a to-be-extracted sound and a noise, and obtains a frequency signal of the mixed sound for each of a plurality of times included in a predetermined duration; and a to-be-extracted sound determination unit (101 (*j*)) which determines, when the number of the frequency signals at the plurality of times included in the predetermined duration is equal to or larger than a first threshold value and a phase distance between the frequency signals out of the frequency signals at the plurality of times is equal to or smaller than a second threshold value, each of the frequency signals with the phase distance as a frequency signal of the to-be-extracted sound. The phase distance is a distance between phases of the frequency signals when a phase of a frequency signal at a time t is $\psi(t)$ (radian) and the phase is represented by $\psi'(t)=\mathrm{mod}\ 2\pi(\psi(t)-2\pi ft)$ (where f is an analysis-target frequency).

10 Claims, 53 Drawing Sheets

U.S. PATENT DOCUMENTS

| | | | | |
|---|---|---|---|---|
| 6,130,949 | A | 10/2000 | Aoki et al. | |
| 6,449,592 | B1 * | 9/2002 | Das | 704/224 |
| 6,453,283 | B1 | 9/2002 | Gigi | |
| 7,076,433 | B2 * | 7/2006 | Ito et al. | 704/500 |
| 7,711,127 | B2 * | 5/2010 | Suzuki et al. | 381/92 |
| 2002/0133333 | A1 * | 9/2002 | Ito et al. | 704/208 |
| 2003/0138116 | A1 | 7/2003 | Jones et al. | |
| 2003/0235312 | A1 * | 12/2003 | Pessoa et al. | 381/66 |
| 2004/0167777 | A1 | 8/2004 | Hetherington et al. | |
| 2006/0195316 | A1 | 8/2006 | Sakuraba | |
| 2008/0262834 | A1 | 10/2008 | Obata et al. | |

FOREIGN PATENT DOCUMENTS

| | | |
|---|---|---|
| JP | 9-258788 | 10/1997 |
| JP | 10-313498 | 11/1998 |
| JP | 2001-100763 | 4/2001 |
| JP | 2003-044086 | 2/2003 |
| JP | 2003-533152 | 11/2003 |
| JP | 2004-254329 | 9/2004 |
| JP | 2006-194959 | 7/2006 |
| WO | 01/87011 | 11/2001 |
| WO | 2006/090589 | 8/2006 |

OTHER PUBLICATIONS

Supplementary European Search Report issued Mar. 26, 2010 in EP 08 79 0491, which is a foreign counterpart to the present application.

Aarabi, P. et al: "Multi-channel time-frequency data fusion," Information Fusion, 2002. Proceedings of the Fifth International Conference on Jul. 8-11, 2002, Piscataway, NJ, USA, IEEE, vol. 1, Jul. 8, 2002, pp. 404-411, XP010595149, ISBN: 978-0-9721844-1-0.

Kates, James M: "Cross-correlation procedures for measuring noise and distortion in AGC hearing aids " The Journal of the Acoustical Society of America, American Institute of Physics for the Acoustical Society of America, New York, NY, US, vol. 107, No. 6, Jun. 1, 2000, pp. 3407-3414, XP012001748, ISSN: 0001-4966.

* cited by examiner

Motorcycle sound

Background noise (c)

| Time | Real part:COS (solid line) | Imaginary part:-SIN (dashed line) |
|---|---|---|
| t1 | +1 | ±0 |
| t1~t2 | + | + |
| t2 | ±0 | +1 |
| t2~t3 | - | + |
| t3 | -1 | ±0 |
| t3~t4 | - | - |
| t4 | ±0 | -1 |
| t4~t5 | + | - |
| t5 | +1 | ±0 |

(a)

(b)

SOUND DETERMINATION DEVICE, SOUND DETECTION DEVICE, AND SOUND DETERMINATION METHOD FOR DETERMINING FREQUENCY SIGNALS OF A TO-BE-EXTRACTED SOUND INCLUDED IN A MIXED SOUND

TECHNICAL FIELD

The present invention relates to a sound determination device which determines a frequency signal of a to-be-extracted sound included in a mixed sound, for each time-frequency domain. In particular, the present invention relates to a sound determination device which discriminates between a toned sound, such as an engine sound, a siren sound, and a voice, and a toneless sound, such as wind noise, a sound of rain, and background noise, so that a frequency signal of the toned sound (or, the toneless sound) is determined for each time-frequency domain.

BACKGROUND ART

According to a first conventional technology, pitch cycle extraction is performed on an input sound signal (a mixed sound) and, when a pitch cycle is not extracted, the sound is determined as noise (see Patent Reference 1, for example). Using the first conventional technology, the sound is recognized from the input sound determined as a sound candidate.

FIG. 1 is a block diagram showing a configuration of a noise elimination device related to the first conventional technology described in Patent Reference 1.

This noise elimination device includes a recognition unit 2501, a pitch extraction unit 2502, a determination unit 2503, and a cycle duration storage unit 2504.

The recognition unit 2501 is a processing unit which provides outputs of sound recognition candidates of a signal segment presumed to be a sound part (a to-be-extracted sound) from an input sound signal (a mixed sound). The pitch extraction unit 2502 is a processing unit which extracts a pitch cycle from the input sound signal. The determination unit 2503 is a processing unit which provides an output of a sound recognition result based on: the sound recognition candidates of the signal segment given by the recognition unit 2501; and the result of the pitch extraction performed on the signal segment by the pitch extraction unit 2502. The cycle duration storage unit 2504 is a storage device which stores a cycle duration of the pitch cycle extracted by the pitch extraction unit 2502. Using this noise elimination device, when a pitch cycle is within a predetermined cycle set with respect to the pitch cycle, the signal of the present signal segment is determined as a sound candidate. Meanwhile, when the pitch cycle is outside the predetermined cycle set with respect to the pitch cycle, the signal is determined as noise.

According to a second conventional technology, the presence or absence of an input of a human voice is eventually determined on the basis of determination results given by three determination units (see Patent Reference 2, for example). A first determination unit determines that a human voice (a to-be-extracted sound) is received, when a signal component having a harmonic structure is detected from an input signal (a mixed sound). A second determination unit determines that a human voice is received, when a centroid frequency of the input signal is within a predetermined frequency range. A third determination unit determines that a human voice is received, when a power ratio of the input signal with respect to a noise level stored in a noise level storage unit exceeds a predetermined threshold value.

Patent Reference 1: Japanese Unexamined Patent Application Publication No. 05-210397 (claim 2, FIG. 1)

Patent Reference 2: Japanese Unexamined Patent Application Publication No. 2006-194959 (claim 1)

SUMMARY OF THE INVENTION

Problems that Invention is to Solve

In the case of the construction according to the first conventional technology, the pitch cycle is extracted for each time domain. For this reason, it is impossible to determine the frequency signal of the to-be-extracted sound included in the mixed sound, for each time-frequency domain. It is also impossible to determine a sound whose pitch cycle varies, such as an engine sound (a sound whose pitch cycle varies according to the number of revolutions of the engine).

In the case of the construction according to the second conventional technology, the to-be-extracted sound is determined depending on a spectrum shape such as a harmonic structure and a centroid frequency. On account of this, when a large noise is superimposed and the spectrum shape is thus distorted, the to-be-extracted sound cannot be determined. Especially when the spectrum shape is distorted due to the noise but the to-be-extracted sound is partially present if seen for each time-frequency domain, the frequency signal of this part cannot be determined as the frequency signal of the to-be-extracted sound.

The present invention is conceived in order to solve the stated conventional problems, and an object of the present invention is to provide a sound determination device and the like which can determine a frequency signal of a to-be-extracted sound included in a mixed sound, for each time-frequency domain. In particular, the object of the present invention is to provide a sound determination device which discriminates between a toned sound, such as an engine sound, a siren sound, and a voice, and a toneless sound, such as wind noise, a sound of rain, and background noise, so that a frequency signal of the toned sound (or, the toneless sound) is determined for each time-frequency domain.

Means to Solve the Problems

A noise elimination device related to an aspect of the present invention includes: a frequency analysis unit which receives a mixed sound including a to-be-extracted sound and a noise, and obtains a frequency signal of the mixed sound for each of a plurality of times included in a predetermined duration; and a to-be-extracted sound determination unit which determines, when the number of the frequency signals at the plurality of times included in the predetermined duration is equal to or larger than a first threshold value and a phase distance between the frequency signals out of the frequency signals at the plurality of times is equal to or smaller than a second threshold value, each of the frequency signals with the phase distance as a frequency signal of the to-be-extracted sound, wherein the phase distance is a distance between phases of the frequency signals when a phase of a frequency signal at a time t is $\psi(t)$ (radian) and the phase is represented by $\psi'(t)=\mathrm{mod}\ 2\pi(\psi(t)-2\pi ft)$ (where f is an analysis-target frequency).

With this configuration, when the phase of the frequency signal at the time t is $\psi(t)$ (radian), the distance (one indicator for measuring the time shape of the phase $\psi'(t)$ in the predetermined duration) in the case where $\psi'(t)=\mathrm{mod}\ 2\pi(\psi(t)-2\pi ft)$ (where f is the analysis-target frequency) is used. Accordingly, a toned sound, such as an engine sound, a siren sound, and a voice, and a toneless sound, such as wind noise, a sound of rain, and background noise, can be discriminated for each time-frequency domain. Moreover, a frequency signal of the toned sound (or, the toneless sound) can be determined.

It is preferable that the to-be-extracted sound determination unit: creates a plurality of groups of frequency signals, each of the groups including the frequency signals in a number that is equal to or larger than the first threshold value and the phase distance between the frequency signals in each of the groups being equal to or smaller than the second threshold value; and determines, when the phase distance between the groups of the frequency signals is equal to or larger than a third threshold value, the groups of the frequency signals as groups of frequency signals of to-be-extracted sounds of different kinds.

With this configuration, when a plurality of kinds of to-be-extracted sounds are present in the same time-frequency domain, discrimination can be made so that each of the to-be-extracted sounds is determined. For example, discrimination is made among engine sounds of a plurality of vehicles and each of the sounds can be thus determined. On account of this, when the noise elimination device of the present invention is applied to a vehicle detection device, this vehicle detection device can notify the driver that a plurality of different vehicles are present. Therefore, the driver can drive safely. Moreover, discrimination can be made among voices of a plurality of persons using the present invention. When the present invention is applied to an audio output device, the audio output device can discriminate among the voices of the plurality of persons and thus provide outputs of the voices separately.

Also, it is preferable that the to-be-extracted sound determination unit selects the frequency signals at times at intervals of 1/f (where f is the analysis-target frequency) from the frequency signals at the plurality of times included in the predetermined duration, and calculates the phase distance using the selected frequency signals at the times.

With this configuration, for a frequency signal at time intervals of 1/f (where f is the analysis-target frequency), $\psi'(t)=\text{mod } 2\pi(\psi(t)-2\pi ft)=\psi(t)$. Thus, the phase distance can be calculated by an easy calculation using $\psi(t)$.

Moreover, it is preferable that the sound determination device described above further includes a phase modification unit which modifies the phase $\psi(t)$ (radian) of the frequency signal at the time t to $\psi'(t)=\text{mod } 2\pi(\psi(t)-2\pi ft)$ (where f is the analysis-target frequency), wherein the to-be-extracted sound determination unit calculates the phase distance using the modified phase $\psi'(t)$ of the frequency signal.

With this configuration, modification represented by $\psi'(t)=\text{mod } 2\pi(\psi(t)-2\pi ft)$ is made. Thus, for a frequency signal at time intervals shorter than the time intervals of 1/f (where f is the analysis-target frequency), the phase distance can be calculated by an easy calculation using the phase $\psi'(t)$. On account of this, in a low frequency band where the time interval of 1/f is longer, the to-be-extracted sound can be determined through an easy calculation using $\psi'(t)$ for each short time domain.

A sound detection device related to another aspect of the present invention includes: the above-described sound determination device; and a sound detection unit which creates a to-be-extracted sound detection flag and to provide an output of the to-be-extracted sound detection flag when the frequency signal included in the frequency signals of the mixed sound is determined as the frequency signal of the to-be-extracted sound by the above-described sound determination device.

With this configuration, the user can be notified of the to-be-extracted sound detected for each time-frequency domain. For example, when the noise elimination device of the present invention is built into a vehicle detection device, an engine sound is detected as the to-be-extracted sound so that the driver can be notified of the approach of a vehicle.

It is preferable: that the frequency analysis unit is receives a plurality of mixed sounds collected by microphones respectively, and obtains the frequency signal for each of the mixed sounds; that the to-be-extracted sound determination unit determines the to-be-extracted sound for each of the mixed sounds; and that the sound detection unit creates the to-be-extracted sound detection flag and provides the output of the to-be-extracted sound detection flag when the frequency signal included in the frequency signals of at least one of the mixed sounds is determined as the frequency signal of the to-be-extracted sound.

With this configuration, even when a to-be-extracted sound cannot be detected, due to the influence of noise, from a mixed sound collected by one microphone, there is an increased possibility for the to-be-extracted sound to be detected by another microphone. This can reduce detection errors. For example, when the noise elimination device of the present invention is built into a vehicle detection device, a mixed sound collected by a microphone less affected by wind noise, the influence of which depends on the position of the microphone, can be used. On account of this, the engine sound as the to-be-extracted sound can be detected with accuracy, and the driver can be accordingly notified of the approach of a vehicle. In this case here, it may be considered that a mixed sound including a large amount of noise would cause an adverse effect. However, by taking advantage of the characteristic of the present invention that the time variation of the phase becomes irregular in the time-frequency domain where the amount of noise is large and the noise can be automatically removed, this adverse effect can be eliminated.

A sound extraction device related to another aspect of the present invention includes: the above-described sound determination device; and a sound extraction unit provides, when the frequency signal included in the frequency signals of the mixed sound is determined as the frequency signal of the to-be-extracted sound by the above-described sound determination device, an output of the frequency signal determined as the frequency signal of the to-be-extracted sound.

With this configuration, the frequency signal of the to-be-extracted sound determined for each time-frequency domain can be used. For example, when the noise elimination device of the present invention is built in an audio output device, the clear to-be-extracted sound obtained after the noise elimination can be reproduced. Also, when the noise elimination device of the present invention is built in a sound source direction detection device, a precise sound source after the noise elimination can be obtained. Moreover, when the noise elimination device of the present invention is built in a sound identification device, a precise sound identification can be performed even when noise is present in the surroundings.

It should be noted here that the present invention may be realized not only as such a sound determination device having these characteristic units, but also as: a sound determination method having the characteristic units included in the sound determination device as its steps; and a sound determination program that causes a computer to execute the steps included in the sound determination method. Also, it should be obvious that such a program can be distributed via a recording medium such as a CD-ROM (Compact Disc-Read Only Memory), or via a transmission medium such as the Internet.

Effects of the Invention

Using the sound determination device included in the present invention, a frequency signal of a to-be-extracted sound included in a mixed sound can be determined for each time-frequency domain. In particular, discrimination is made between a toned sound, such as an engine sound, a siren sound, and a voice, and a toneless sound, such as wind noise, a sound of rain, and background noise, so that a frequency signal of the toned sound (or, the toneless sound) can be determined for each time-frequency domain.

For example, the present invention can be applied to an audio output device which receives a frequency signal of a sound determined for each time-frequency domain and provides an output of a to-be-extracted sound through reverse frequency conversion. Also, the present invention can be applied to a sound source direction detection device which receives a frequency signal of a to-be-extracted sound determined for each time-frequency domain for each of mixed sounds received from two or more microphones, and then provides an output of a sound source direction of the to-be-extracted sound. Moreover, the present invention can be applied to a sound identification device which receives a frequency signal of a to-be-extracted sound determined for each time-frequency domain and then performs sound recognition and sound identification. Furthermore, the present invention can be applied to a wind-noise level determination device which receives a frequency signal of wind noise determined for each time-frequency domain and provides an output of the magnitude of power. Also, the present invention can be applied to a vehicle detection device which: receives a frequency signal of a traveling sound that is caused by tire friction and determined for each time-frequency domain; and detects a vehicle from the magnitude of power. Moreover, the present invention can be applied to a vehicle detection device which detects a frequency signal of an engine sound determined for each time-frequency domain and notifies of the approach of a vehicle. Furthermore, the present invention can be applied to an emergency vehicle detection device or the like which detects a frequency signal of a siren sound determined for each time-frequency domain and notifies of the approach of an emergency vehicle.

NUMERICAL REFERENCES

Figure 1:
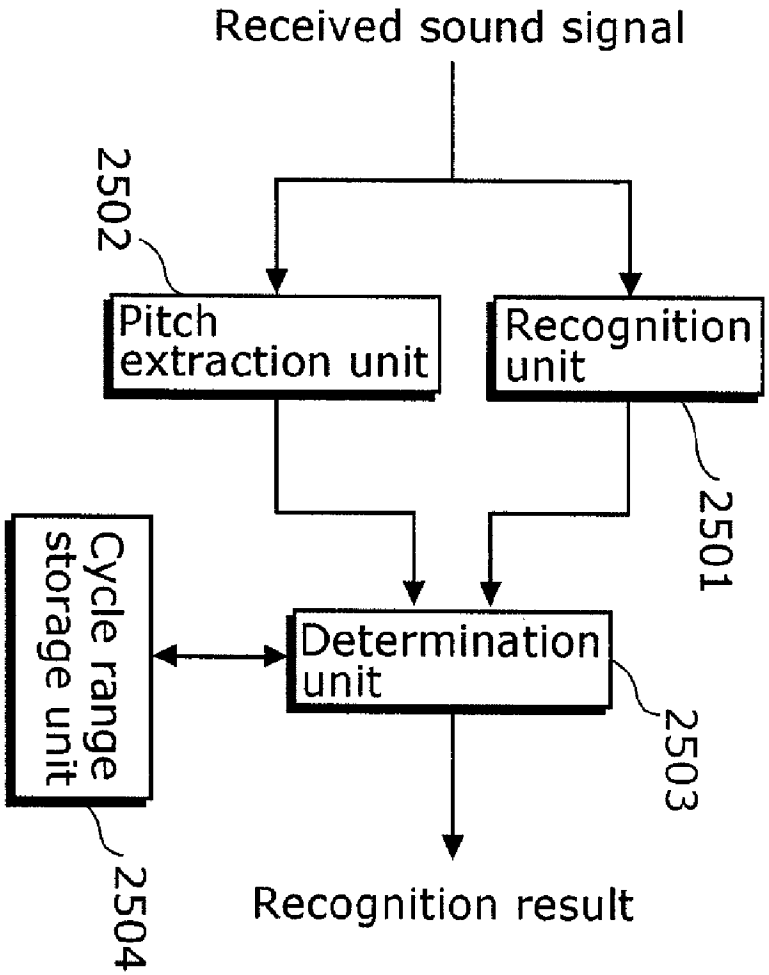
FIG. 1 is a block diagram showing an entire configuration of a conventional noise elimination device.

100, 1500 noise elimination device
101, 1504 noise elimination processing unit
101 (*j*) (j=1 to M), 1502 (*j*) (j=1 to M), 4103 (*j*) (j=1 to M) to-be-extracted sound determination unit
200 (*j*) (j=1 to M), 1600 (*j*) (j=1 to M) frequency signal selection unit
201 (*j*) (j=1 to M), 1601 (*j*) (j=1 to M), 4200 (*j*) (j=1 to M) phase distance determination unit
202 (*j*) (j=1 to M), 1503 (*j*) (j=1 to M) sound extraction unit
1100 DFT analysis unit
1501 (*j*) (j=1 to M), 4102 (*j*) (j=1 to M) phase modification unit
2401, 2401 (1), 2402 (2) mixed sound
2402 FFT analysis unit
2408 frequency signal of to-be-extracted sound
2501 recognition unit
2502 pitch extraction unit
2503 determination unit
2504 cycle duration storage unit
4100 vehicle detection device
4101 vehicle detection processing unit
4104 (*j*) (j=1 to M) sound detection unit
4105 to-be-extracted sound detection flag
4106 presentation unit
4107 (1), 4107 (2) microphone

DETAILED DESCRIPTION OF THE INVENTION

One of the characteristics of the present invention is that after frequency analysis is performed on the received mixed sound, discrimination is made for the analysis-target frequency f between a toned sound, such as an engine sound, a siren sound, and a voice, and a toneless sound, such as wind noise, a sound of rain, and background noise on the basis of whether or not the time variation of the phase of the analyzed frequency signal is cyclically repeated in (1/f) (where f is an analysis-target frequency), so that a frequency signal of the toned sound (or, the toneless sound) is determined for each time-frequency domain.

Figure 2:
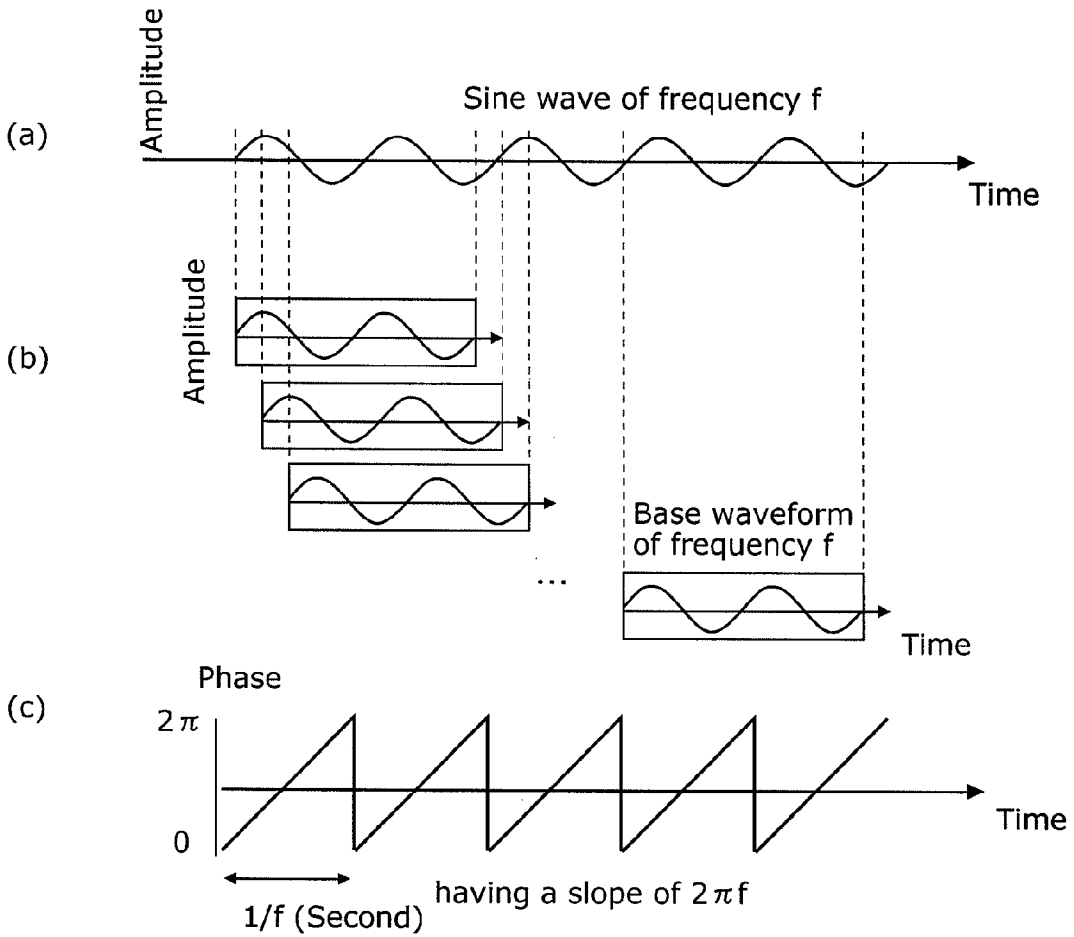
FIG. 2 is a diagram for explaining a definition of a phase, according to the present invention.

Here, the term "phase" used for the present invention is defined, with reference to FIG. 2. FIG. 2 (*a*) shows a received mixed sound. The horizontal axis represents time and the vertical axis represents amplitude. In this example, a sine wave of a frequency f is used. FIG. 2 (*b*) is a conceptual diagram showing a base waveform (the sine wave of the frequency f) used when frequency analysis is performed through the discrete Fourier transform. The horizontal axis and the vertical axis are the same as those in FIG. 2 (*a*). A frequency signal (phase) is obtained by performing the convolution processing on this base waveform and the received mixed sound. In the present example, by performing the convolution processing on the received mixed signal while the base waveform is being shifted in the direction of the time axis, the frequency signal (phase) is obtained for each of the times. The result obtained through this processing is shown in FIG. 2 (*c*). The horizontal axis represents time and the vertical axis represents phase. In this example, since the received mixed sound is shown as the sine wave of the frequency f, the pattern of the phase of the frequency f is repeated cyclically in a cycle of time of 1/f.

In the case of the present invention, the phase obtained while the base waveform is being shifted in the direction of the time axis as shown in FIG. 2 is defined as the "phase" used for the present invention.

Figure 3A:
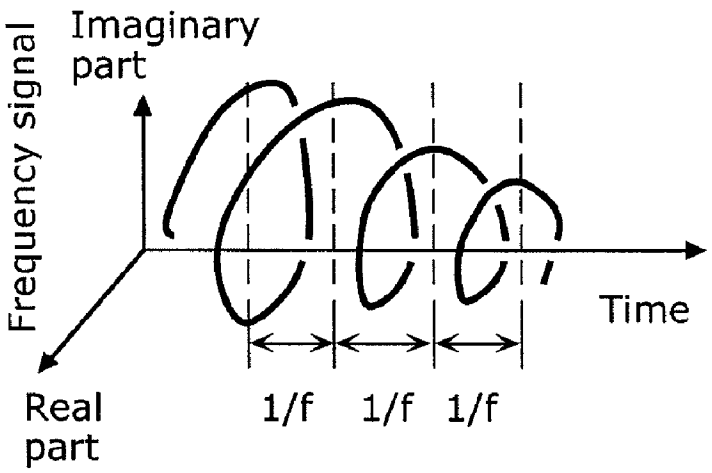
FIG. 3A is a conceptual diagram for explaining one of the characteristics of the present invention.
Figure 3B:
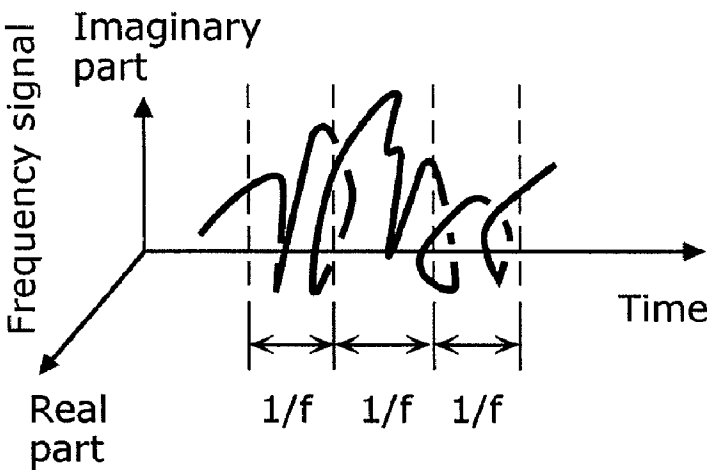
FIG. 3B is a conceptual diagram for explaining one of the characteristics of the present invention.

FIGS. 3A and 3B are conceptual diagrams for explaining the characteristics of the present invention. FIG. 3A is a schematic diagram showing a result of frequency analysis performed on a motorcycle sound (an engine sound) at the frequency f. FIG. 3B is a schematic diagram showing a result of frequency analysis performed on background noise at the frequency f. In both of the diagrams, the horizontal axes are time axes and the vertical axes are frequency axes. As shown in FIG. 3A, although the magnitude of the amplitude (power) of the frequency signal varies due to influences including the time variation of the frequency, the phase of the frequency signal cyclically varies from 0 up to 2π (radian) at an isometric speed at time intervals of 1/f (where f is the analysis-target frequency). For example, a 100-Hz frequency signal rotates in phase by 2π (radian) in an interval of 10 ms, and a 200-Hz frequency signal rotates in phase by 2π (radian) in an interval of 5 ms. Meanwhile, as shown in FIG. 3B, the time variation of the phase of the frequency signal in the case of a toneless sound, such as background noise, is irregular. Also, the time variation of the phase in a part which is distorted due to the mixed sound is disrupted, causing irregularity. In this way, the frequency signal of a time-frequency domain where the time variation of the phase of the frequency signal is cyclic is determined, so that the frequency signal of the toned sound, such as an engine sound, a siren sound, and a voice, can be determined in distinction to a toneless sound, such as wind noise, a sound of rain, and background noise. Or, the frequency signal of the toneless sound can be determined, in distinction to the toned sound.

Here, an explanation is given as to a relationship of property differences and phases of sound sources between a toned sound and a toneless sound.

Figure 4A:
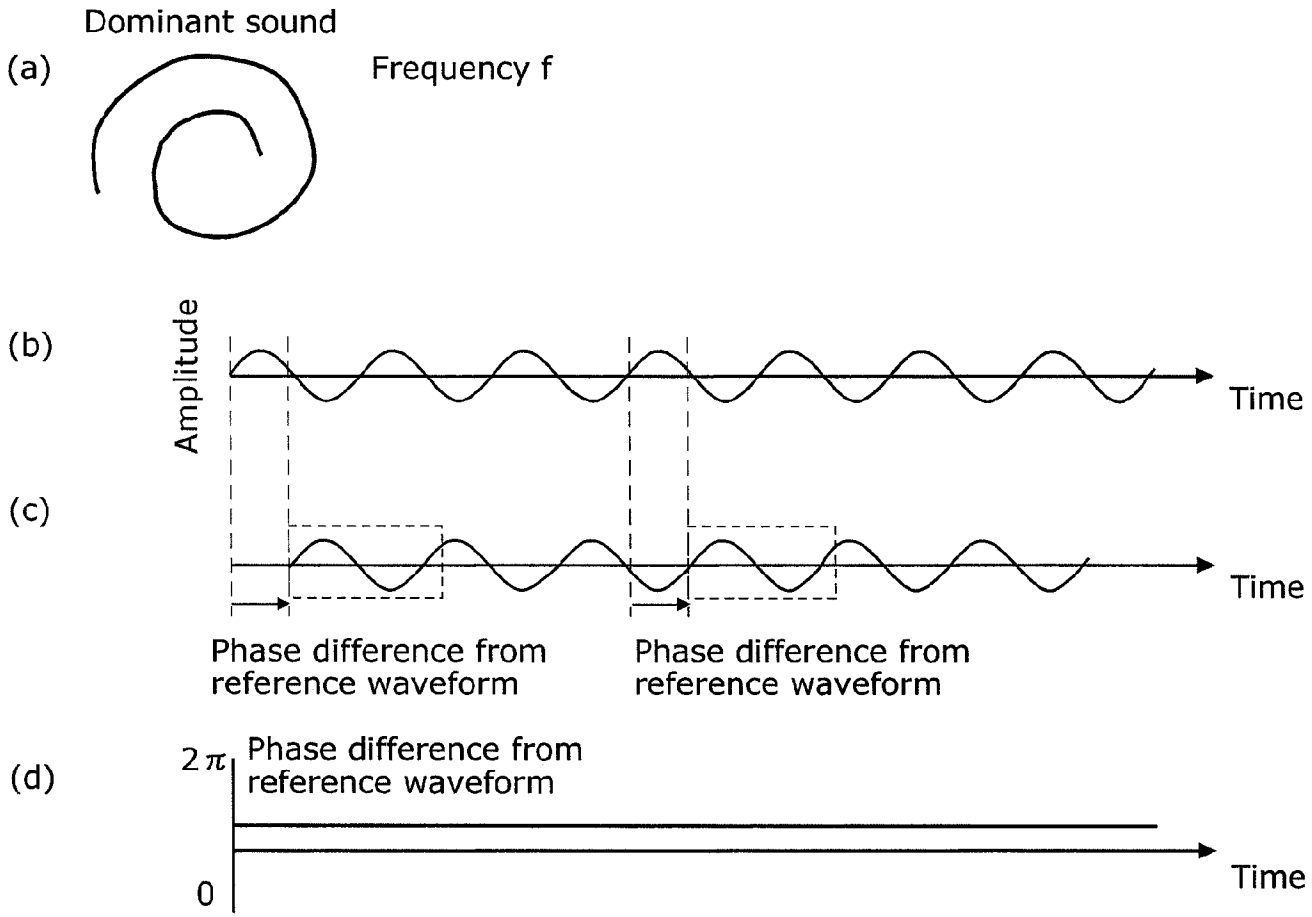
FIG. 4A is a diagram for explaining a relationship between a property and a phase of a sound source of a toned sound.

FIG. 4A (a) is a schematic diagram showing the phase of a toned sound (an engine sound, a siren sound, a voice, or a sine wave) at the frequency f. FIG. 4A (b) is a diagram showing a reference waveform at the frequency f. FIG. 4A (c) is a diagram showing a dominant sound waveform of the toned sound. FIG. 4A (d) is a diagram showing a phase difference with respect to the reference waveform. This diagram shows a phase difference of the sound waveform shown in FIG. 4A (c) with respect to the reference waveform shown in FIG. 4A (b).

Figure 4B:
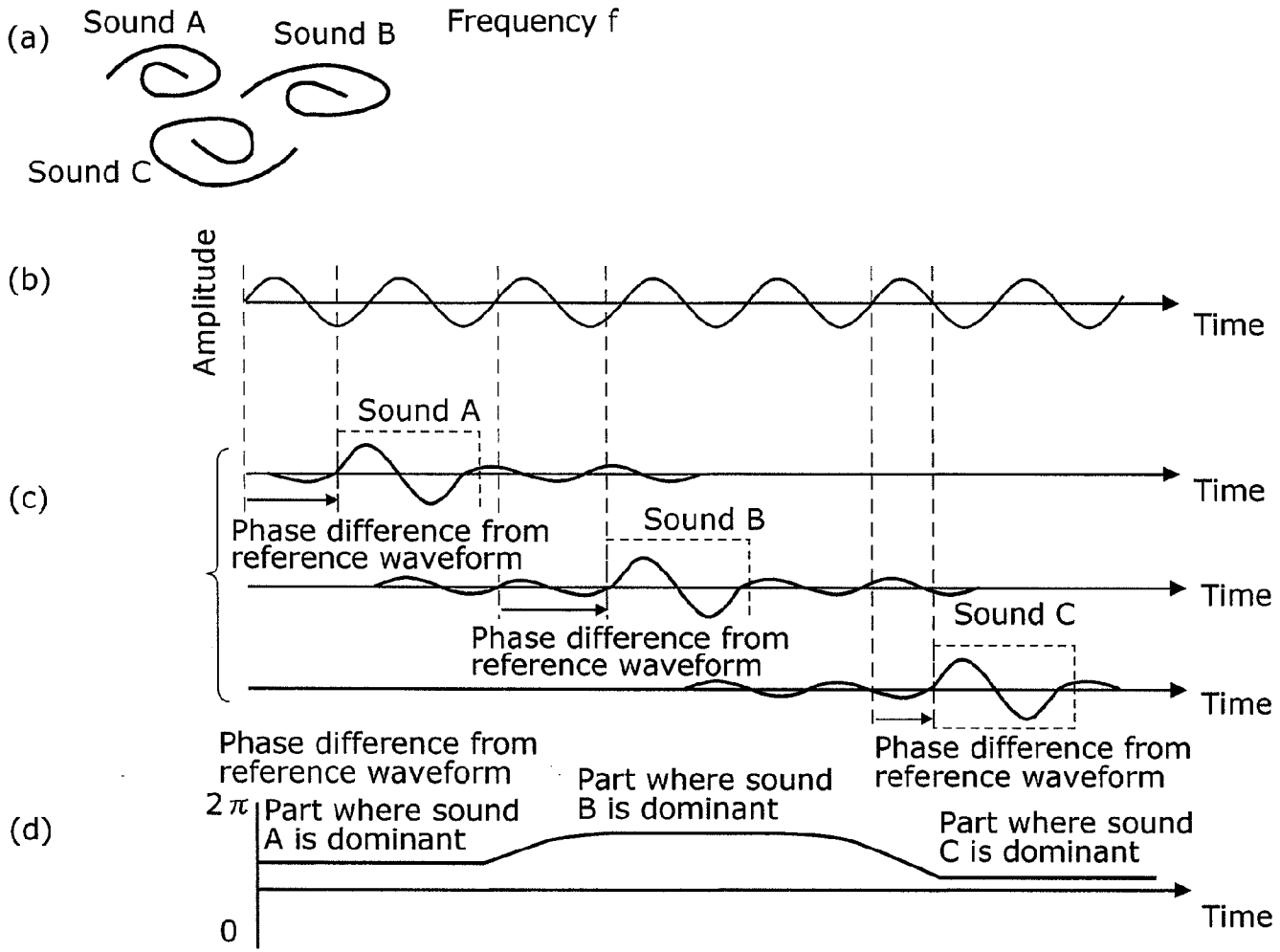
FIG. 4B is a diagram for explaining a relationship between a property and a phase of a sound source of a toneless sound.

FIG. 4B (a) is a schematic diagram showing the phases of toneless sounds (background noise, wind noise, a sound of rain, or white noise) at the frequency f. FIG. 4B (b) is a diagram showing a reference waveform at the frequency f. FIG. 4B (c) is a diagram showing sound waveforms of the toneless sounds (a sound A, a sound B, and a sound C). FIG. 4B (d) is a diagram showing phase differences with respect to the reference waveform. This diagram shows phase differences of the sound waveforms shown in FIG. 4B (c) with respect to the reference waveform shown in FIG. 4B (b).

As shown in FIGS. 4A (a) and 4A (c), the toned sound (an engine sound, a siren sound, a voice, or a sine wave) is represented by a sound waveform made up of a sine wave in which the frequency f is dominant, at the frequency f. On the other hand, as shown in FIGS. 4B (a) and 4B (c), the toneless sound (background noise, wind noise, a sound of rain, or white noise) is represented by a sound waveform in which a plurality of sine waves of the frequency f are mixed, at the frequency f.

Here, an explanation is given as to why a plurality of sound waveforms are present in the case of the toneless sound.

The reason is that the background sound includes a plurality of overlapping sounds (sounds at the same frequency) existing in the distance in a short time domain (the order of hundreds of milliseconds or less).

Also, the reason is that when wind noise is caused due to air turbulence, the turbulence includes a plurality of overlapping spiral sounds (sounds in the same frequency band) in a short time domain (the order of hundreds of milliseconds or less).

Moreover, the reason is that the sound of rain includes a plurality of overlapping raindrop sounds (sounds in the same frequency band) in a short time domain (the order of hundreds of milliseconds or less).

In each of FIGS. 4A (c) and 4B (c), the horizontal axis represents time and the vertical axis represents amplitude.

First, the phase of the toned sound is considered with reference to FIGS. 4A (b), 4A (c), and 4A (d). In this case here, the sine wave at the frequency f as shown in FIG. 4A (b) is prepared as a reference waveform. The horizontal axis represents time and the vertical axis represents amplitude. This reference waveform corresponds to a waveform obtained by fixing, not shifting in the direction of the time axis, the base waveform for the discrete Fourier transform shown in FIG. 2 (*b*). FIG. 4A (c) shows a dominant sound waveform of the toned sound at the frequency f. FIG. 4A (d) shows a phase difference between the reference waveform shown in FIG. 4A (b) and the sound waveform shown in FIG. 4A (c). As can be seen from FIG. 4A (d), the temporal fluctuation of the phase difference between the reference waveform shown in FIG. 4A (b) and the dominant sound waveform shown in FIG. 4A (c) is small in the case of the toned sound. Here, considering the relationship with the phase defined for the present invention, a value obtained by adding a phase increase 2πft caused when the base waveform shown in FIG. 2 (*b*) is shifted by t in the direction of the time axis to the phase difference shown in FIG. 4A (d) is the phase defined for the present invention. In the case of the toned sound, the phase difference shown in FIG. 4A (d) maintains a roughly constant value. On this account, the phase pattern in the present invention obtained by adding 2 πft to the phase difference is cyclically repeated in a cycle of time of 1/f as shown in FIG. 2 (*c*).

Next, the phase of the toneless sound is considered with reference to FIGS. 4B (b), 4B (c), and 4B (d). Also in this case, the sine wave at the frequency f as shown in FIG. 4B (b) is prepared as a reference waveform, as with FIG. 4A (b). The horizontal axis represents time and the vertical axis represents amplitude. FIG. 4B (c) shows the sound waveforms of the plurality of mixed sine waves of the toneless sounds (the sound A, the sound B, and the sound C) at the frequency f. These sound waveforms are mixed at short time intervals of the order of hundreds milliseconds or less. FIG. 4B (d) shows the phase difference between the reference waveform shown in FIG. 4B (b) and the sound waveform mixed with the plurality of sounds. At a start time in FIG. 4B (d), the phase difference of the sound A appears because the amplitude of the sound A is greater than the amplitudes of the sound B and the sound C. At a middle time, the phase difference of the sound B appears because the amplitude of the sound B is greater than the amplitudes of the sound A and the sound C. At an end time, the phase difference of the sound C appears because the amplitude of the sound C is greater than the amplitudes of the sound A and the sound B. In this way, in the case of the toneless sound, the temporal fluctuation of the phase difference between the reference waveform shown in FIG. 4B (b) and the sound waveform mixed with the plurality of sounds shown in FIG. 4B (c) is large at the short time intervals of the order of hundreds milliseconds or less. Here, considering the relationship with the phase defined for the present invention, a value obtained by adding a phase increase 2πft caused when the base waveform shown in FIG. 2 (*b*) is shifted by t in the direction of the time axis to the phase difference shown in FIG. 4B (d) is the phase defined for the present invention. On this account, the phase pattern in the present invention is not cyclically repeated in a cycle of time of 1/f in the case of the toneless sound.

In this way, determination can be made as to whether it is a toned sound or a toneless sound by calculating a phase distance based on the magnitude of the temporal fluctuation of the phase difference with respect to the reference waveform, using the phase difference with respect to the reference waveform as shown in FIG. 4A (d) or FIG. 4*b* (d). Moreover, the determination can be made as to whether it is a toned sound or a toneless sound by calculating a phase difference based on a displacement from the temporal waveform cyclically repeated at times where the phase is 1/f (where f is the analysis-target frequency), using the phase of the present invention obtained while the base waveform as shown in FIG. 2 (*c*) is being shifted in the direction of the time axis. Each of these methods is a concrete method for determining the toned sound or the toneless sound using the phase distance which is a distance between the phases obtained when the phase is represented by $\psi'(t)=\text{mod } 2\pi(\psi(t)-2\pi ft)$ (where f is the analysis-target frequency).

Additionally, it is considered that a degree of regularity in the temporal fluctuation of the phase is different between a mechanical sound close to a sine wave, such as a siren sound, and a physical and mechanical sound, such as a motorcycle sound (an engine sound). Thus, it is considered that the degree of regularity in the temporal fluctuation in the phase can be expressed as follows using inequality signs.

Regularity=sine wave>siren sound>motorcycle sound (engine sound)>background noise>random [Formula 1]

According to this, when the frequency signal of the motorcycle sound is determined from the sound mixed with the siren sound, the motorcycle sound, and the background noise, it is considered that only the degree of regularity in the temporal fluctuation of the phase has to be determined.

Moreover, according to the present invention, the frequency signal of the to-be-extracted sound can be determined using the phase distance, regardless of the power magnitudes of the frequency signals of the noise and the to-be-extracted sound. For example, using the regularity in the phase, even when the power of the frequency signal of the noise is large in a certain time-frequency domain, not only that the frequency signal of the to-be-extracted sound existing in a time-frequency domain where the power of this signal is larger than the power of the noise can be determined, but that the frequency signal of the to-be-extracted sound existing in a time-frequency domain where the power of this signal is smaller than the power of the noise can be determined as well.

The following is a description of embodiments according to the present invention, with reference to the drawings.

First Embodiment

Figure 5:
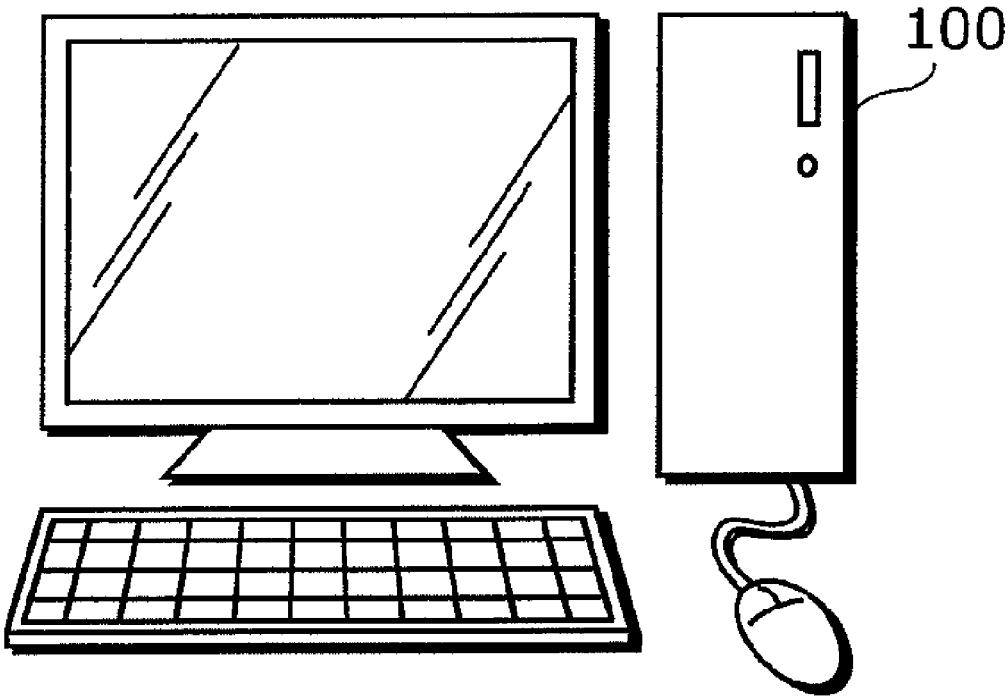
FIG. 5 is a diagram showing an external view of a noise elimination device according to a first embodiment of the present invention.

FIG. 5 is a diagram showing an external view of a noise elimination device according to the first embodiment of the present invention. A noise elimination device 100 includes a frequency analysis unit, a to-be-extracted sound determination unit, and a sound extraction unit, and is realized by causing a program for realizing functions of these processing units to be executed on a CPU which is one of components included in a computer. It should be noted here that various kinds of intermediate data, execution result data, and the like are stored into a memory.

Figure 6:
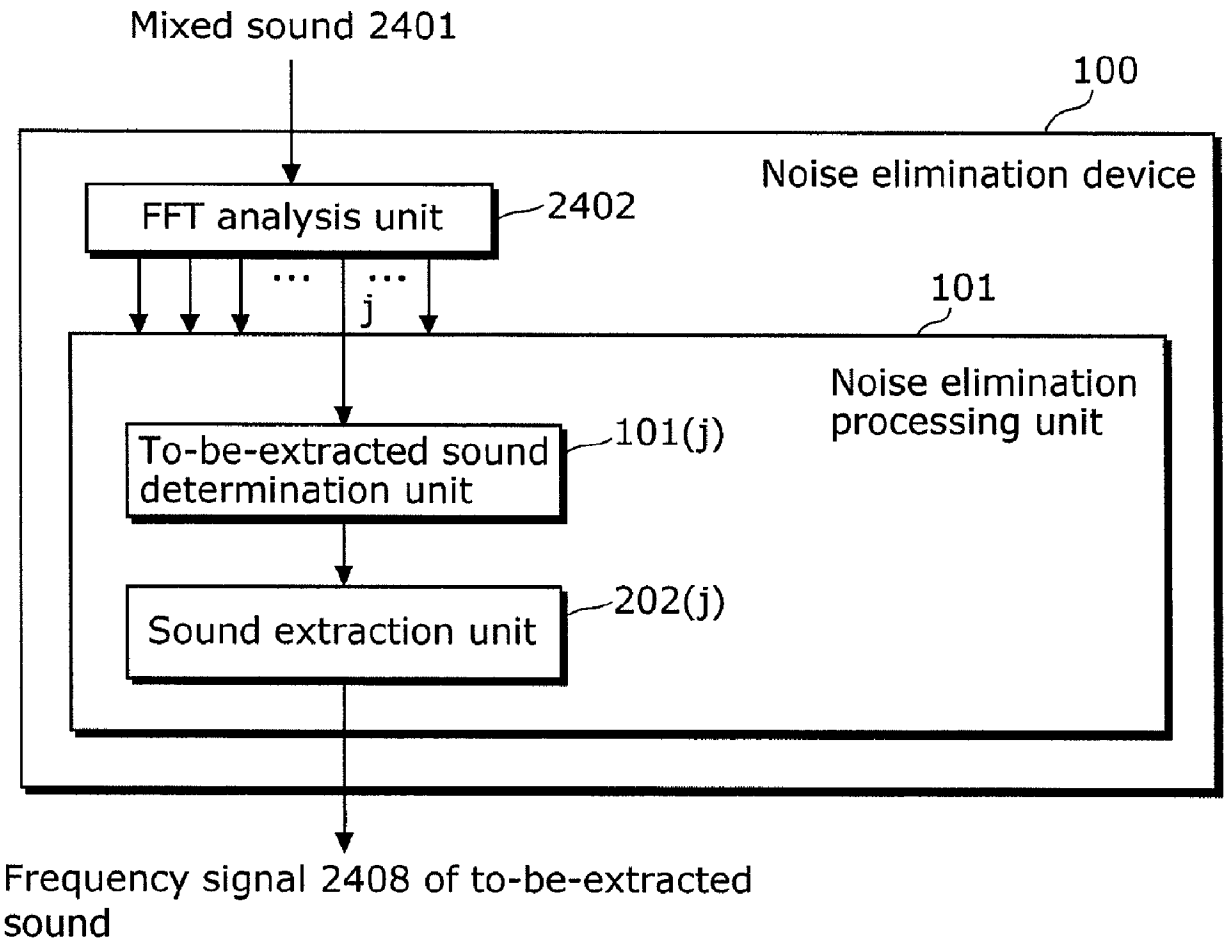
FIG. 6 is a block diagram showing an entire configuration of the noise elimination device according to the first embodiment of the present invention.
Figure 7:
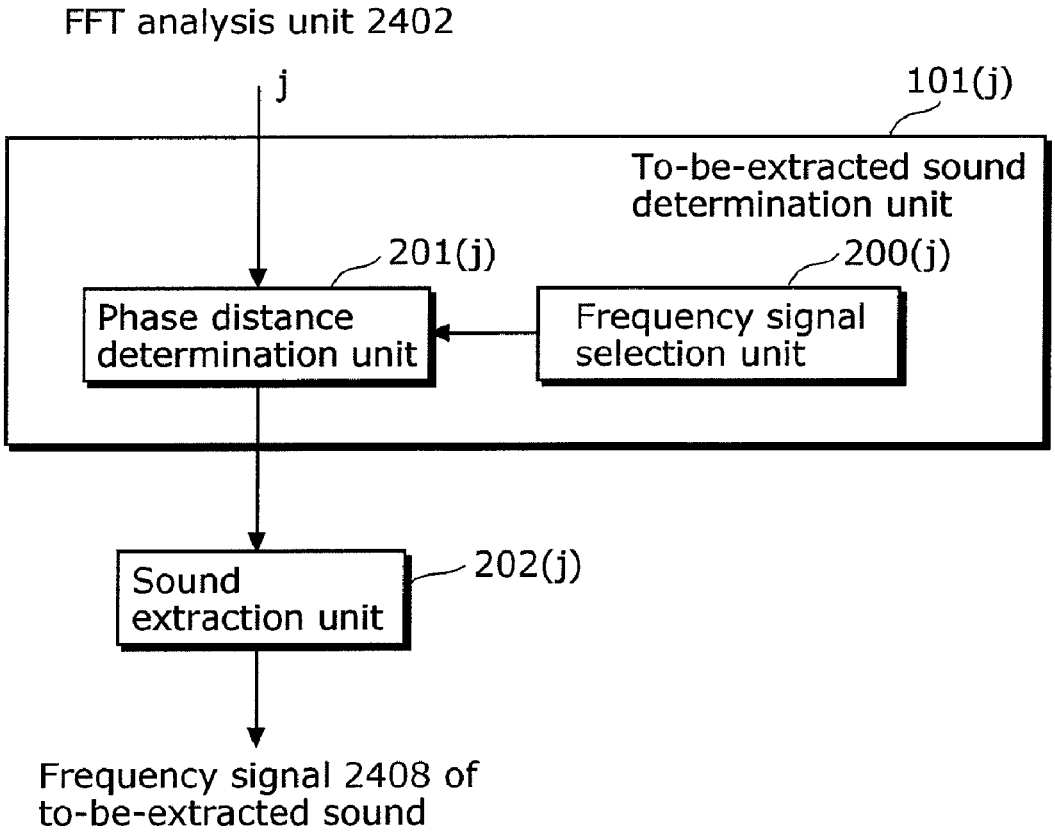
FIG. 7 is a block diagram showing a to-be-extracted sound determination unit 101 (*j*) of the noise elimination device according to the first embodiment of the present invention.

FIGS. 6 and 7 are block diagrams showing a configuration of the noise elimination device according to the first embodiment of the present invention.

In FIG. 6, the noise elimination device 100 includes an FFT analysis unit 2402 (the frequency analysis unit) and a noise elimination processing unit 101 (including the to-be-extracted sound determination unit and the sound extraction unit). The FFT analysis unit 2402 and the noise elimination processing unit 101 are realized by causing the program for realizing the functions of the processing units to be executed on the computer.

The FFT analysis unit 2402 is a processing unit which performs fast Fourier transform processing on a received mixed sound 2401 and obtains a frequency signal of the mixed sound 2401. Hereinafter, the number of frequency bands of the frequency signal obtained by the FFT analysis unit 2402 is represented as M and a number specifying a frequency band is represented as a symbol j (j=1 to M).

The noise elimination processing unit 101 includes a to-be-extracted sound determination unit 101 (*j*) (j=1 to M) and a sound extraction unit 202 (*j*) (j=1 to M). The noise elimination processing unit 101 is a processing unit which eliminates noise, from the frequency signal obtained by the FFT analysis unit 2402, by extracting a frequency signal of the to-be-extracted sound from the mixed sound using the to-be-extracted sound determination unit 101 (*j*) (j=1 to M) and the sound extraction unit 202 (*j*) (j=1 to M) for each frequency band j (j=1 to M).

Using the frequency signals at a plurality of times selected from among times at time intervals of 1/f (where f is the analysis-target frequency) included in a predetermined duration, the to-be-extracted sound determination unit 101 (*j*) (j=1 to M) calculates phase distances between the frequency signal at a analysis-target time and the respective frequency signals at a plurality of times other than the analysis-target time. Here, the number of the frequency signals used in calculating the phase distances is equal to or larger than a first threshold value. Also, the phase distance is a distance between the phases when the phase of the frequency signal at the time t is $\psi(t)$ (radian) and the phase is represented by $\psi'(t)=\text{mod } 2\pi(\psi(t)-2\pi ft)$ (where f is the analysis-target frequency). Moreover, the frequency signal at the analysis-target time where the phase distance is equal to or smaller than a second threshold value is determined as a frequency signal 2408 of the to-be-extracted sound.

Lastly, the sound extraction unit 202 (*j*) (j=1 to M) extracts the frequency signal 2408 of the to-be-extracted sound determined by the to-be-extracted sound determination unit 101 (*j*) (j=1 to M) to eliminate noise from the mixed sound.

These processes are performed while the time of the predetermined duration is being shifted, so that the frequency signal 2408 of the to-be-extracted sound can be extracted for each time-frequency domain.

FIG. 7 is a block diagram showing a configuration of the to-be-extracted sound determination unit 101 (*j*) (j=1 to M).

The to-be-extracted sound determination unit 101 (*j*) (j=1 to M) includes a frequency signal selection unit 200 (*j*) (j=1 to M) and a phase distance determination unit 201 (*j*) (j=1 to M).

The frequency signal selection unit 200 (*j*) (j=1 to M) is a processing unit which selects the frequency signals, the number of which is equal to or larger than the first threshold value, as the frequency signals used in calculating the phase distances, from among the frequency signals in the predetermined duration. The phase distance determination unit 201 (*j*) (j=1 to M) calculates the phase distances using the phases of the frequency signals selected by the frequency signal selection unit 200 (*j*) (j=1 to M), and then determines each of the frequency signals whose phase distance is equal to or smaller than the second threshold value as the frequency signal 2408 of the to-be-extracted sound.

Next, an explanation is given as to an operation performed by the noise elimination device 100 configured as described so far.

A $j^{th}$ frequency band is explained as follows. The same processing is performed for the other frequency bands. Here, the explanation is given, as an example, about the case where a center frequency and an analysis-target frequency (the frequency f as in $\psi'(t)=\text{mod } 2\pi(\psi(t)-2\pi ft)$ used in calculating the phase distances) agree with each other. In this case, whether or not the to-be-extracted sound exists in the frequency f can be determined. As another method, the to-be-extracted sound may be determined using a plurality of frequencies including the frequency band as the analysis frequencies. In this case, whether or not the to-be-extracted sound exists in the frequencies around the center frequency is determined.

Figure 8:
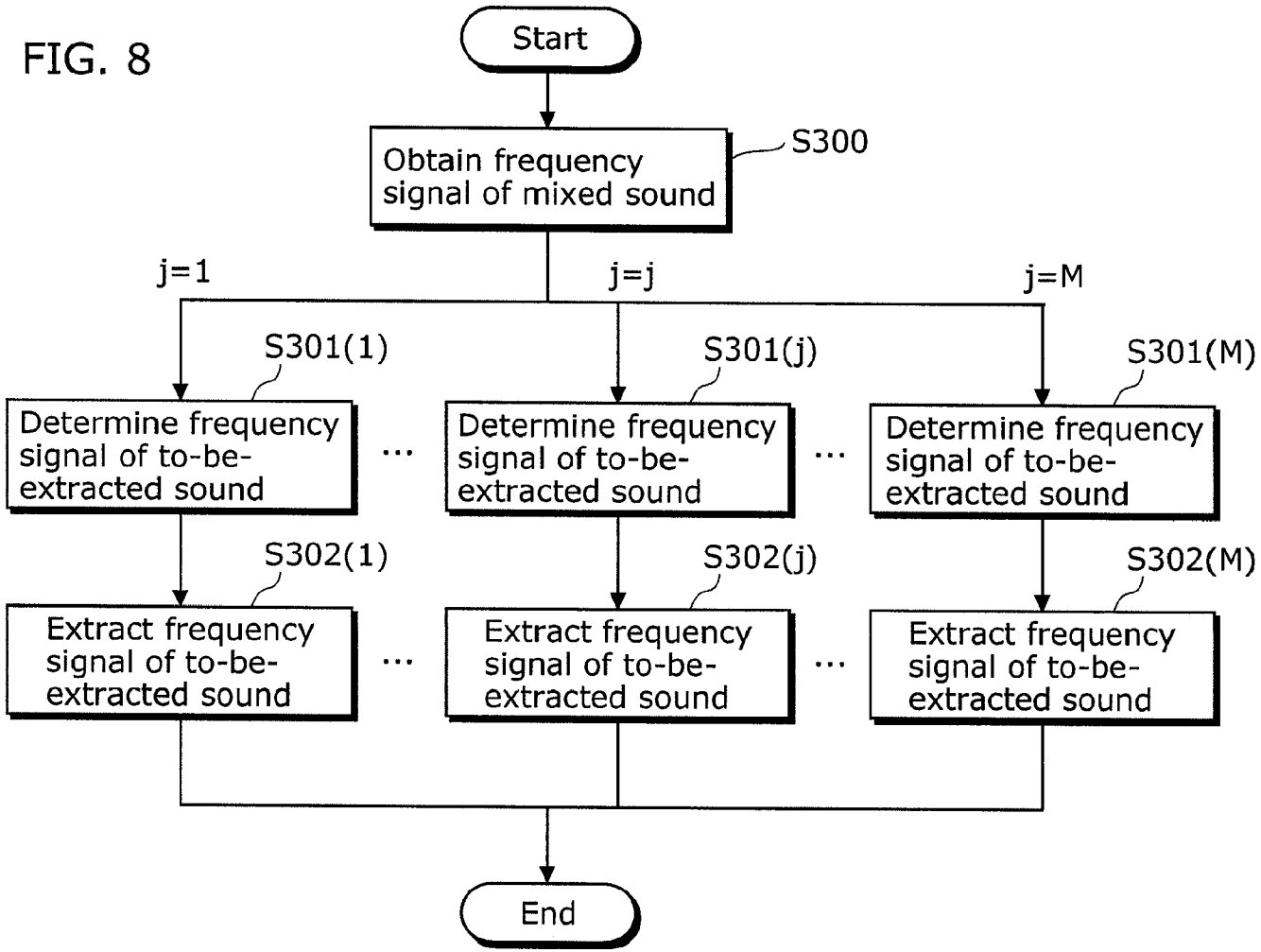
FIG. 8 is a flowchart showing an operation procedure of the noise elimination device according to the first embodiment of the present invention.
Figure 9:
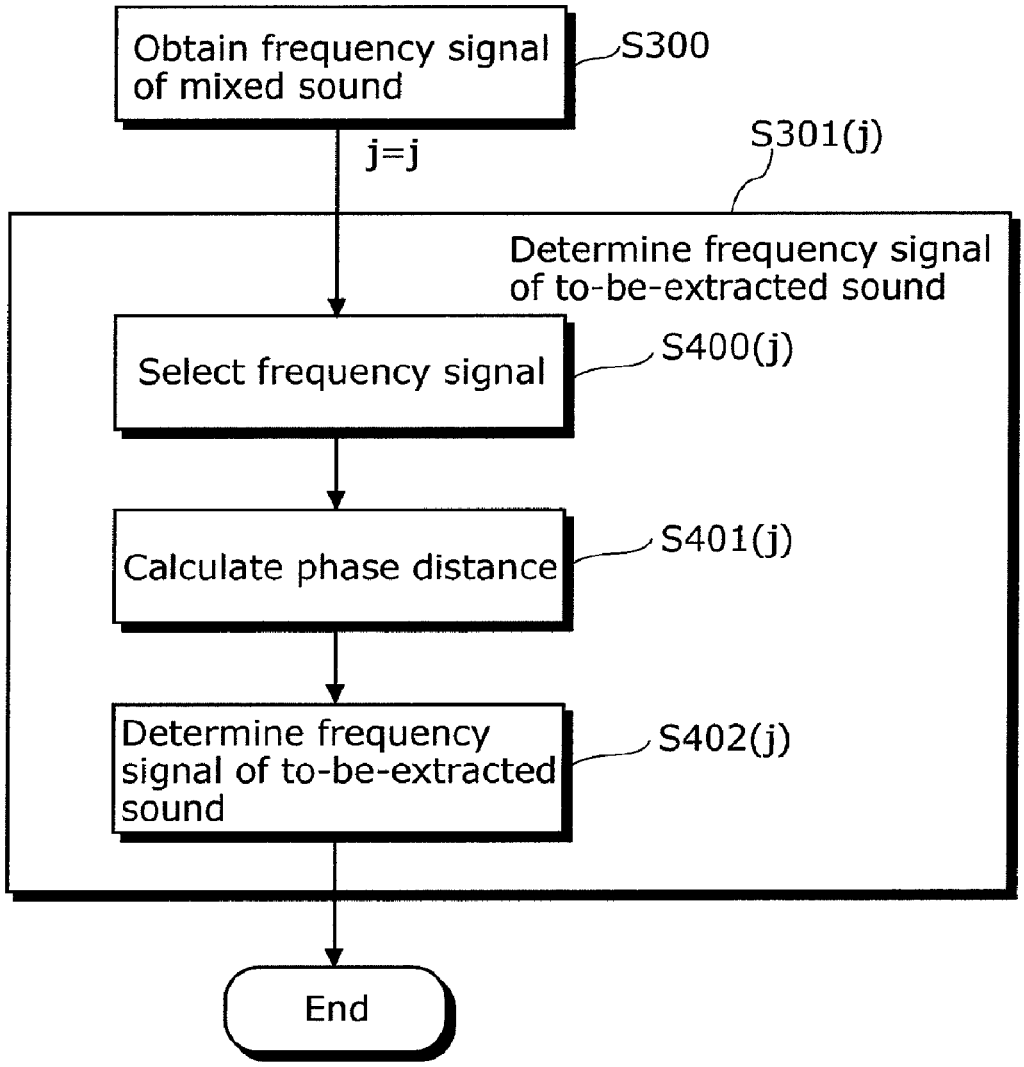
FIG. 9 is a flowchart showing an operation procedure performed in step S301 (*j*) in which the noise elimination device determines a frequency signal of a to-be-extracted sound, according to the first embodiment of the present invention.

FIGS. 8 and 9 are flowcharts showing operation procedures of the noise elimination device 100.

Here, the explanation is given, as an example, about the case where a mixed sound (created by a computer) of a sound (a voiced sound) and white noise is used as the mixed sound 2401. In this example, the object is to eliminate the white noise (a toneless sound) from the mixed sound 2401 and thus extract the frequency signal of the sound (a toned sound).

Figure 10:
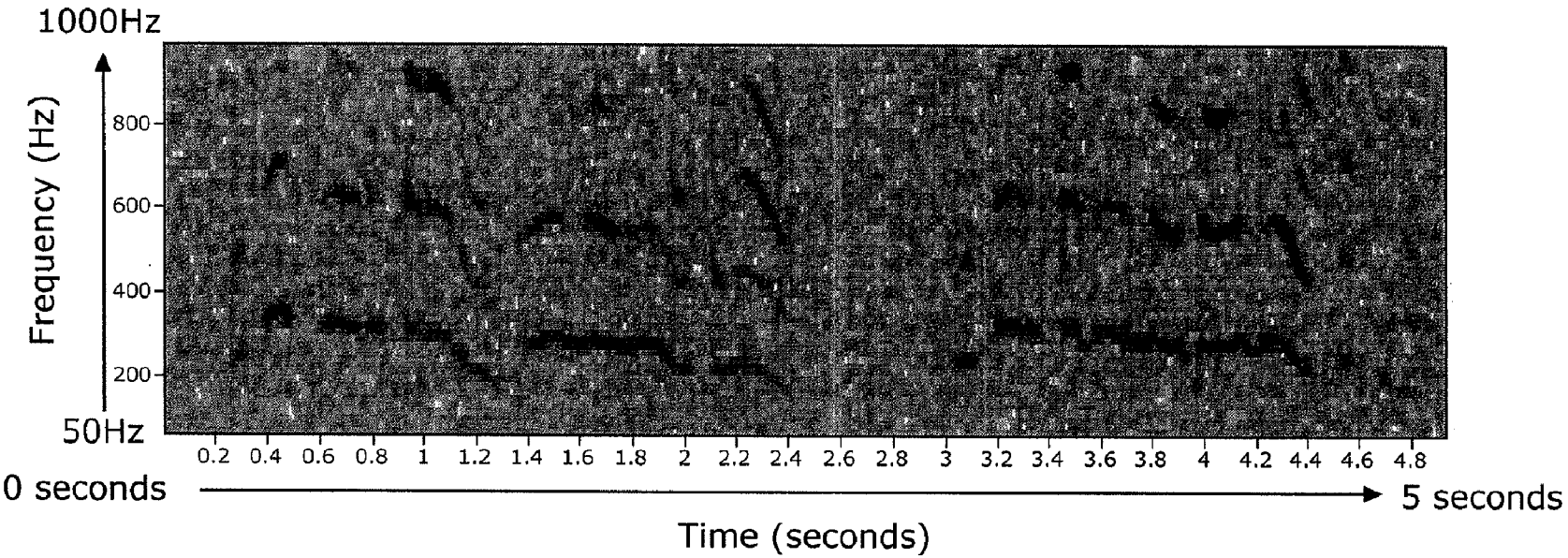
FIG. 10 is a diagram showing an example of a spectrogram of a mixed sound 2401.

FIG. 10 is a diagram showing an example of a spectrogram of the mixed sound 2401 including the sound and the white noise. The horizontal axis is a time axis and the vertical axis is a frequency axis. The color density represents the magnitude of power of a frequency signal. The darker the color, the greater the power of the frequency signal. In the diagram, a spectrogram at 0 to 5 seconds in a frequency range from 50 Hz to 1000 Hz is shown. The display of the phase components of the frequency signal is omitted in this diagram.

Figure 11:
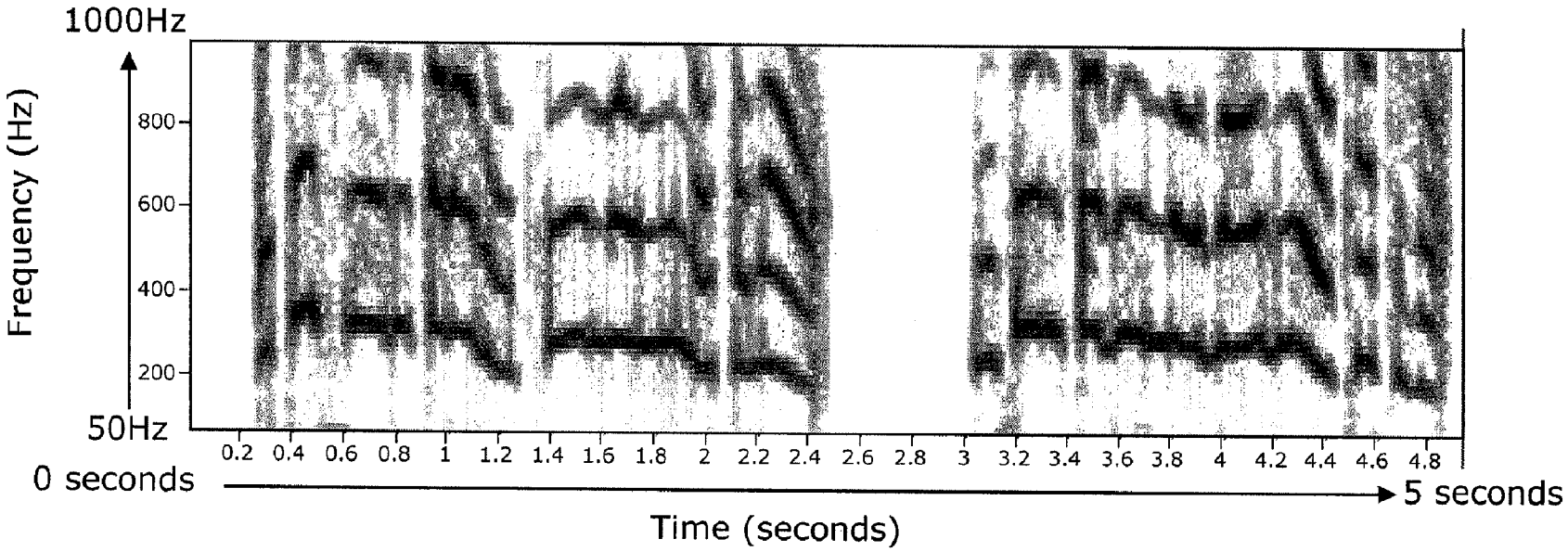
FIG. 11 is a diagram showing an example of a spectrogram of a sound used when the mixed sound 2401 is created.

FIG. 11 shows a spectrogram of the sound used when the mixed sound 2401 shown in FIG. 10 is created. The display manner is the same as in FIG. 10, and thus the detailed explanation is not repeated here.

From FIGS. 10 and 11, only the sound corresponding to the part where the power of the frequency signal of the sound out of the mixed sound 2401 is great can be observed. Here, it can be seen that the harmonic structure of the sound is partially lost.

First, the FFT analysis unit 2402 receives the mixed sound 2401 and performs the fast Fourier transform processing on the mixed sound 2401 to obtain the frequency signal of the mixed sound 2401 (step S300). In this example, the frequency signal in a complex space is obtained through the fast Fourier transform processing. As a condition of the fast Fourier transform processing in this example, the mixed sound 2401 sampled at a sampling frequency=16000 Hz is processed using the Hanning window with a time window width $\Delta t$=64 ms (1024 pt). Moreover, the frequency signal is obtained for each of the times while the time shift is being performed by 1 pt (0.0625 ms) in the direction of the time axis. Only the magnitude of the power of the frequency signals is shown in FIG. 10 as a result of this processing.

Next, the noise elimination processing unit 101 determines the frequency signal of the to-be-extracted sound from the mixed sound for each time-frequency domain using the to-be-extracted sound determination unit 101 (*j*), for each frequency band j of the frequency signal obtained by the FFT analysis unit 2402 (step S301 (*j*)). Then, the noise elimination processing unit 101 uses the sound extraction unit 202 (*j*) to extract the frequency signal of the to-be-extracted sound determined by the to-be-extracted sound determination unit 101 (*j*) so that the noise is eliminated (step S302 (*j*)). The explanation after this is given only about the $j^{th}$ frequency band. The processing performed for the other frequency bands is the same. In this example, a center frequency of the $j^{th}$ frequency band is f.

Using the frequency signals at all the times at the time intervals of 1/f included in a predetermined duration (192 ms), the to-be-extracted sound determination unit 101 (*j*) calculates phase distances between the frequency signal at a analysis-target time and the respective frequency signals at all the times other than the analysis-target time. Here, as the first threshold value, a value corresponding to 30% of the number of the frequency signals at the time intervals of 1/f included in the predetermined duration is used. In this example, when the number of the frequency signals at the time intervals of 1/f included in the predetermined duration is equal to or larger than the first threshold value, the phase distances are calculated using all the frequency signals included in the predetermined duration. Then, the frequency signal at the analysis-target time where the phase distance is equal to or smaller than the second threshold value is determined as the frequency signal 2408 of the to-be-extracted sound. Lastly, the sound extraction unit 202 (*j*) extracts the frequency signal determined by the to-be-extracted sound determination unit 101 (*j*) as the frequency signal of the to-be-extracted sound, so that the noise is eliminated (step S302 (*j*)). Here, the explanation is given, as an example, about the case where the frequency f=500 Hz.

Figure 12:
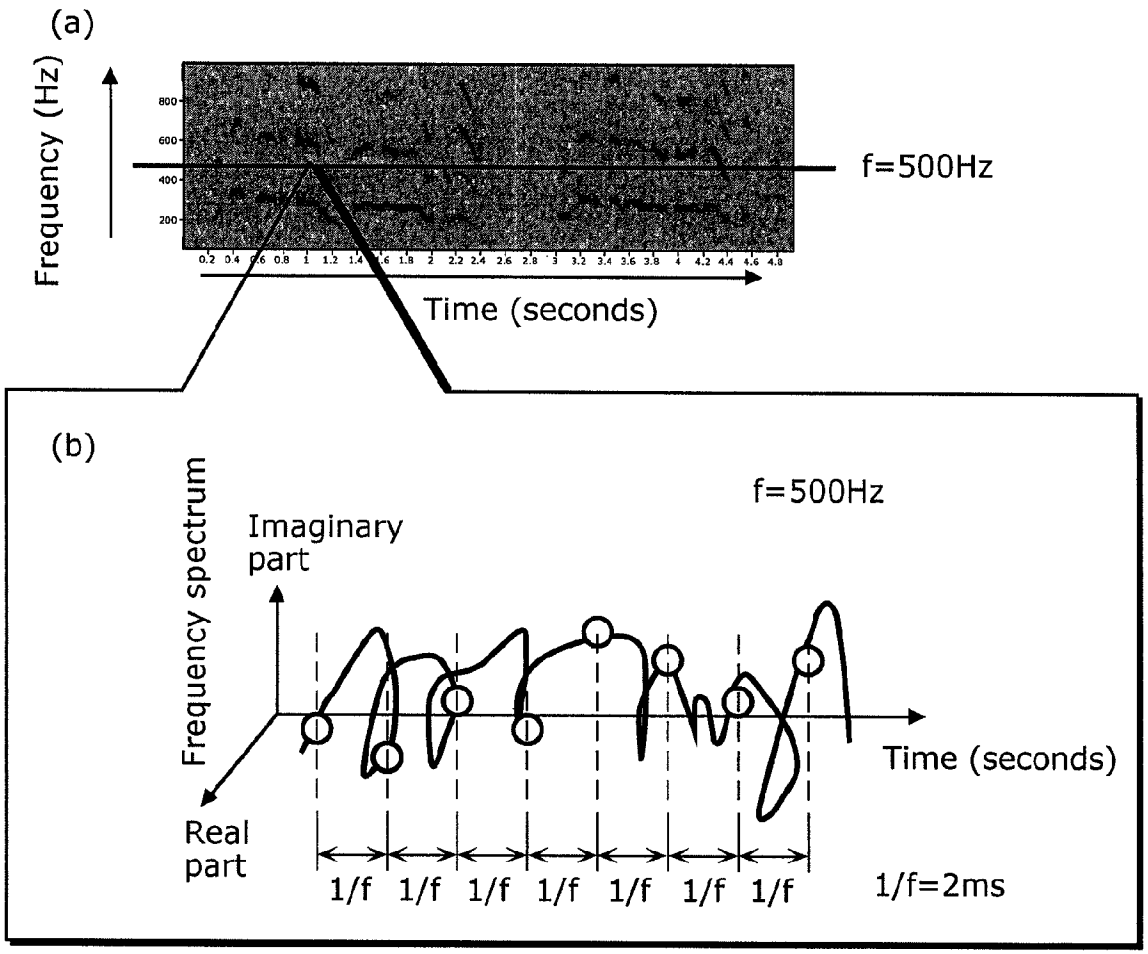
FIG. 12 is a diagram for explaining an example of a method for selecting a frequency signal.

FIG. 12 (*b*) is a schematic diagram showing the frequency signal of the mixed sound 2401 shown in FIG. 12 (*a*) at the frequency f=500 Hz. FIG. 12 (*a*) is the same as what is shown in FIG. 10. In FIG. 12 (*b*), the horizontal axis is a time axis and the two axes on a vertical plane respectively represent a real part and an imaginary part. In the present example, since the frequency f=500 Hz, 1/f=2 ms.

First, the frequency signal selection unit 200 (*j*) selects all the frequency signals, the number of which is equal to or larger than the first threshold value, at the time intervals of 1/f in the predetermined duration (step S400 (*j*)). This is because it would be difficult to determine the regularity of the time variation in the phase when the number of the frequency signals selected for the phase distance calculation is small. In FIG. 12 (*b*), the positions of the frequency signals selected from the times at the time intervals of 1/f are indicated by open circles. In this case here, the frequency signals at all the times at a time interval of 1/f=2 ms are selected, as shown in FIG. 12 (*b*).

Figure 13A:
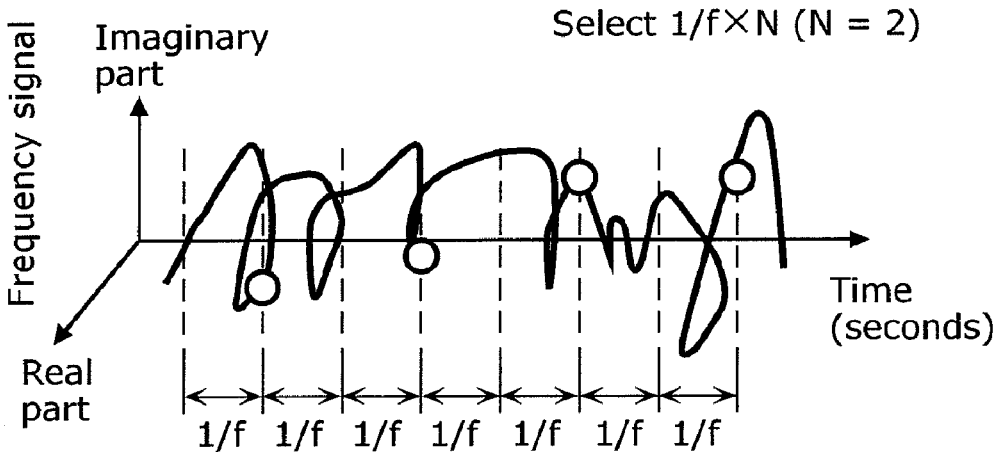
FIG. 13A is a diagram for explaining another example of the method for selecting a frequency signal.
Figure 13B:
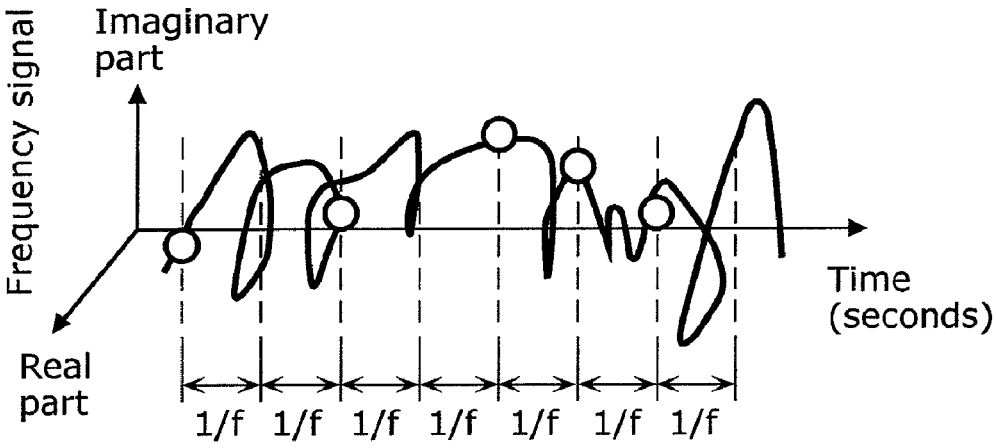
FIG. 13B is a diagram for explaining another example of the method for selecting a frequency signal.

Here, different methods for selecting the frequency signals are shown in FIGS. 13A and 13B. The display manner is the same as in FIG. 12 (*b*), and thus the detailed explanation is not repeated here. FIG. 13A shows an example in which the frequency signals of the times at time intervals of 1/f*N (N=2) are selected from the times at the time intervals of 1/f. FIG. 13B shows an example in which the frequency signals at the times randomly selected from the times at the time intervals of 1/f are selected. To be more specific, a method for selecting the frequency signals may be any method employed for selecting the frequency signals obtained from the times at the time intervals of 1/f. Note, however, that the number of the selected frequency signals needs to be equal to or larger than the first threshold value.

The frequency signal selection unit 200 (*j*) also sets a time range (a predetermined duration) of the frequency signals used by the phase distance determination unit 201 (*j*) for calculating the phase distances. A method for setting the time range will be explained later together with the explanation about the phase distance determination unit 201 (*j*).

Next, the phase distance determination unit 201 (*j*) calculates the phase distances using all the frequency signals selected by the frequency signal selection unit 200 (*j*) (step S401 (*j*)). In this case here, as a phase distance, the reciprocal of a correlation value between the frequency signals normalized by the power is used.

Figure 14:
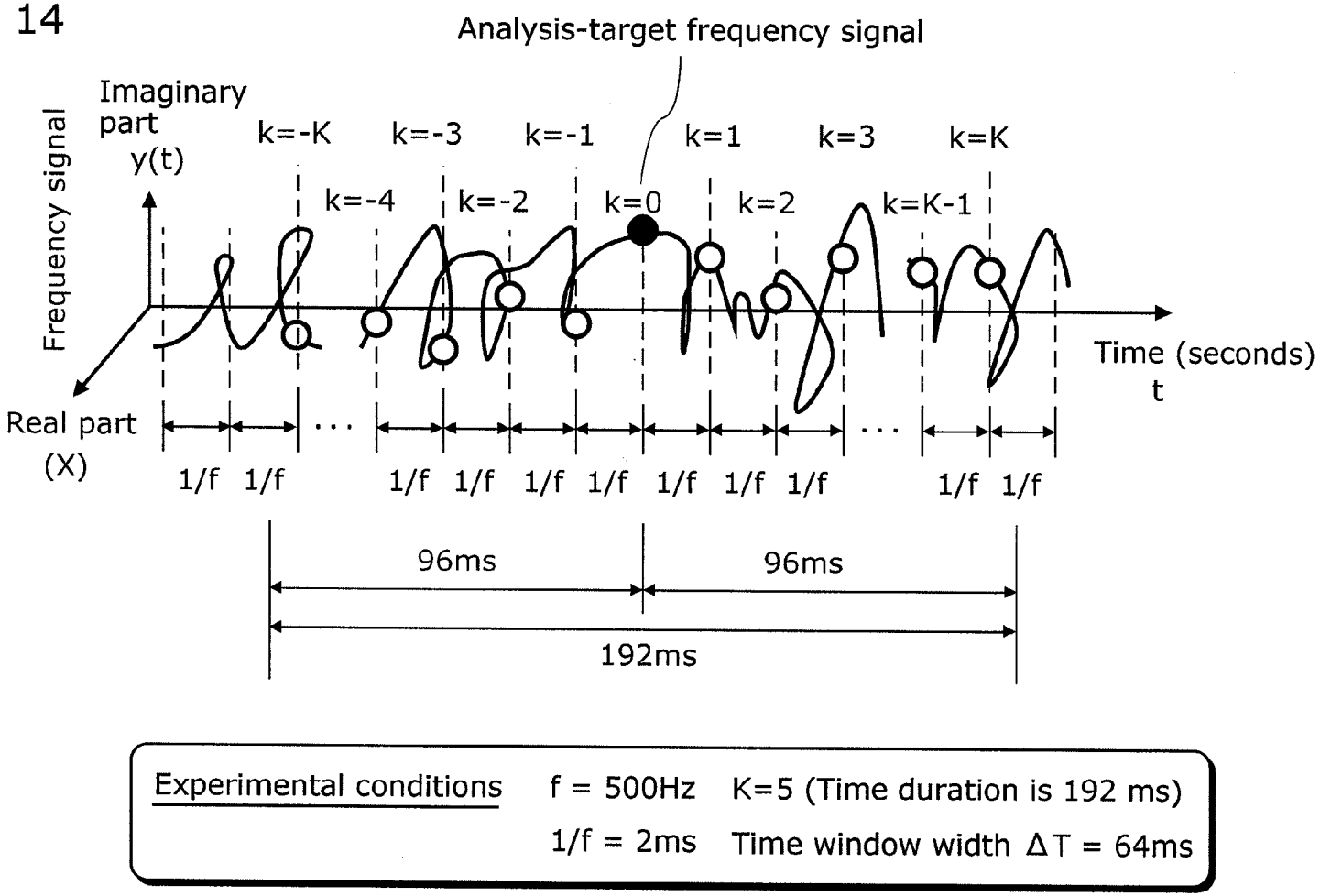
FIG. 14 is a diagram for explaining an example of a method for calculating a phase distance.

FIG. 14 shows an example of a method for calculating the phase distances. Regarding the display manner of FIG. 14, the same parts as in FIG. 12 (*b*) are not explained. In FIG. 14, the frequency signal of the analysis-target time is indicated by a filled circle and the selected frequency signals at the times other than the analysis-target time are indicated by open circles.

In the present example, from the times at the time intervals of 1/f (=2 ms) existing within ±96 ms from the analysis-target time (the time indicated by the filled circle) (the predetermined duration is 192 ms), the frequency signals at the times other than the analysis-target time (that is, the times indicated by the open circles) are the frequency signals used for calculating the phase distances with respect to the analysis-target frequency signal. The time length of the predetermined duration here is a value experimentally obtained from the characteristics of the sound which is the to-be-extracted sound.

Here, a method for calculating the phase distances is explained as follows. In this example, the phase distances are calculated using the frequency signals at the time intervals of 1/f. Note that, in the following, the real part of a frequency signal is expressed as follows.

$$x_k(k=-K, \ldots, -2, 1, 0, 1, 2, \ldots, K) \quad \text{[Formula 2]}$$

Also note that the imaginary part of the frequency signal is expressed as follows.

$$y_k(k=-K, \ldots, -2, -1, 0, 1, 2, \ldots, K)$$

In this example, the symbol k represents a number identifying a frequency signal. The frequency signal expressed by k=0 represents the frequency signal at the analysis-target time. The frequency signals with k which is other than 0 (that is, k=−K, . . . , −2, −1, 1, 2, . . . , K) are the frequency signals used for calculating the phase distances with respect to the frequency signal at the analysis-target time (see FIG. 14).

Here, in order to calculate the phase distances, the frequency signals normalized by the magnitude of power of the frequency signals are obtained. A value obtained by normalizing the real part of the frequency signal is as follows.

$$x'_k = \frac{x_k}{\sqrt{(x_k)^2 + (y_k)^2}} \quad \text{[Formula 4]}$$

$$(k = -K, \ldots, -2, -1, 0, 1, 2, \ldots, K)$$

Also, a value obtained by normalizing the imaginary part of the frequency signal is as follows.

$$y'_k = \frac{y_k}{\sqrt{(x_k)^2 + (y_k)^2}} \quad \text{[Formula 5]}$$

$$(k = -K, \ldots, -2, -1, 0, 1, 2, \ldots, K)$$

A phase distance S is calculated using the following formula.

$$S = 1 \Big/ \left( \sum_{k=-K}^{k=1} (x'_0 \times x'_k + y'_0 \times y'_k) + \sum_{k=1}^{k=K} (x'_0 \times x'_k + y'_0 \times y'_k) + \alpha \right) \quad \text{[Fomula 6]}$$

Since the frequency signal here is represented by ψ'(t)=mod 2π(ψ(t)−2πft)=ψ(t), the phase distance can be calculated using the frequency signal as it is.

The following are different methods for calculating the phase distance S: a method whereby normalization is performed using the total number of the frequency signals in the calculation of the correlation value as follows, $$S = 1 \Big/ \left( 1/2K \left( \sum_{k=-K}^{k=1} (x'_0 \times x'_k + y'_0 \times y'_k) + \sum_{k=1}^{k=K} (x'_0 \times x'_k + y'_0 \times y'_k) \right) + \alpha \right) \quad \text{[Formula 7]}$$

; a method whereby a phase distance between the frequency signals at the analysis-target time is added as well, as follows, $$S = 1 \Big/ \left( \sum_{k=-K}^{k=K} (x'_0 \times x'_k + y'_0 \times y'_k) + \alpha \right) \quad \text{[Formula 8]}$$

; a method whereby a difference error of the frequency signals is used as follows, $$S = 1/2K + 1 \sum_{k=-K}^{k=K} \sqrt{(x'_0 - x'_k)^2 + (y'_0 - y'_k)^2} \quad \text{[Formula 9]}$$

; a method whereby a difference error of the phases is used as follows, $$S = 1/2K + 1 \sum_{k=-K}^{k=K} \left| \begin{matrix} \bmod 2\pi(\arctan(y_0/x_0)) - \\ \bmod 2\pi(\arctan(y_k/x_k)) \end{matrix} \right| \quad \text{[Formula 10]}$$

$$= 1/2K + 1 \sum_{k=-K}^{k=K} |\varphi(0) - \varphi(k)|$$

; and a method whereby a variance value of the phases is used. Since ψ'(t)=mod 2π(ψ(t)−2πft)=ψ(t), the phase distance can be easily calculated using ψ(t). Here, in Formulas 6, 7, and 8, $$\alpha \quad \text{[Formula 11]}$$

is a small value predetermined in order for S to diverge infinitely.

It should be noted that the phase distance may be calculated, considering that the phase values are toroidally linked (0 (radian) and 2 π (radian) are the same). For example, when the phase distance is calculated using the difference error of the phases as represented by Formula 10, the phase distance may be calculated by representing the right-hand side as follows.

$$|\bmod 2\pi(\arctan(y_0/x_0))-\bmod 2\pi(\arctan(y_k/x_k))| \equiv \min\{|\bmod 2\pi(\arctan(y_0/x_0))-\bmod 2\pi(\arctan(y_k/x_k))|, |\bmod 2\pi(\arctan(y_0/x_0))-(\bmod 2\pi(\arctan(y_k/x_k))+2\pi)|, |\bmod 2\pi(\arctan(y_0/x_0))-(\bmod 2\pi(\arctan(y_k/x_k))-2\pi)|\} \quad \text{[Formula 12]}$$

Next, the phase distance determination unit 201 (*j*) determines each of the frequency signals, which are the analysis targets and whose phase distances each are equal to or smaller than the second threshold value, as the frequency signal 2408 of the to-be-extracted sound (the voice sound) (step S402 (*j*)). The second threshold value is set to a value experimentally obtained on the basis of the phase distance between the voice sound and the white noise in the time duration of 192 ms (the predetermined duration).

These processes are performed so that the frequency signals at all the times obtained while the time shift is being performed by 1 pt (0.0625 ms) in the direction of the time axis are the analysis-target frequency signals.

Lastly, the sound extraction unit 202 (*j*) extracts the frequency signal determined by the to-be-extracted sound determination unit 101 (*j*) as the frequency signal 2408 of the to-be-extracted sound, so that the noise is eliminated.

Figure 15:
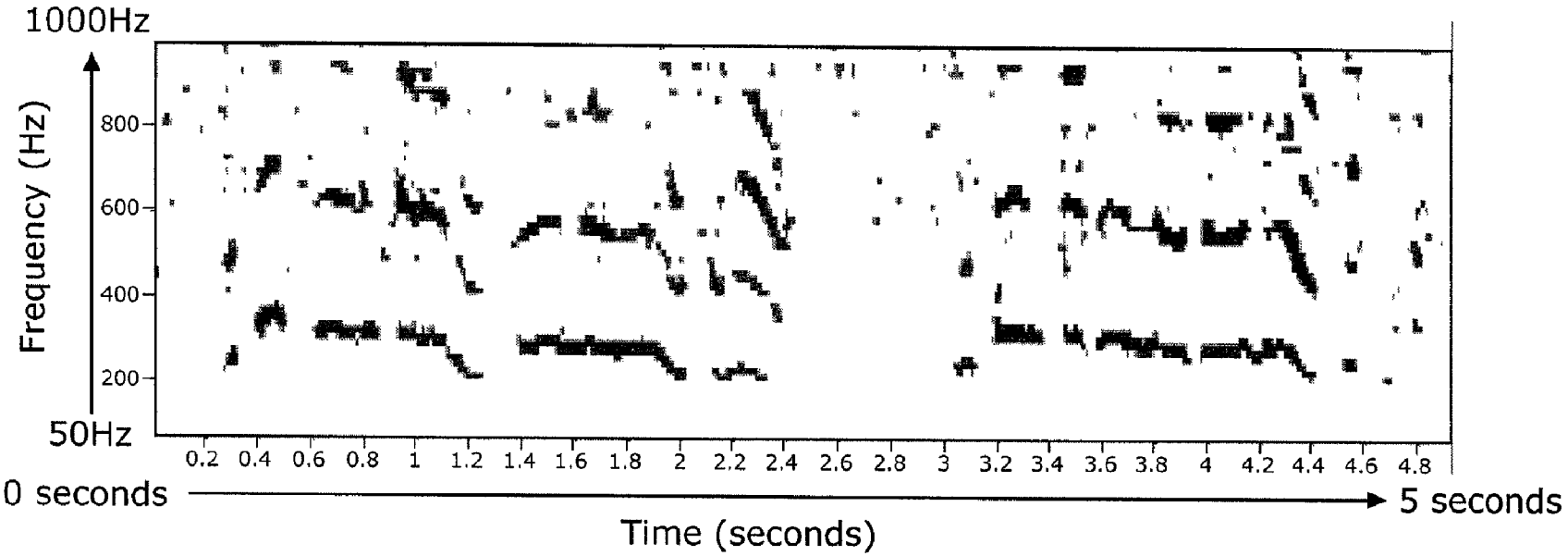
FIG. 15 is a diagram showing a spectrogram of a sound extracted from the mixed sound 2401.

FIG. 15 shows an example of a spectrogram of a sound extracted from the mixed sound 2401 shown in FIG. 10. The display manner is the same as in FIG. 10, and thus the detailed explanation is not repeated here. It can be seen that the frequency signal of the sound is extracted from the mixed sound in which the harmonic structure of the sound is partially lost.

Figure 16:
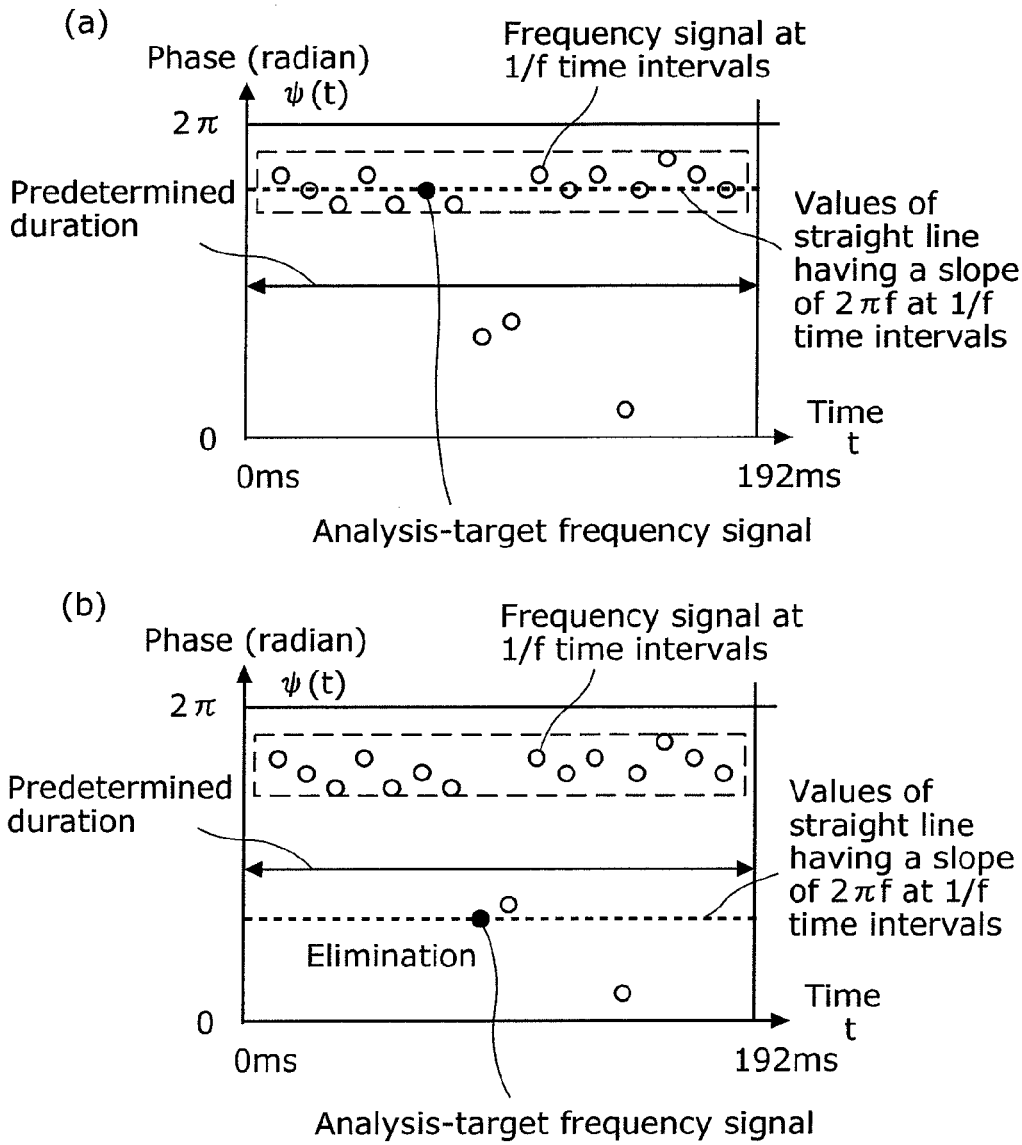
FIG. 16 is a schematic diagram showing phases of frequency signals of the mixed sound in a time range (a predetermined duration) where phase distances are to be calculated.

Here, consideration is given to the phase of the frequency signal eliminated as noise. In this case here, the second threshold value is set to $\pi/2$ (radian). FIG. 16 is a schematic diagram showing the phases of the frequency signals of the mixed sound in the predetermined duration in which the phase distances are to be calculated. The horizontal axis is a time axis and the vertical axis is a phase axis. A filled circle indicates the phase of the analysis-target frequency signal, and open circles indicate the phases of the frequency signals whose phase distances are to be calculated with respect to the analysis-target frequency signal. In this example, the phases of the frequency signals at the time intervals of 1/f are shown. As shown in FIG. 16 (*a*), obtaining the phase distance when $\psi'(t)=\bmod 2\pi(\psi(t)-2\pi ft)$ (where f is the analysis-target frequency) is the same as to obtaining a distance at $\psi(t)$ with respect to a straight line which passes through the phase $\psi(t)$ of the analysis-target frequency signal and which has a slope of $2\pi f$ with respect to the time t (that is, the horizontal straight line with respect to the time axis in the case of the time intervals of 1/f). In FIG. 16 (*a*), since the phases of the frequency signals are concentrated around this straight line, each phase distance with respect to the frequency signals, the number of which is equal to or larger than the first threshold, is equal to or smaller than the second threshold value. Thus, the analysis-target frequency signal is determined as the frequency signal of the to-be-extracted sound. Moreover, as shown in FIG. 16 (*b*), when the frequency signals are hardly present around a straight line which passes through the phase of the analysis-target frequency signal and which has a slope of $2\pi f$ with respect to the time, this means that each phase distance with respect to the frequency signals, the number of which is equal to or larger than the first threshold value, is larger than the second threshold value. Thus, the target frequency signal is not determined as the frequency signal of the to-be-extracted sound and, therefore, is eliminated as noise.

According to the described configuration, discrimination can be made between a toned sound, such as an engine sound, a siren sound, and a voice, and a toneless sound, such as wind noise, a sound of rain, and background noise, for each time-frequency domain using the phase distance obtained when the phase of the frequency signal at the time t is $\psi(t)$ (radian) and the phase is represented by $\psi'(t)=\bmod 2\pi(\psi(t)-2\pi ft)$ (where f is the analysis-target frequency). Also, the frequency signal of the toned sound (or, the toneless sound) can be determined.

Moreover, in the case of the frequency signals at the time intervals of 1/f (where f is the analysis-target frequency), $\psi'(t)=\bmod 2\pi(\psi(t)-2\pi ft)=\psi(t)$. Thus, the phase distance can be easily calculated using $\psi(t)$.

Here, the phase distance using $\psi'(t)=\bmod 2\ (\psi(t)-2\pi ft)$ (where f is the analysis-target frequency) is explained as follows. As explained with reference to FIG. 3A, the phase of the frequency signal of a toned sound (having a component of the frequency f) cyclically rotates at an isometric speed by $2\pi$ (radian) in the time interval of 1/f in the predetermined duration.

Figure 17:
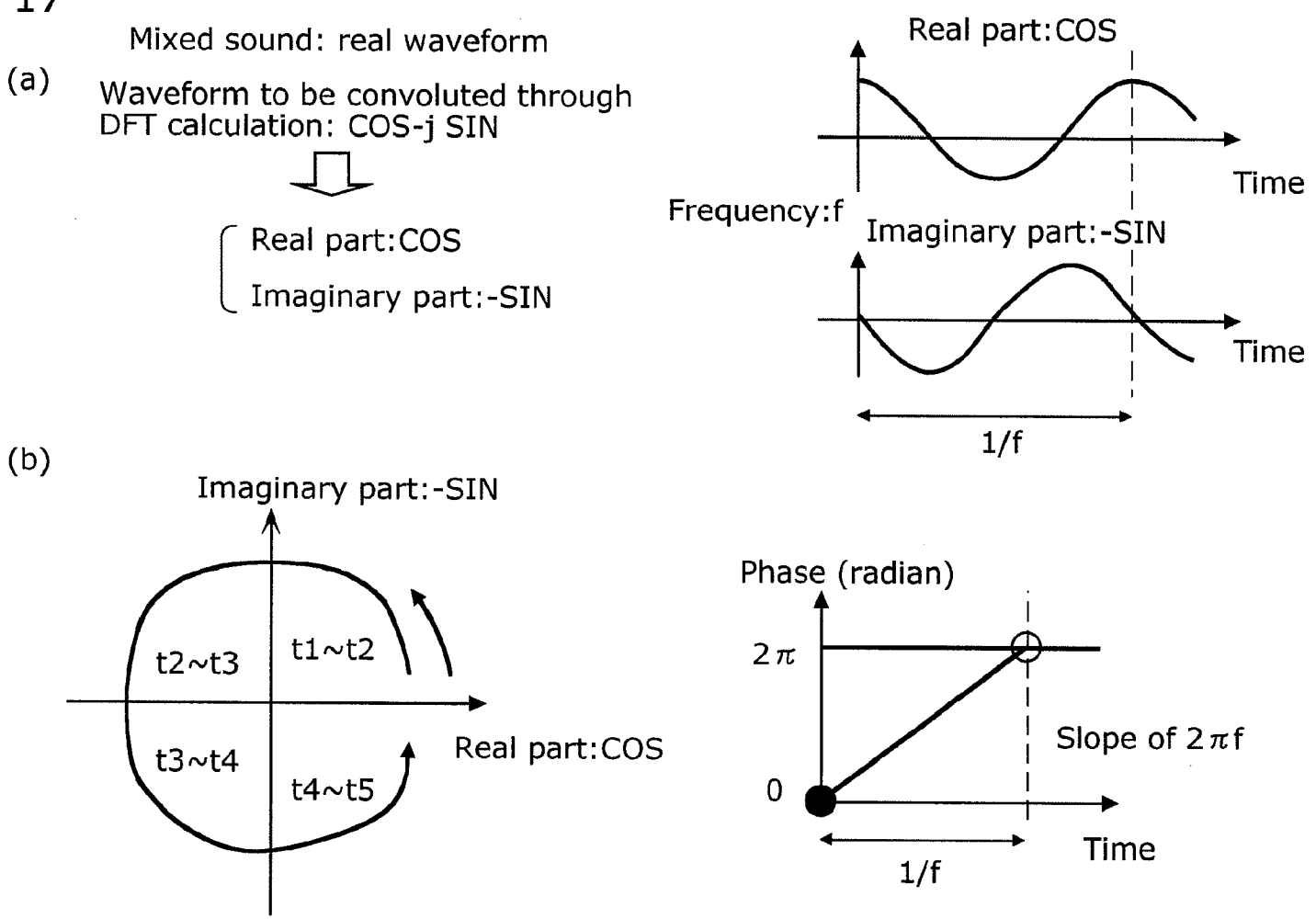
FIG. 17 is a diagram for explaining a phase distance when $\psi'(t)=\mathrm{mod}\ 2\pi\ (\psi(t)-2\pi ft)$ (where f is the analysis-target frequency).
Figure 18:
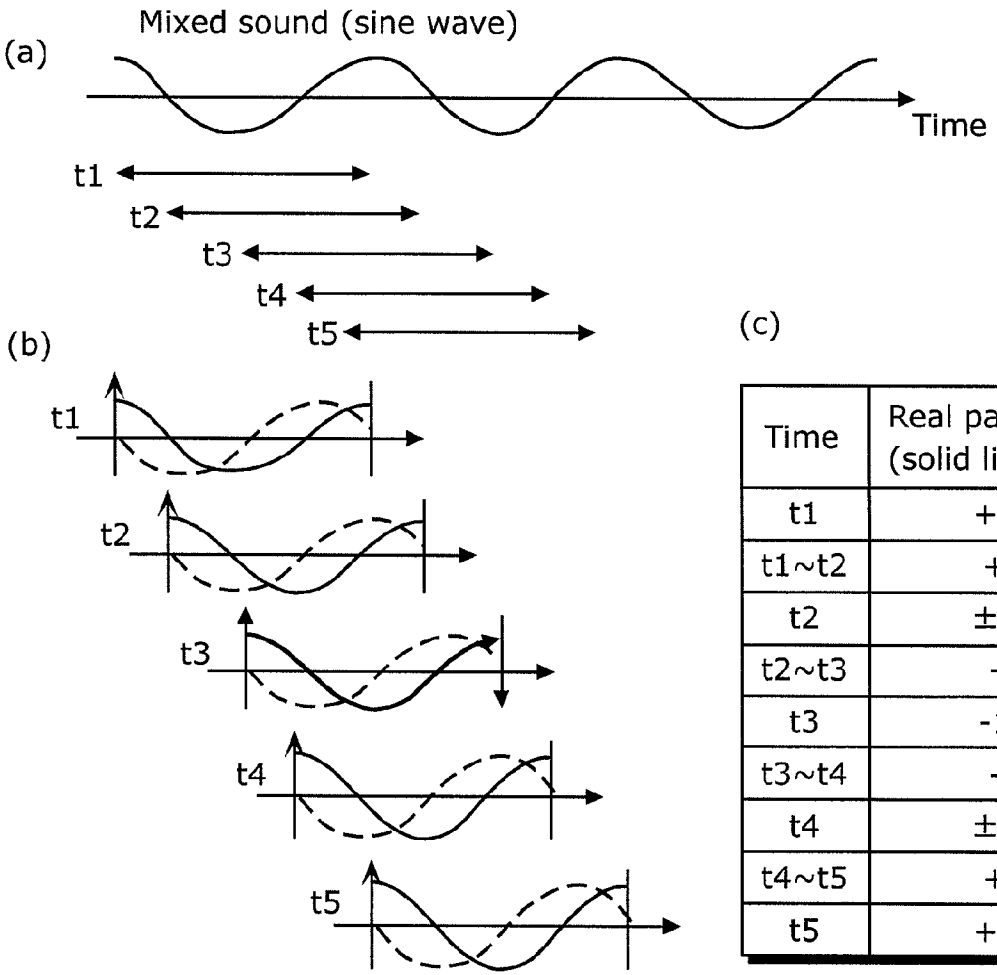
FIG. 18 is a diagram for explaining how the time variation of the phase becomes counterclockwise.

FIG. 17 (*a*) shows waveforms of the signal to be convoluted with the to-be-extracted sound through calculation according to DFT (Discrete Fourier Transform) when frequency analysis is performed. The real part is represented by a cosine waveform, and the imaginary part is represented by a negative sine waveform. In this case here, analysis is performed on the signal of the frequency f. When the to-be-extracted sound is represented by a sine wave of the frequency f, the time variation of the phase $\psi(t)$ of the frequency signal when the frequency analysis is performed is in a counterclockwise direction as shown in FIG. 17 (*b*). Here, the horizontal axis represents the real part, and the vertical axis represents the imaginary part. Supposing that the counterclockwise direction is positive, the phase $\psi(t)$ increases by $2\pi$ (radian) in a period of 1/f. It can be also said that the phase $\psi(t)$ varies at a slope of $2\pi f$ with respect to the time t. With reference to FIG. 18, an explanation is given as to how the time variation of the phase $\psi(t)$ is in the counterclockwise direction. FIG. 18 (*a*) shows a to-be-extracted sound (a sine wave of the frequency f). In this case here, the magnitude of the amplitude (the magnitude of the power) of the to-be-extracted sound is normalized to 1. FIG. 18 (*b*) shows waveforms of the signal (the frequency f) to be convoluted with the to-be-extracted sound through DFT calculation when frequency analysis is performed. Each solid line represents the cosine waveform of the real part, and each dashed line represents the negative sine waveform of the imaginary part. FIG. 18 (*c*) shows signs of values obtained when the to-be-extracted sound of FIG. 18 (*a*) and the waveforms of FIG. 18 (*b*) are convoluted through DFT calculation. It can be seen from FIG. 18 (*c*) that the phase varies: in a first quadrant of FIG. 17 (*b*) when the time is expressed as (t1 to t2); in a second quadrant of FIG. 17 (*b*) when the time is expressed as (t2 to t3); in a third quadrant of FIG. 17 (*b*) when the time is expressed as (t3 to t4); and in a fourth quadrant of FIG. 17 (*b*) when the time is expressed as (t4 to t5). From this, it can be understood that the time variation of the phase $\psi(t)$ is in the counterclockwise direction.

Figure 19:
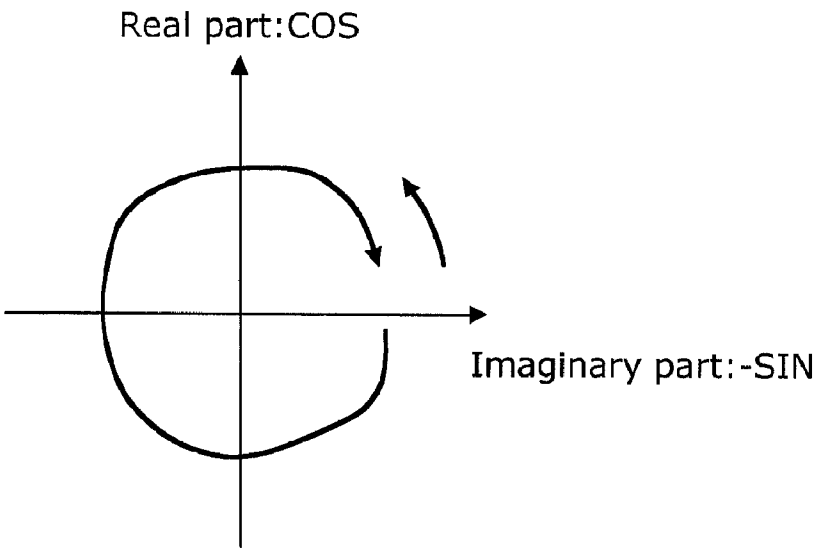
FIG. 19 is a diagram for explaining a phase distance when $\psi'(t)=\mathrm{mod}\ 2\pi(\psi(t)-2\pi ft)$ (where f is an analysis-target frequency).
Figure 19:
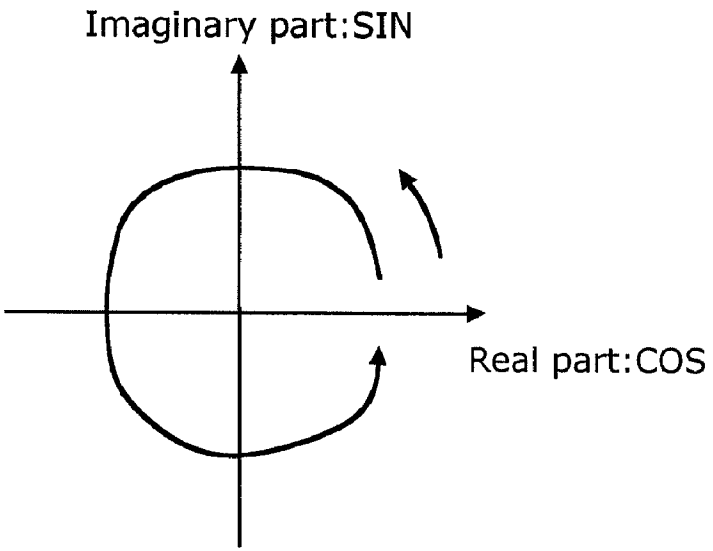

As a supplementary explanation, the variation in the phase $\psi(t)$ is reversed when the horizontal axis represents the imaginary part and the vertical axis represents the real part, as shown in FIG. 19 (*a*). Supposing that the counterclockwise direction is positive, the phase $\psi(t)$ decreases by $2\pi$ (radian) in a period of 1/f. To be more specific, the phase $\psi(t)$ varies at a slope of $(-2\pi f)$ with respect to the time t. However, in this case here, the explanation is given on the assumption that the phase is modified corresponding to the way of the axes as shown in FIG. 17 (*b*). Similarly, as to the waveforms to be convoluted when the frequency analysis is performed, when the real part represents the cosine waveform and the imaginary part represents the sine waveform, the variation in the phase $\psi(t)$ is reversed. Supposing that the counterclockwise direction is positive, the phase $\psi(t)$ decreases by $2\pi$ (radian) in a period of 1/f. To be more specific, the phase $\psi(t)$ varies at a slope of $(-2\pi f)$ with respect to the time t. However, in this case here, the explanation is given on the assumption that the signs of the real part and the imaginary part are modified corresponding to the result of the frequency analysis of FIG. 17 (*a*).

From this, since the phase $\psi(t)$ of the frequency signal of the toned sound varies at a slope of $2\pi f$ with respect to the time t, the phase distance is small in the case where $\psi'(t)=\mathrm{mod}\ 2\pi(\psi(t)-2\pi ft)$ (where f is the analysis-target frequency).

First Modification of First Embodiment)

Next, the first modification of the noise elimination device described in the first embodiment is explained.

In the present modification, the explanation is given about the case, as an example, where a mixed sound of a 100-Hz sine wave, a 200-Hz sine wave, and a 300-Hz sine wave is used as the mixed sound 2401. In this example, an object is to eliminate a frequency signal distorted due to frequency leakage from the 100-Hz sine wave and the 300-Hz sine wave, from the 200-Hz sine wave (a to-be-extracted sound) included in the mixed sound. Precise elimination of the frequency signal distorted due to the frequency leakage allows a frequency structure of an engine sound included in the mixed sound to be precisely analyzed, so that the approach of a vehicle can be detected through the Doppler shift or the like. Moreover, a format structure of a voice included in the mixed sound can be precisely analyzed.

Figure 20:
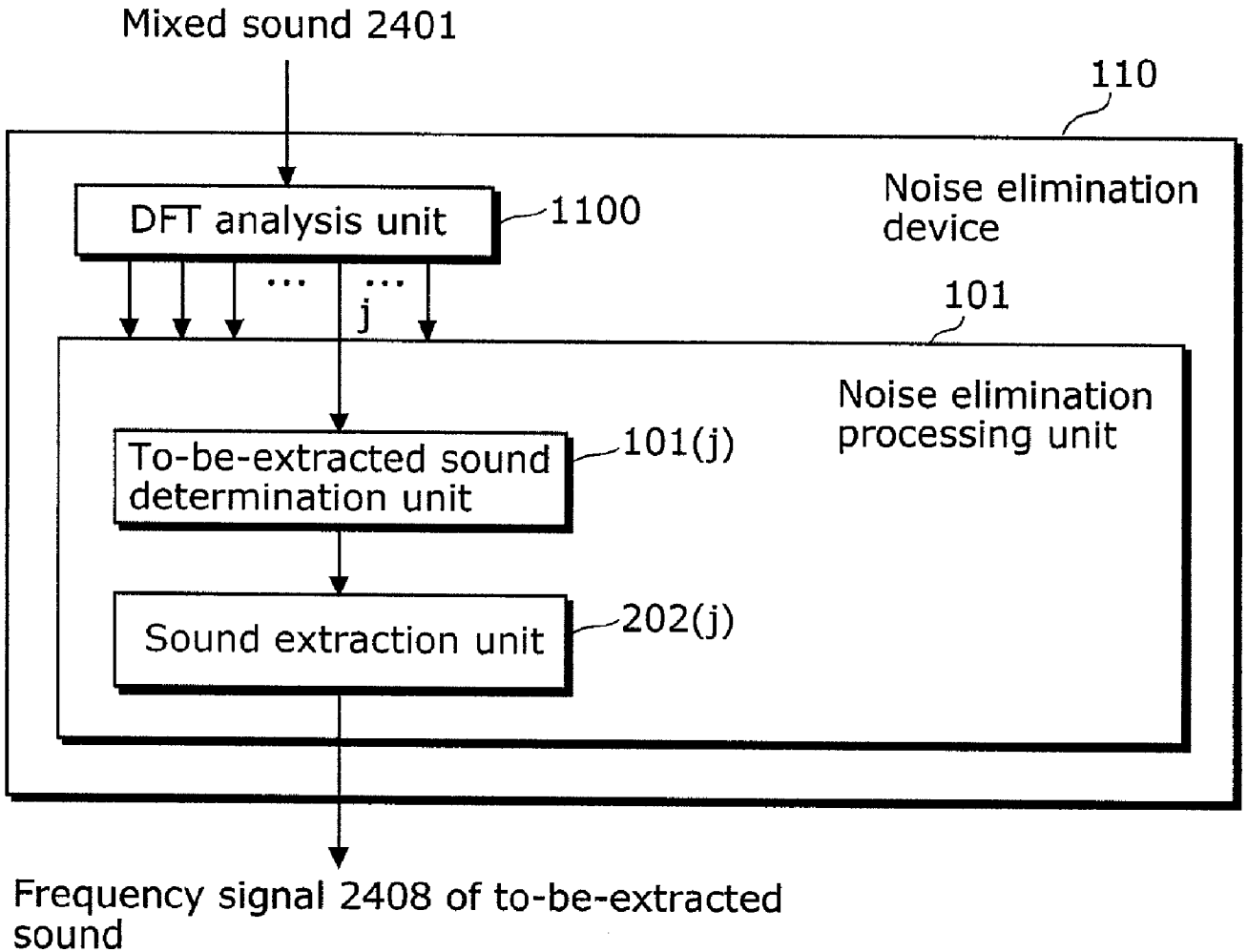
FIG. 20 is a block diagram showing an entire configuration of another noise elimination device according to the first embodiment of the present invention.

FIG. 20 is a block diagram showing a configuration of a noise elimination device according to the first modification.

In FIG. 20, components which are the same as those in FIG. 6 are indicated by the same referential numerals used in FIG. 6, and the detailed explanations about these components are not repeated here. The noise elimination device in the present example is different from the noise elimination device of the first embodiment in that a DFT (Discrete Fourier Transform) analysis unit 1100 (a frequency analysis unit) is used in place of the FFT analysis unit 2402. The other processing units in the present example are identical to those included in the noise elimination device according to the first embodiment. Flowcharts showing the operation procedures performed by a noise elimination device 110 are the same as those in the first embodiment, and are shown in FIGS. 8 and 9.

Figure 21:
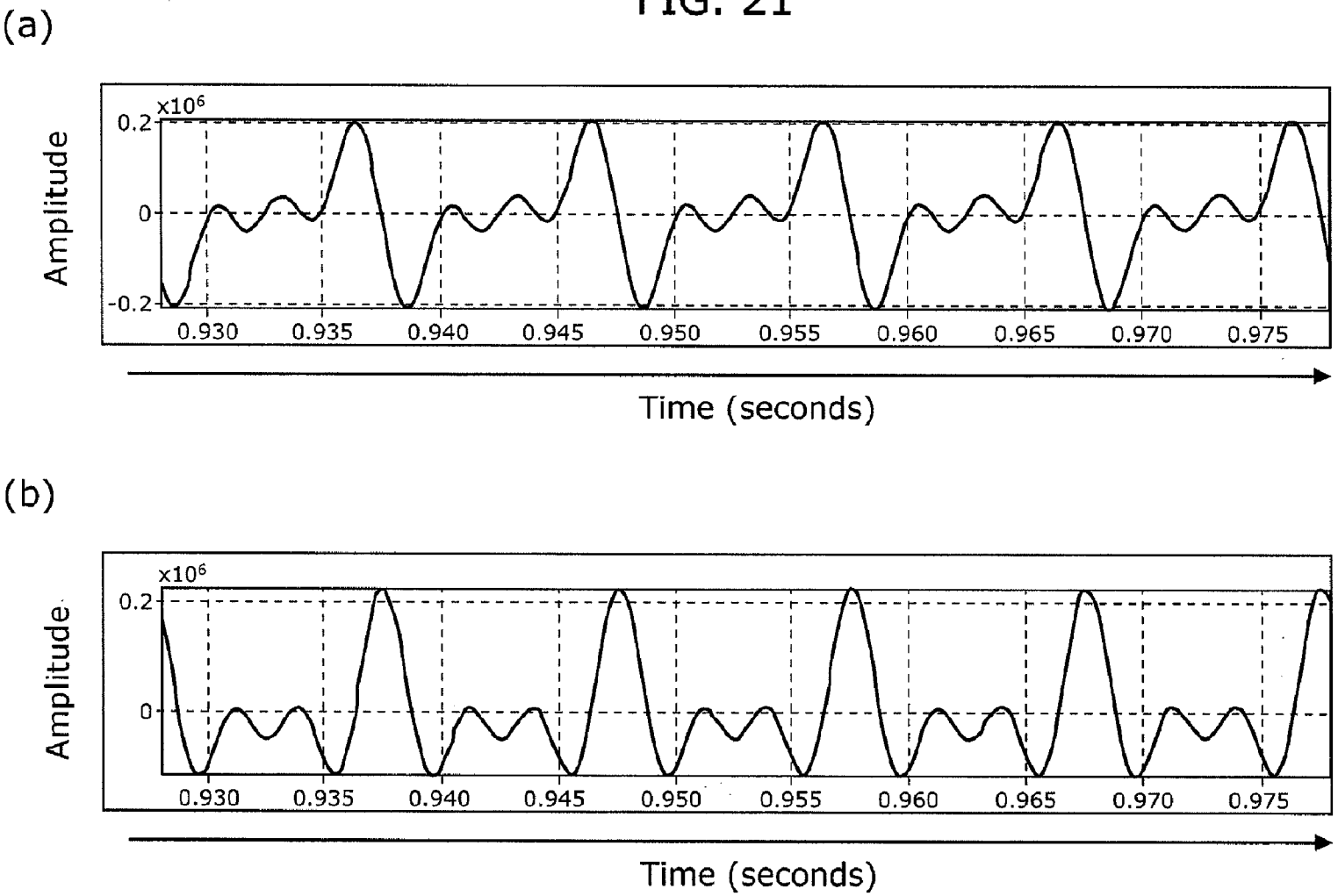
FIG. 21 is a diagram showing a temporal waveform of a frequency signal of the mixed sound 2401 at 200 Hz.

FIG. 21 shows an example of a temporal waveform of a frequency signal at a frequency of 200 Hz when the mixed sound 2401 including the 100-Hz sine wave, the 200-Hz sine wave, and the 300-Hz sine wave is used. FIG. 21 (*a*) shows a temporal waveform of the real part of the frequency signal at a frequency of 200 Hz, and FIG. 21 (*b*) shows a temporal waveform of the imaginary part of the frequency signal at a frequency of 200 Hz. The horizontal axis is a time axis, and the vertical axis represents the amplitude of the frequency signal. In this case here, temporal waveforms of a time length of 50 ms are shown.

Figure 22:
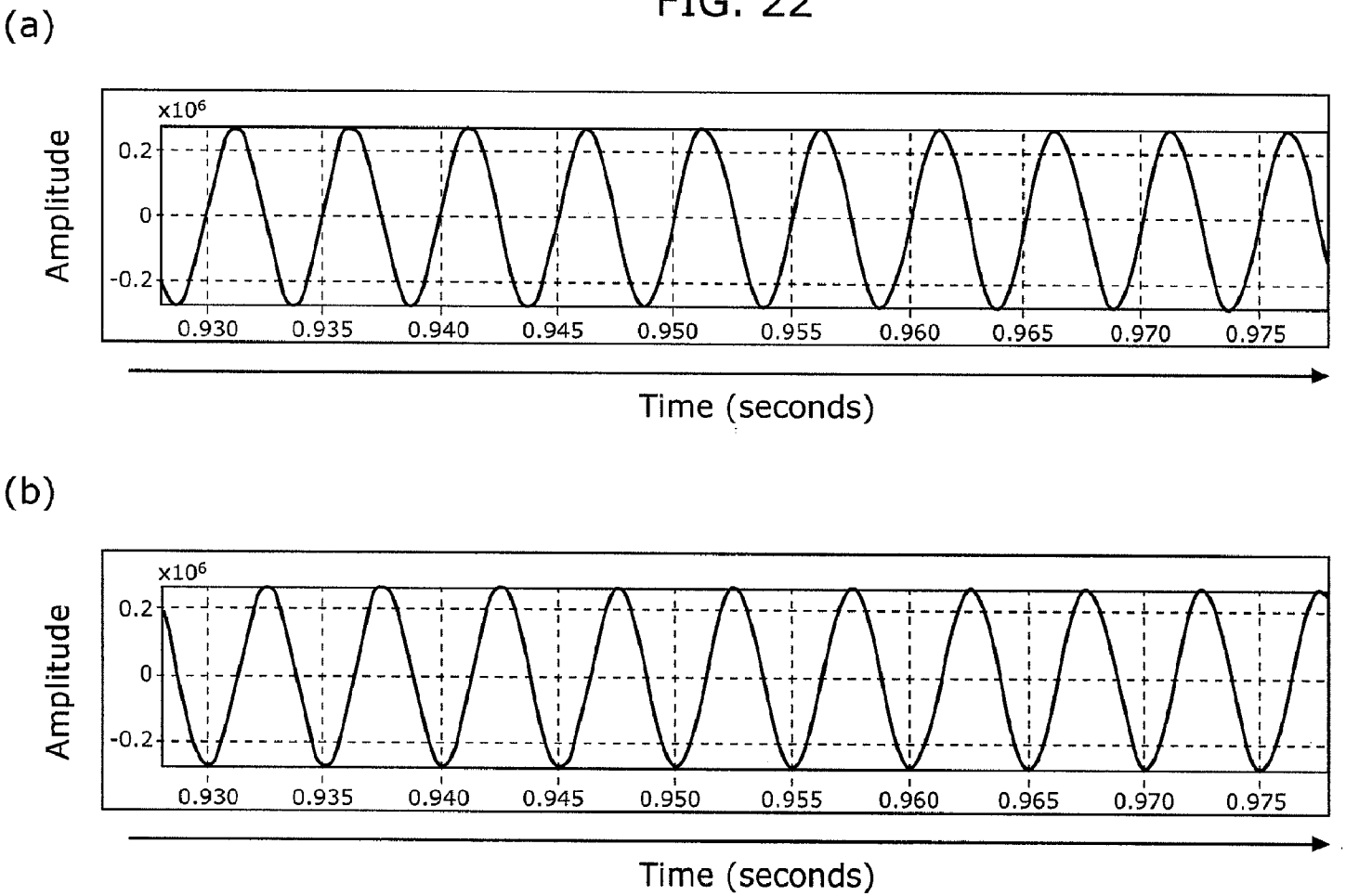
FIG. 22 is a diagram showing a temporal waveform of a frequency signal of a 200-Hz sine wave used when the mixed sound 2401 is created.

FIG. 22 shows a temporal waveform of the frequency signal, at 200 Hz, of a 200-Hz sine wave used when the mixed sound 2401 shown in FIG. 21 is created. The display manner is the same as in FIG. 21, and the detailed explanation is not repeated here.

From FIGS. 21 and 22, it can be seen that distorted parts exist in the 200-Hz sine wave of the mixed sound 2401, due to the influence of frequency leakage from the 100-Hz sine wave and the 300-Hz sine wave.

First, the DFT analysis unit 1100 receives the mixed sound 2401 and performs the discrete Fourier transform processing on the mixed sound 2401 to obtain the frequency signal of the mixed sound 2401 at a center frequency of 200 Hz (step S300). In this example, the analysis-target frequency f is 200 Hz as well. As a condition of the discrete Fourier transform processing in this example, the mixed sound 2401 sampled at a sampling frequency=16000 Hz is processed using the Hanning window with a time window width $\Delta T$=5 ms (80 pt). Moreover, the frequency signal is obtained for each of the times while the time shift is being performed by 1 pt (0.0625 ms) in the direction of the time axis. The temporal waveforms of the frequency signal obtained as a result of this processing are shown in FIG. 21.

Next, the noise elimination processing unit 101 determines the frequency signal of the to-be-extracted sound from the mixed sound for each time-frequency domain using the to-be-extracted sound determination unit 101 (*j*) (j=1 to M) for each frequency band j (j=1 to M) of the frequency signal obtained by the DFT analysis unit 1100 (step S301 (*j*) (j=1 to M)). Then, the noise elimination processing unit 101 uses the sound extraction unit 202 (*j*) (j=1 to M) to extract the frequency signal of the to-be-extracted sound determined by the to-be-extracted sound determination unit 101 (*j*) so that the noise is eliminated (step S302 (*j*) (j=1 to M)). In this example, M=1 and the center frequency of the $j=1^{st}$ frequency band is expresses as f=200 Hz (the same value as the analysis-target frequency). Although what follows is an explanation about the case where j=1, the same processing is performed when j is a different value.

Using the frequency signals at all the times at the time intervals of 1/f (where f is the analysis-target frequency) included in a predetermined duration (100 ms), the to-be-extracted sound determination unit 101 (1) calculates phase distances between the frequency signal at a analysis-target time and the respective frequency signals at all the times other than the analysis-target time. In this example, when the number of the frequency signals at the time intervals of 1/f included in the predetermined duration is equal to or larger than the first threshold value, the phase distances are calculated using all the frequency signals included in the predetermined duration. Then, the frequency signal at the analysis-target time where the phase distance is equal to or smaller than the second threshold value is determined as the frequency signal 2408 of the to-be-extracted sound.

Lastly, the sound extraction unit 202 (1) extracts the frequency signal determined by the to-be-extracted sound determination unit 101 (1) as the frequency signal 2408 of the to-be-extracted sound, so that the noise is eliminated (step S302 (1)).

Next, the details of the processing performed in step S301 (1) are described. First, as in the case of the example described in the first embodiment, the frequency signal selection unit 200 (1) selects the frequency signals, the number of which is equal to or larger than the first threshold value, at the times at the time intervals of 1/f (f=200 Hz) in the predetermined duration (step S400 (1)).

Here, what is different from the example described in the first embodiment is a length of the time range (the predetermined duration) of the frequency signals used by the phase distance determination unit 201 (1) for calculating the phase distances. In the example of the first embodiment, the time range is 192 ms and the time window width $\Delta T$ for obtaining the frequency signals is 64 ms. In the present example, the time range is 100 ms and the time window width $\Delta T$ for obtaining the frequency signals is 5 ms.

Next, the phase distance determination unit 201 (1) calculates the phase distances using the phases of the frequency signals selected by the frequency signal selection unit 200 (1)

(step S401 (1)). The processing performed here is the same as the processing described in the first embodiment, and thus the detailed explanation is not repeated here. The phase distance determination unit 201 (1) determines the frequency signal at the analysis-target time where the phase distance S is equal to or smaller than the second threshold value, as the frequency signal 2408 of the to-be-extracted sound (step S402 (1)). Accordingly, undistorted parts of the frequency signal in the 200-Hz sine wave can be determined.

Lastly, the sound extraction unit 202 (1) extracts the frequency signal determined as the frequency signal 2408 of the to-be-extracted sound by the to-be-extracted sound determination unit 101 (1), so that the noise is eliminated (step S302 (1)). The processing performed here is the same as the processing described in the first embodiment, and thus the detailed explanation is not repeated here.

Figure 23:
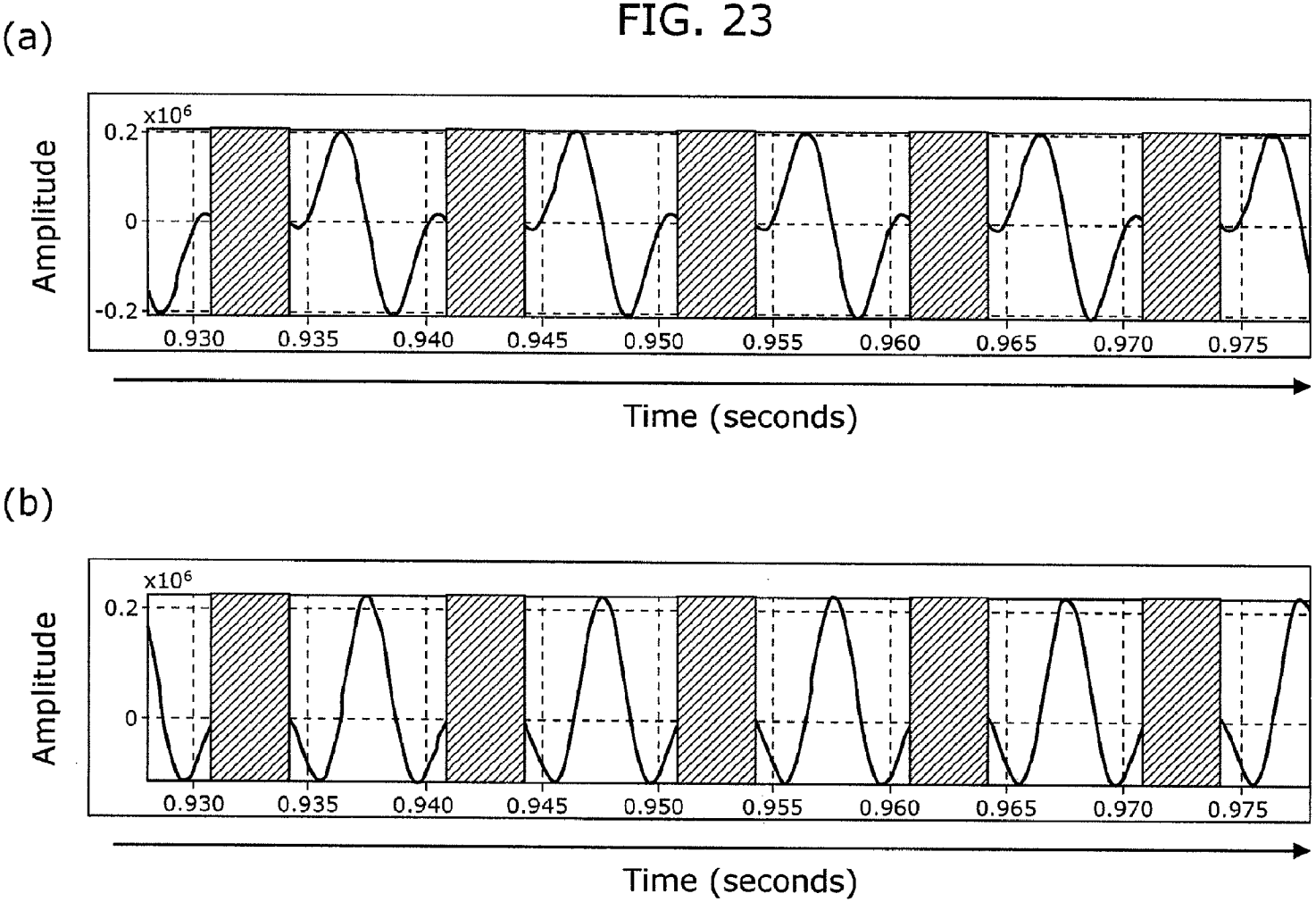
FIG. 23 is a diagram showing a temporal waveform of a 200-Hz frequency signal extracted from the mixed sound 2401.

FIG. 23 shows temporal waveforms of the frequency signal at 200 Hz extracted from the mixed sound 2401 shown in FIG. 21. Regarding the display manner, the same parts as in FIG. 21 are not explained. In FIG. 23, diagonally shaded areas represent parts where the frequency signals are eliminated because the signals are distorted due to the frequency leakage. When FIG. 23 is compared with FIGS. 21 and 22, it can be seen that the frequency signals distorted due to the frequency leakage from the 100-Hz sine wave and the frequency leakage from the 300-Hz sine wave are eliminated from the mixed sound 2401, and that the frequency signal of the 200-Hz sine wave is thus extracted.

Accordingly, using the phase distances between the frequency signal at the analysis-target time and the respective frequency signals at a plurality of times before and after the analysis-target time that also include the times beyond the ΔT time interval (the time window width for obtaining the frequency signals), the configurations described in the first embodiment and the first modification of the first embodiment have the effect of eliminating the frequency signals distorted due to the frequency leakage from the neighboring frequencies resulting from the influence caused when the temporal resolution (ΔT) is increased.

Second Modification of First Embodiment

Next, the second modification of the noise elimination device described in the first embodiment is explained.

A noise elimination device of the second modification has the same configuration as the noise elimination device of the first embodiment explained with reference to FIGS. 6 and 7. However, the processing performed by the noise elimination processing unit 101 is different in the present modification.

The phase distance determination unit 201 (*j*) of the to-be-extracted sound determination unit 101 (*j*) creates a phase histogram using the frequency signals, at the times at the time intervals of 1/f, selected by the frequency signal selection unit 200 (*j*). From the created histogram, the phase distance determination unit 201 (*j*) determines the frequency signal whose phase distance is equal to or smaller than the second threshold value and whose occurrence frequency is equal to or larger than the first threshold value, as the frequency signal 2408 of the to-be-extracted sound.

Lastly, the sound extraction unit 202 (*j*) extracts the frequency signal 2408 of the to-be-extracted sound determined by the phase distance determination unit 201 (*j*), so that the noise is eliminated.

Next, an explanation is given about an operation performed by the noise elimination device 100 configured as described so far. Flowcharts showing the operation procedures of the noise elimination device 100 are the same as those in the first embodiment and are shown in FIGS. 8 and 9.

The noise elimination processing unit 101 determines the frequency signal of the to-be-extracted sound using the to-be-extracted sound determination unit 101 (*j*) (j=1 to M) for each frequency band j (j=1 to M) of the frequency signal obtained by the FFT analysis unit 2402 (the frequency analysis unit) (step S301 (*j*) (j=1 to M)). The explanation after this is given only about the $j^{th}$ frequency band. The processing performed for the other frequency bands is the same. In this example, a center frequency of the $j^{th}$ frequency band is f.

The to-be-extracted sound determination unit 101 (*j*) creates a phase histogram using the frequency signals, at the times at the time intervals of 1/f, selected by the frequency signal selection unit 200 (*j*). Then, the to-be-extracted sound determination unit 101 (*j*) determines the frequency signal whose phase distance is equal to or smaller than the second threshold value and whose occurrence frequency is equal to or larger than the first threshold value, as the frequency signal 2408 of the to-be-extracted sound (step S301 (*j*)).

Using the frequency signals selected by the frequency signal selection unit 200 (*j*), the phase distance determination unit 201 (*j*) creates the phase histogram of the frequency signals and determines the phase distances (step S401 (*j*)). A method for obtaining the histogram is explained as follows.

Note that the frequency signals selected by the frequency signal selection unit 200 (*j*) are represented by Formula 2 and Formula 3. Here, the phase of the frequency signal is calculated using the following formula.

$$\phi_k=\arctan(y_k/x_k)(k=-K,\ldots,-2,-1,0,1,2,\ldots,K) \quad \text{[Formula 13]}$$

Figure 24:
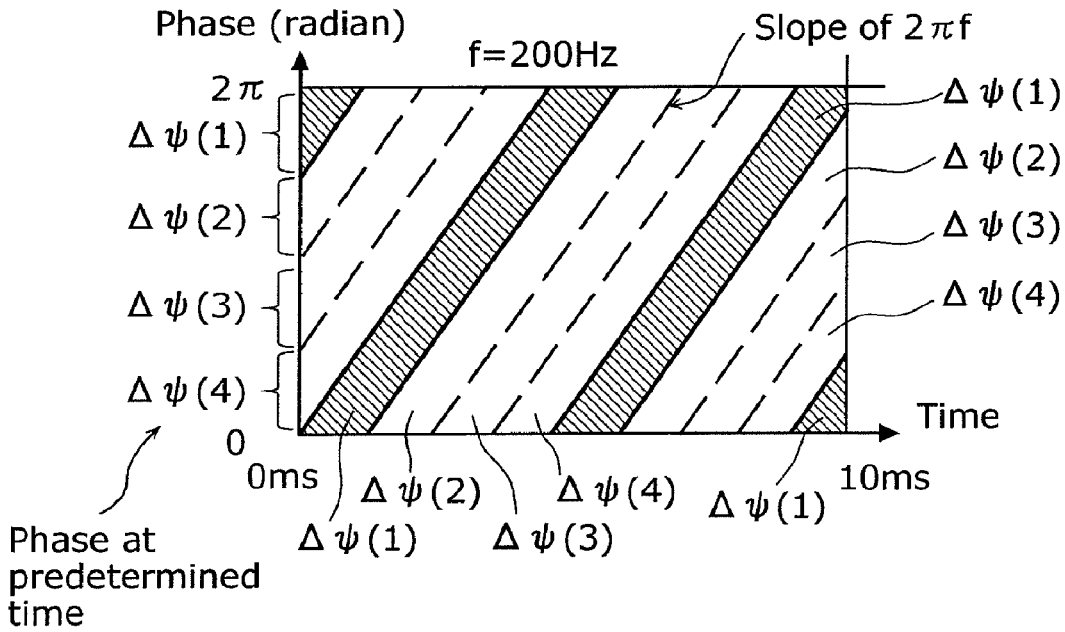
FIG. 24 is a diagram for explaining an example of a method for creating a histogram of a phase component of a frequency signal.

FIG. 24 shows an example of a method for creating a phase histogram of the frequency signal. In this example, the histogram is created by obtaining the occurrence frequency of the frequency signal in the predetermined duration for each band area where a phase domain is Δψ(i) (i=1 to 4) and the phase varies at a slope of 2πf (where f is the analysis-target frequency) with respect to the time. In FIG. 24, the diagonally shaded parts are the areas of Δψ(1). Since the phase is shown only from 0 to 2π (radian) in this diagram, the areas are drawn discretely. Here, the histogram can be created by counting the number of the frequency signals included in these areas for each Δψ(i) (i=1 to 4).

Figure 25:
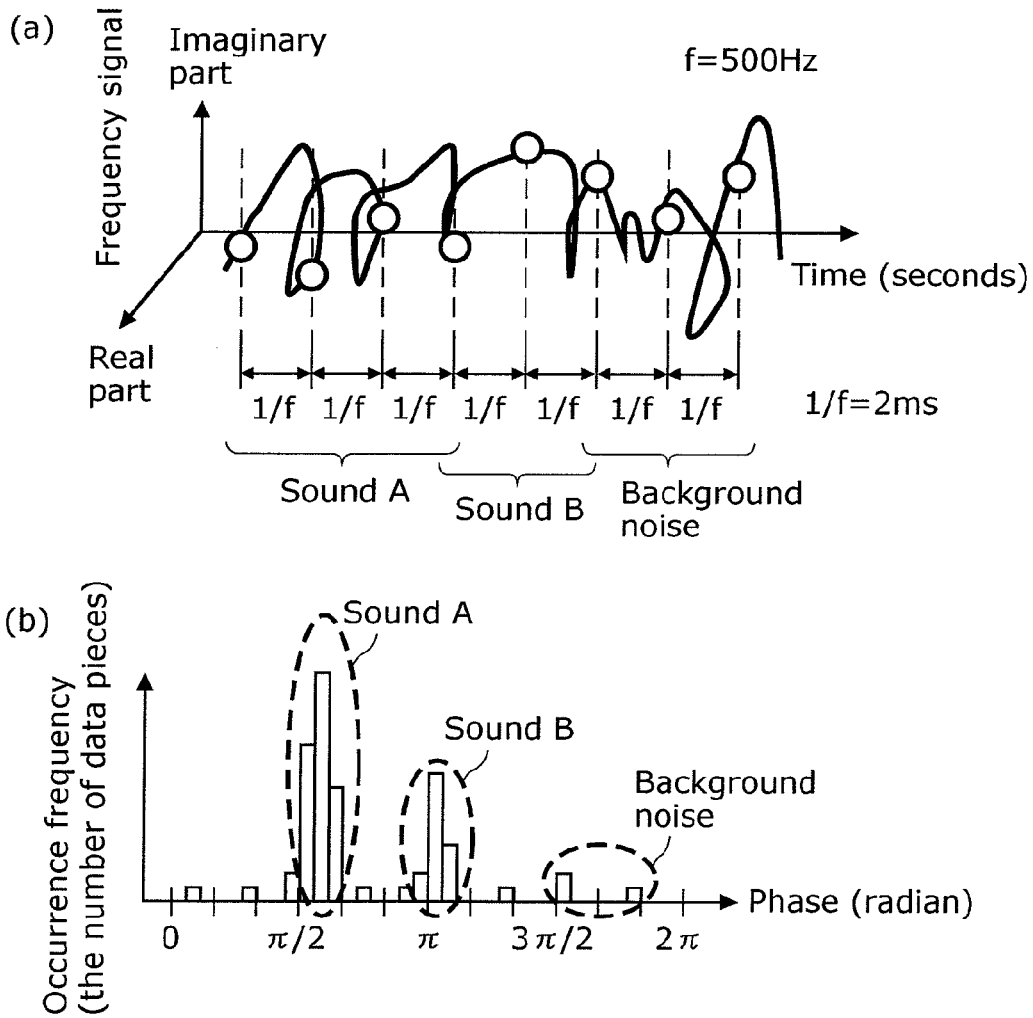
FIG. 25 is a diagram showing frequency signals selected by a frequency signal selection unit 200 (*j*) and an example of a phase histogram of the selected frequency signals.

FIG. 25 shows examples of the frequency signal selected by the frequency signal selection unit 200 (*j*) and the phase histogram of the selected frequency signal. In this case here, an analysis is performed using Δψ(i) (i=1 to L) finer than the histogram shown in FIG. 24.

FIG. 25 (*a*) shows the selected signal. The display manner of FIG. 25 (*a*) is the same as in FIG. 12 (*b*), and thus the detailed explanation is not repeated here. In this example, the selected signal includes frequency signals of a sound A (a toned sound), a sound B (a toned sound), and background noise (a toneless sound).

FIG. 25 (*b*) schematically shows an example of the phase histogram of the frequency signal. A group of the frequency signals of the sound A have similar phases (close to π/2 (radian) in this example), and a group of the frequency signals of the sound B have similar phases (close to π (radian) in this example). On account of this, two peaks are formed around π/2 (radian) and π (radian). Here, the frequency signal of the background noise does not have specific phases and, thus, no peak is formed in the histogram.

Then, the phase distance determination unit 201 (*j*) determines the frequency signals, whose phase distances each are equal to or smaller than the second threshold value (π/4 (radian) and whose occurrence frequency is equal to or larger than the first threshold value (30% of the number of all the frequency signals at the time intervals of 1/f included in the predetermined duration), as the frequency signals 2408 of the to-be-extracted sound. In the present example, the frequency signals near π/2 (radian) and the frequency signals near π (radian) are determined as the frequency signals 2408 of the to-be-extracted sound. Here, the phase distance between the frequency signal near π/2 (radian) and the frequency signal near π (radian) is equal to or larger than π/4 (radian) (a third threshold value). For this reason, these two groups of the frequency signals shown as the two peaks are determined as different kinds of the to-be-extracted sounds. To be more specific, discrimination can be made between the sound A and the sound B, which are thus determined as the frequency signals of two to-be-extracted sounds.

Lastly, the sound extraction unit 202 (*j*) extracts the frequency signals of the to-be-extracted sounds of different kinds determined by the phase distance determination unit 201 (*j*), so that the noise can be eliminated (step S402 (*j*)).

According to this configuration, the to-be-extracted sound determination unit creates a plurality of groups of the frequency signals, the number of the frequency signals included in each of the groups being equal to or larger than the first threshold value, and the degree of similarity in the phase between the frequency signals in the group being equal to or smaller than the second threshold value. Moreover, when the phase distance between the groups of the frequency signals is equal to or larger than the third threshold value, the to-be-extracted sound determination unit determines these groups of the frequency signals as the to-be-extracted sounds of different kinds. Through these processes, when a plurality of kinds of to-be-extracted sounds are present in the same time-frequency domain, these sounds can be determined in distinction from each other. For example, engine sounds of a plurality of vehicles can be determined in distinction from each other. On this account, when the noise elimination device of the present invention is applied to a vehicle detection device, the driver can be notified of the presence of a plurality of different vehicles and thus can drive safely. Moreover, voices of a plurality of persons can be determined in distinction from each other. On this account, when the noise elimination device is applied to a voice extraction device, the voices of the plurality of persons can be played by separation from each other.

When the noise elimination device of the present invention is built in an audio output device, for example, clear audio can be reproduced after inverse frequency transform is performed following the determination of the audio frequency signal from a mixed sound for each time-frequency domain. Also, when the noise elimination device of the present invention is built in a sound source direction detection device, for example, a precise direction of a sound source can be obtained by extracting the frequency signal of the to-be-extracted sound after the noise elimination. Moreover, when the noise elimination device of the present invention is built in a sound recognition device, for example, a precise sound recognition can be performed even when noise is present in the surroundings, by extracting an audio frequency signal from a mixed sound for each time-frequency domain. Furthermore, when the noise elimination device of the present invention is built in a sound identification device, for example, a precise sound identification can be performed even when noise is present in the surroundings, by extracting an audio frequency signal from a mixed sound for each time-frequency domain. Also, when the noise elimination device of the present invention is built into a different vehicle detection device, for example, the driver can be notified of the approach of a vehicle when a frequency signal of an engine sound is extracted from a mixed sound for each time-frequency domain. Moreover, when noise elimination device of the present invention is applied to an emergency vehicle detection device, for example, the driver can be notified of the approach of an emergency vehicle when a frequency signal of a siren sound is detected from a mixed sound for each time-frequency domain.

Also, considering that a frequency signal of noise (a toneless sound) which is not determined as the to-be-extracted sound (a toned sound) is extracted according to the present invention, when the noise elimination device of the present invention is built in a wind sound level determination device, for example, a frequency signal of wind noise can be extracted from a mixed sound for each time-frequency domain and an output of the calculated magnitude of power can be provided. Moreover, when the noise elimination device of the present invention is built in a vehicle detection device, for example, a frequency signal of a traveling sound caused by tire friction can be extracted from a mixed sound for each time-frequency domain and the approach of a vehicle can be thus detected on the basis of the magnitude of power.

It should be noted that cosine transform, wavelet transform, or a band-pass filter may be used as the frequency analysis unit.

It should be noted that any window function, such as a Hamming window, a rectangular window, or a Blackman window, may be used as a window function of the frequency analysis unit.

It should be noted that different values may be used for the center frequency f of the frequency signal obtained by the frequency analysis unit and the analysis-target frequency f' used for calculating the phase distance. In this case, when the frequency signal at the frequency f' exists in the frequency signal at the center frequency f, this frequency signal is determined as the frequency signal of the to-be-extracted sound. Also, the detailed frequency of this frequency signal is f'.

In the first embodiment and the first modification, the to-be-extracted sound determination unit 101 (*j*) (j=1 to M) selects the frequency signals from the same time domain K (a duration of 96 ms) with respect to both the past times and the future times at the time intervals of 1/f (where f is the analysis-target frequency). However, the present invention is not limited to this. For example, the frequency signals may be selected from different time domains with respect to the past times and the future times respectively.

In the first embodiment and the first modification, the frequency signal at the analysis-target time is set when the phase distance is calculated, and whether or not the frequency signal is the frequency signal of the to-be-extracted sound is determined for each of the times. However, the present invention is not limited to this. For example, the phase distance of a plurality of frequency signals may be calculated at one time and compared to the second threshold, so that whether or not the plurality of the frequency signals as a whole is the frequency signal of the to-be-extracted sound can be determined at one time. In this case, an average time variation of the phase in the time domain is to be analyzed. For this reason, when it so happens that the phase of noise agrees with the phase of the to-be-extracted sound, the frequency signal of the to-be-extracted sound can be determined with stability.

Second Embodiment

Next, a noise elimination device according to the second embodiment is described. The noise elimination device of the second embodiment is different from the noise elimination device of the first embodiment. In the present embodiment, when the phase of a frequency signal of a mixed sound at a time t is $\psi(t)$ (radian), the phase is modified to $\psi'(t)=\text{mod } 2\pi(\psi(t)-2\pi ft)$ (where f is an analysis-target frequency) and the frequency signal of a to-be-extracted sound is determined using the modified phase $\psi'(t)$ of the frequency signal so that noise is eliminated.

Figure 26:
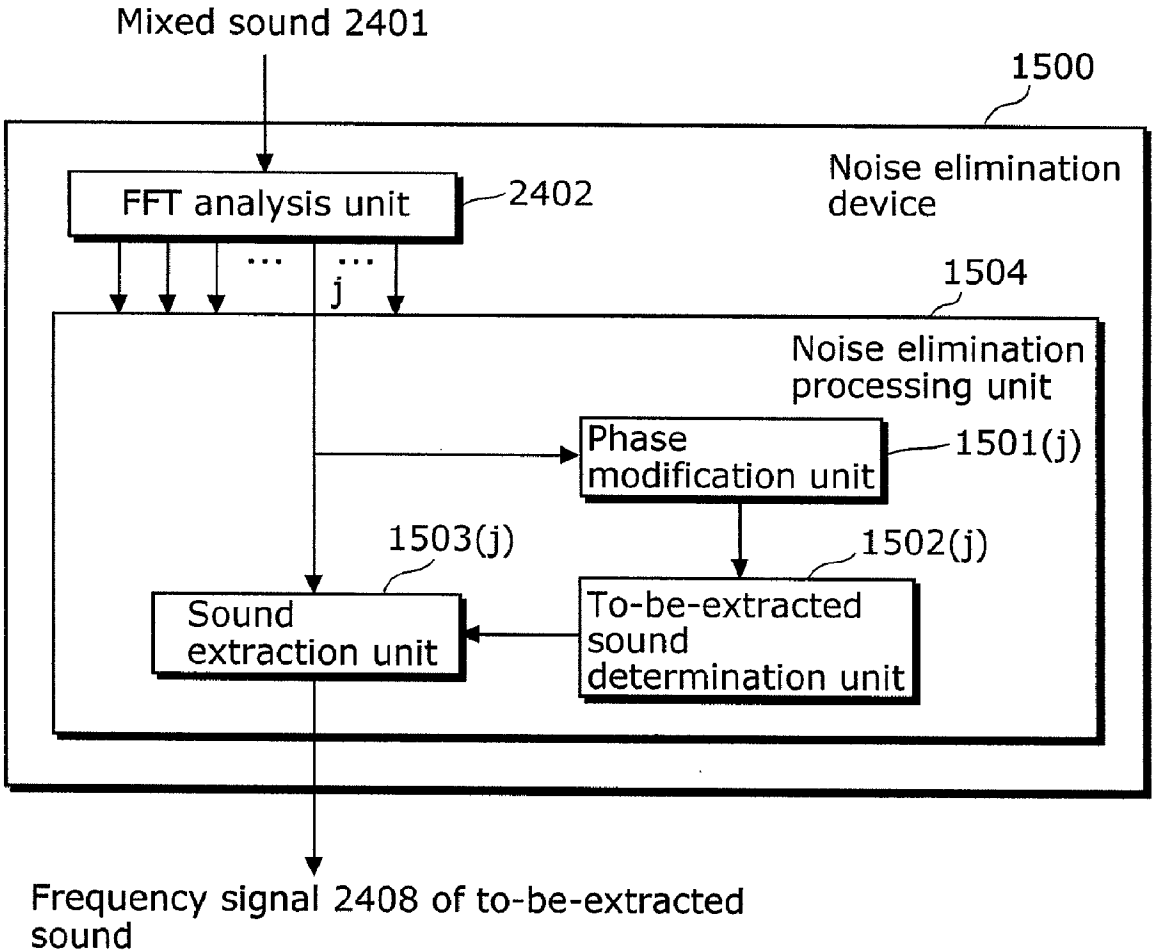
FIG. 26 is a block diagram showing an entire configuration of a noise elimination device according to a second embodiment of the present invention.
Figure 27:
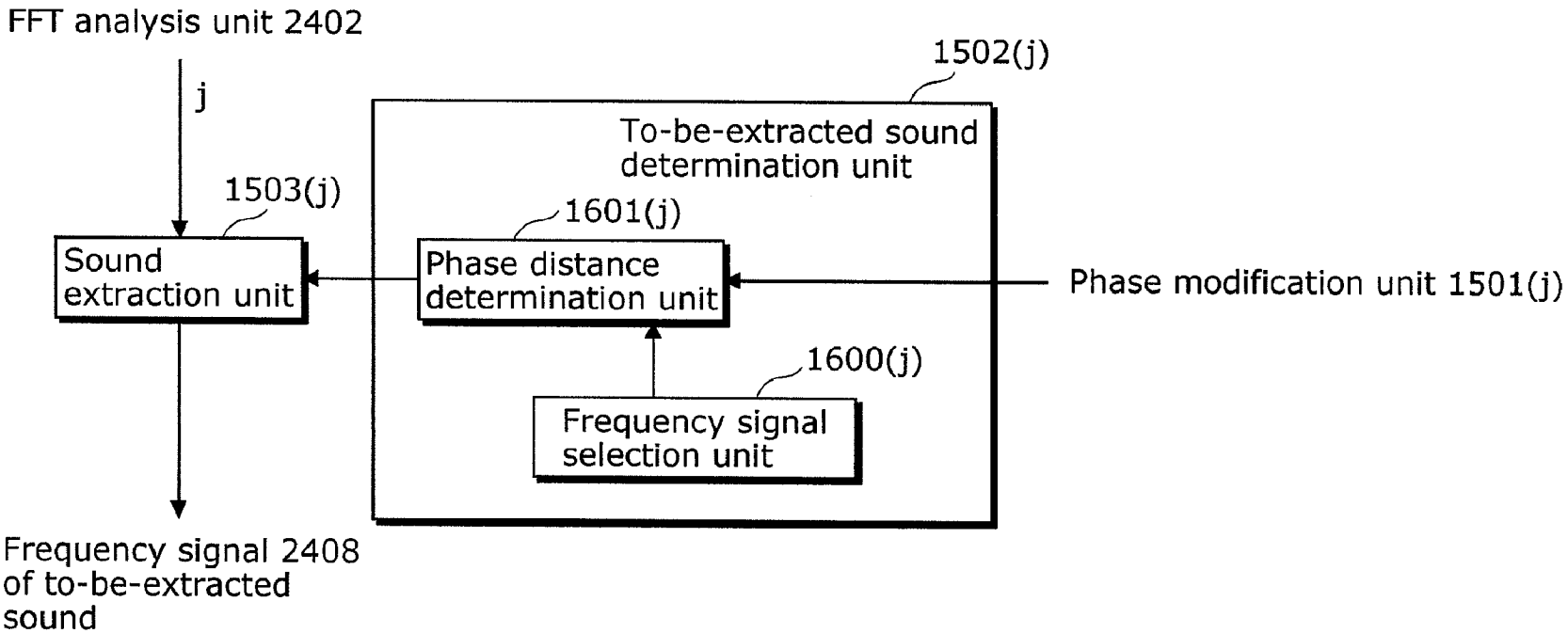
FIG. 27 is a block diagram showing a to-be-extracted sound determination unit 1502 (*j*) of the noise elimination device according to the second embodiment of the present invention.

FIGS. 26 and 27 are block diagrams showing a configuration of the noise elimination device according to the second embodiment.

In FIG. 26, a noise elimination device 1500 includes an FFT analysis unit 2402 (a frequency analysis unit) and a noise elimination processing unit 1504 which includes a phase modification unit 1501 (*j*) (j=1 to M), a to-be-extracted sound determination unit 1502 (*j*) (j=1 to M), and a sound extraction unit 1503 (*j*) (j=1 to M).

The FFT analysis unit 2402 is a processing unit which performs fast Fourier transform processing on a received mixed sound 2401 and obtains a frequency signal of the mixed sound 2401. Hereinafter, the number of frequency bands obtained by the FFT analysis unit 2402 is represented as M and a number specifying a frequency band is represented as a symbol j (j=1 to M).

The phase modification unit 1501 (*j*) (j=1 to M) is a processing unit which, when the phase of a frequency signal at a time t is $\psi(t)$ (radian), modifies the phase of the frequency signal of the frequency band j obtained by the FFT analysis unit 2402 to $\psi'(t)=\text{mod } 2\pi(\psi(t)-2\pi ft)$ (where f is the analysis-target frequency).

The to-be-extracted sound determination unit 1502 (*j*) (j=1 to M) calculates the phase distances between the phase-modified frequency signal at the analysis-target time and the respective phase-modified frequency signals at a plurality of times other than the analysis-target time in the predetermined duration. Here, note that the number of the frequency signals used in calculating the phase distances is equal to or larger than a first threshold value. Also note that the phase distances are calculated using $\psi'(t)$. Then, the frequency signal at the analysis-target time where the phase distance is equal to or smaller than a second threshold value is determined as the frequency signal 2408 of the to-be-extracted sound.

Lastly, the sound extraction unit 1503 (*j*) (j=1 to M) extracts the frequency signal 2408 of the to-be-extracted sound determined by the to-be-extracted sound determination unit 1502 (*j*) (j=1 to M) to eliminate noise from the mixed sound.

These processes are performed while the time of the predetermined duration is being shifted, so that the frequency signal 2408 of the to-be-extracted sound can be extracted for each time-frequency domain.

FIG. 27 is a block diagram showing a configuration of a to-be-extracted sound determination unit 1502 (*j*) (j=1 to M).

The to-be-extracted sound determination unit 1502 (*j*) (j=1 to M) includes a frequency signal selection unit 1600 (*j*) (j=1 to M) and a phase distance determination unit 1601 (*j*) (j=1 to M).

The frequency signal selection unit 1600 (*j*) (j=1 to M) is a processing unit which selects the frequency signals to be used by the phase distance determination unit 1601 (*j*) (j=1 to M) for calculating the phase distances, from among the frequency signals in the predetermined duration which are phase-modified by the phase modification unit 1501 (*j*) (j=1 to M). The phase distance determination unit 1601 (*j*) (j=1 to M) calculates the phase distances using the modified phases $\psi'(t)$ of the frequency signals selected by the frequency signal selection unit 1600 (*j*) (j=1 to M), and then determines the frequency signal whose phase distance is equal to or smaller than the second threshold value as the frequency signal 2408 of the to-be-extracted sound.

Next, an explanation is given as to an operation performed by the noise elimination device 1500 configured as described so far.

A $j^{th}$ frequency band is explained as follows. The same processing is performed for the other frequency bands. Here, the explanation is given, as an example, about the case where a center frequency and an analysis-target frequency (the frequency f as in $\psi'(t)=\text{mod } 2\pi(\psi(t)-2\pi ft)$ used in calculating the phase distances) agree with each other. In this case, whether or not the to-be-extracted sound exists in the frequency f can be determined. As another method, the to-be-extracted sound may be determined using a plurality of peripheral frequencies including the frequency band as the analysis frequencies. In this case, whether or not the to-be-extracted sound exists in the frequencies around the center frequency is determined. The processing performed here is the same processing as in the first embodiment.

Figure 28:
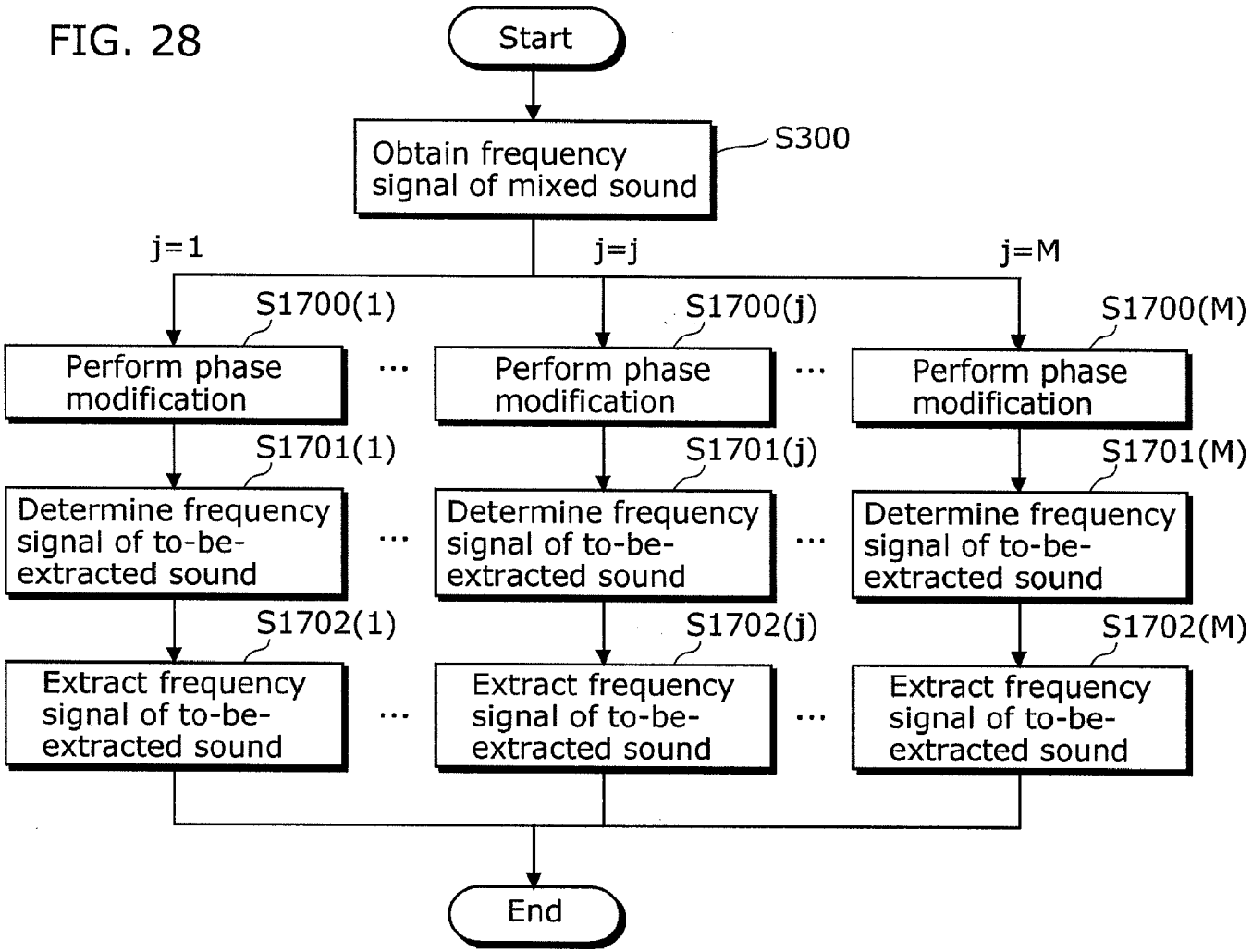
FIG. 28 is a flowchart showing an operation procedure performed by the noise elimination device according to the second embodiment of the present invention.
Figure 29:
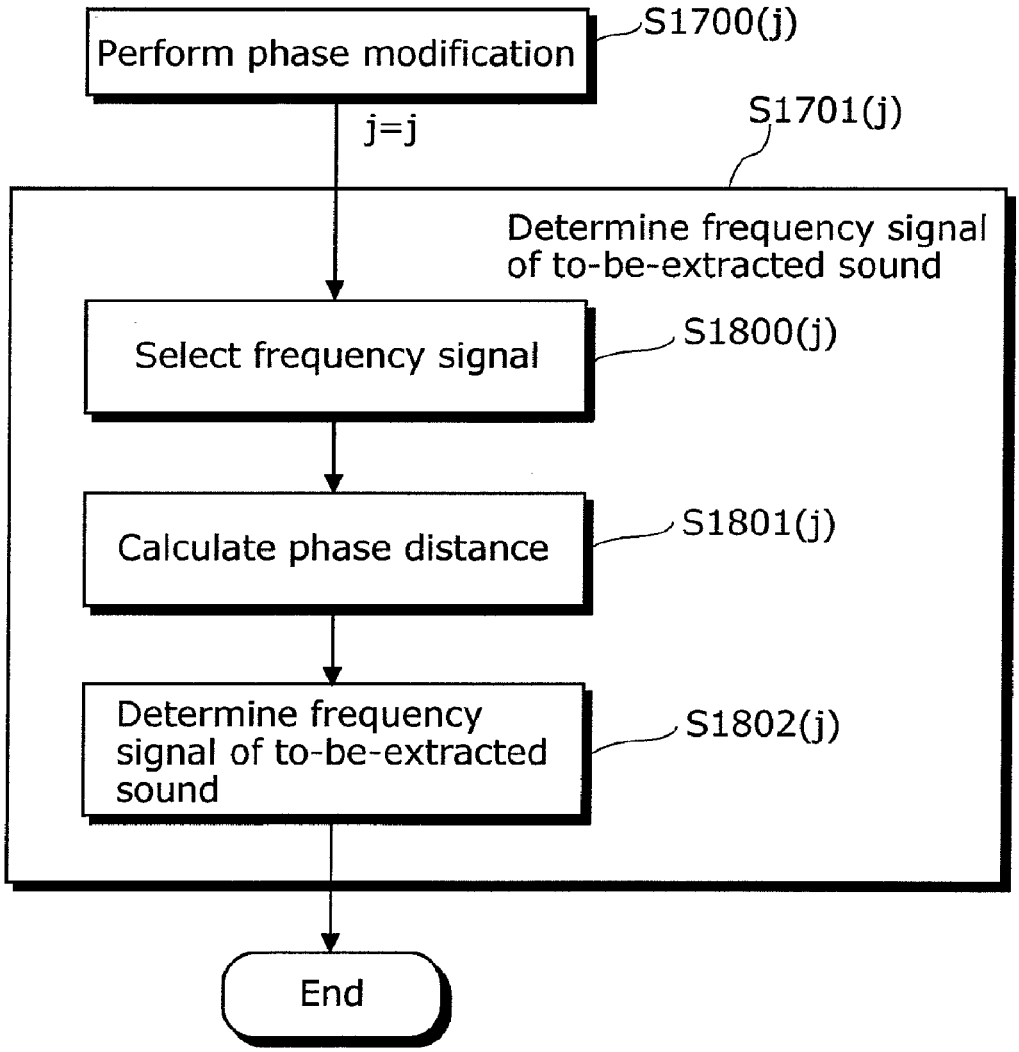
FIG. 29 is a flowchart showing an operation procedure performed in step S1701 (*j*) in which the noise elimination device determines a frequency signal of a to-be-extracted sound, according to the second embodiment of the present invention.

FIGS. 28 and 29 are flowcharts showing operation procedures of the noise elimination device 1500.

First, the FFT analysis unit 2402 receives the mixed sound 2401 and performs the fast Fourier transform processing on the mixed sound 2401 to obtain the frequency signal of the mixed sound 2401 (step S300). In the present embodiment, the frequency signal is obtained as is the case with the first embodiment.

Next, the phase modification unit 1501 (*j*) performs phase modification, supposing that the phase of the frequency signal at the time t is $\psi(t)$ (radian), on the frequency signal of the frequency band j obtained by the FFT analysis unit 2402 by converting the phase to $\psi'(t)=\text{mod } 2\pi(\psi(t)-2\pi ft)$ (where f is the analysis-target frequency) (step S1700 (*j*)).

Figure 30:
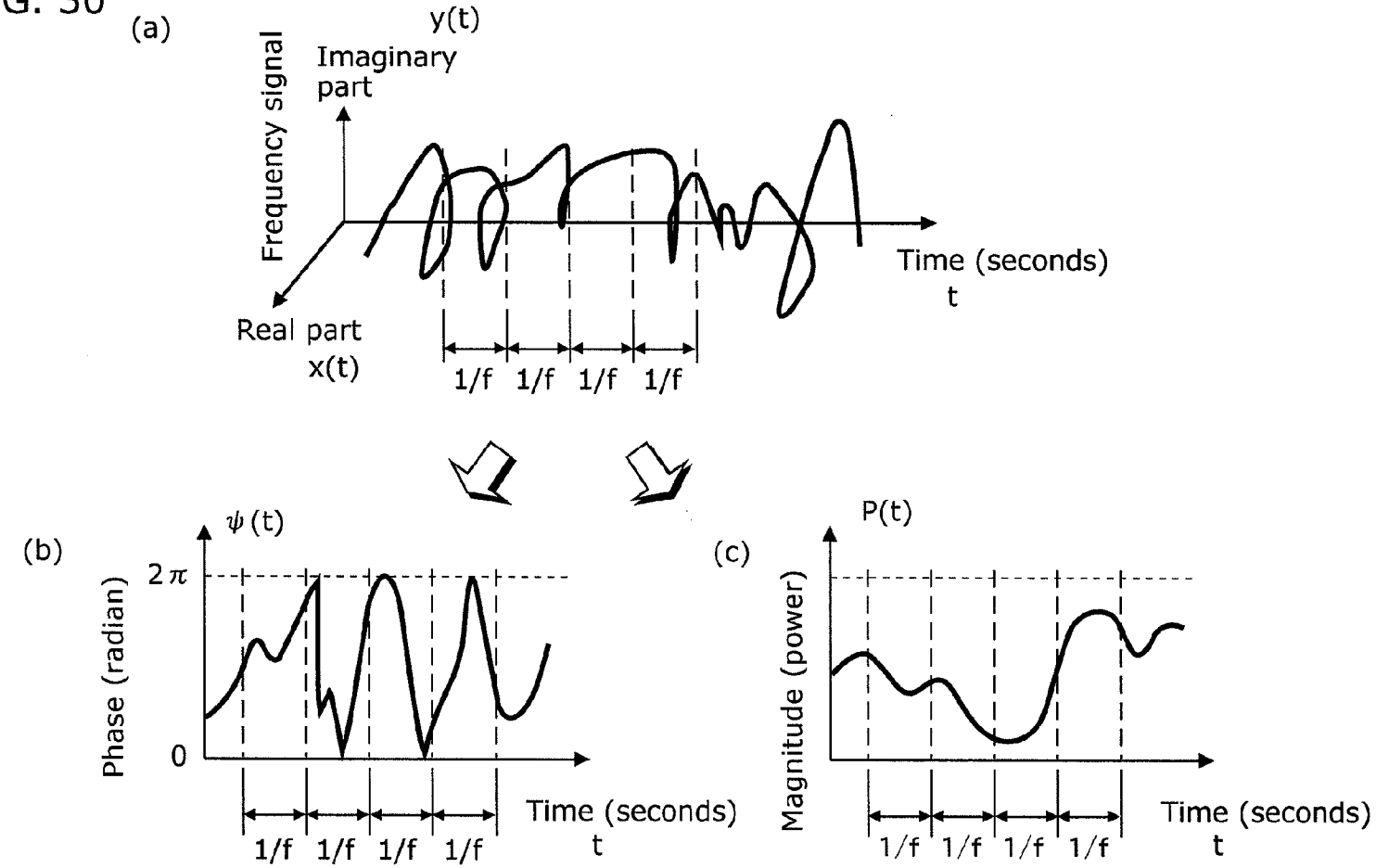
FIG. 30 is a diagram for explaining an example of a method for modifying a phase difference resulting from a time lag.
Figure 31:
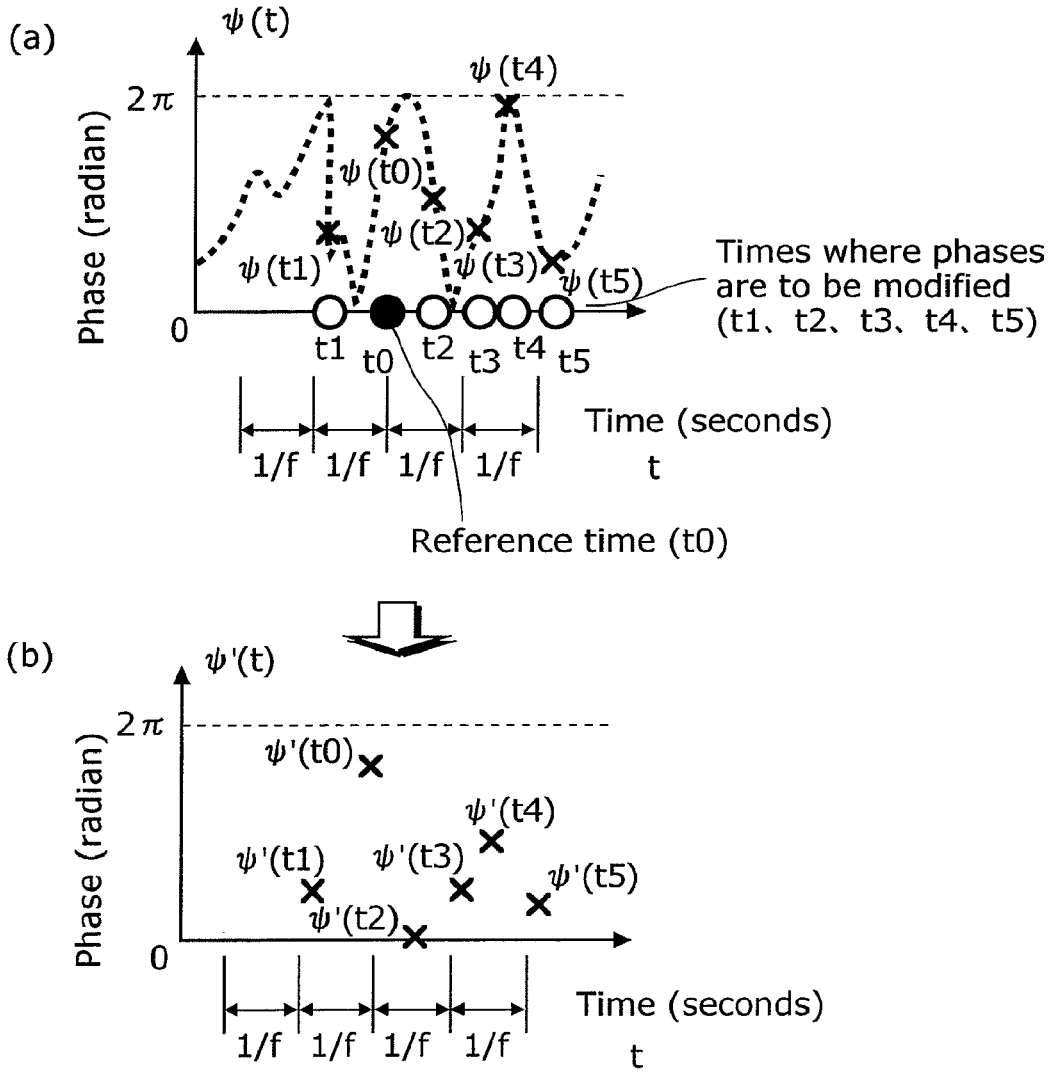
FIG. 31 is a diagram for explaining an example of a method for modifying a phase difference resulting from a time lag.
Figure 32:
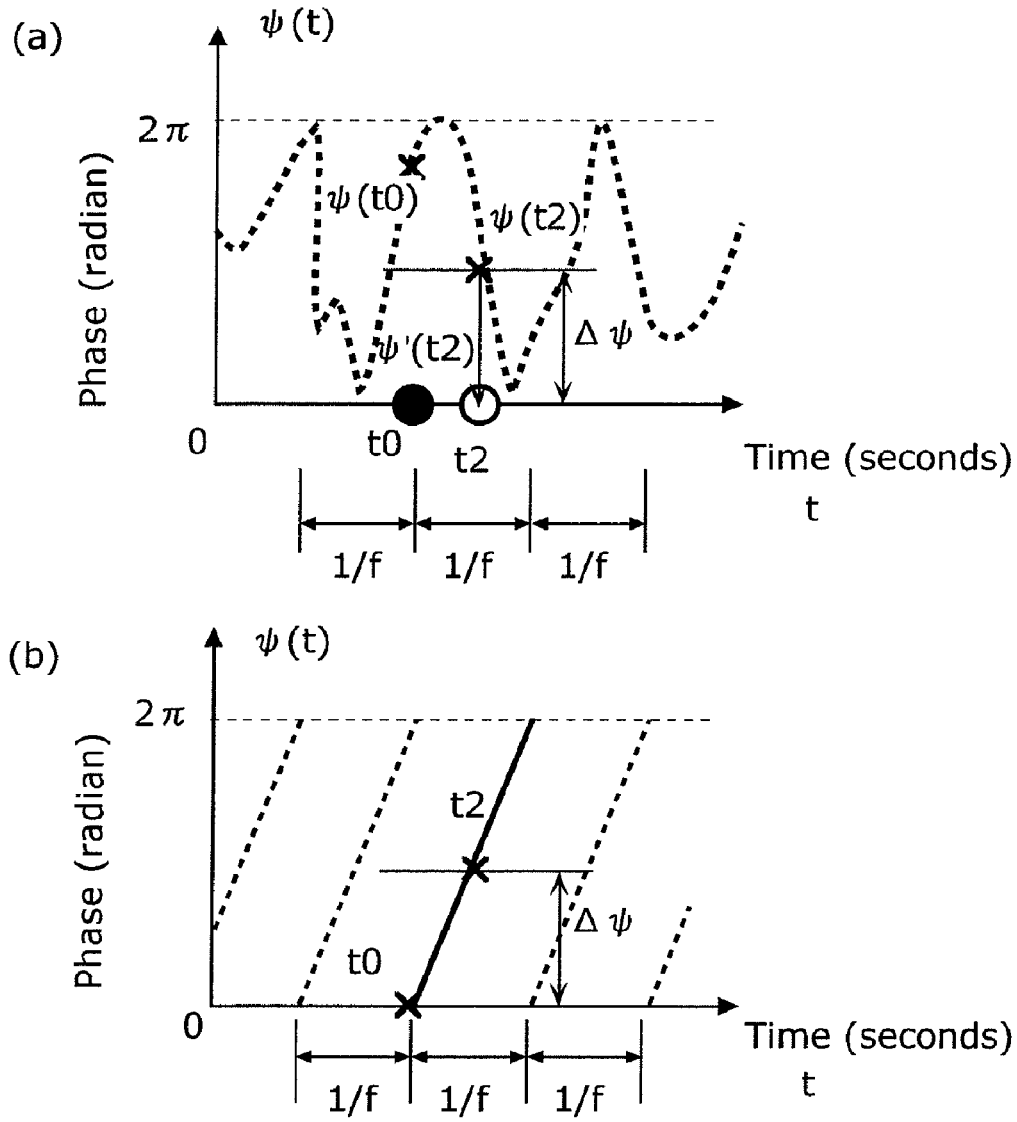
FIG. 32 is a diagram for explaining an example of a method for modifying a phase difference resulting from a time lag.

With reference to FIGS. 30 to 32, an example of a method for performing phase modification is explained. FIG. 30 (*a*) schematically shows the frequency signal obtained by the FFT analysis unit 2402. FIG. 30 (*b*) schematically shows the phase of the frequency signal obtained from FIG. 30 (*a*). FIG. 30 (*c*) schematically shows the magnitude (power) of the frequency signal obtained from FIG. 30 (*a*). In each of FIGS. 30 (*a*), (*b*), and (*c*), the horizontal axis is a time axis. The display manner in FIG. 30 (*a*) is the same as in FIG. 12 (*a*), and thus the detailed explanation is not repeated here. The vertical axis in FIG. 30 (*b*) represents the phase of the frequency, which is indicated by a value from 0 to $2\pi$ (radian). The vertical axis in FIG. 30 (*c*) represents the magnitude (power) of the frequency signal. When the real part of the frequency signal is expressed as:

$$x(t) \quad \text{[Formula 14]}$$

and the imaginary part of the frequency signal is expressed as:

$$y(t) \quad \text{[Formula 15]}$$

, the phase $\psi(t)$ and the magnitude (power) P(t) of the frequency signal are expressed as:

$$\phi(t)=\text{mod } 2\pi(\arctan(y(t)/x(t))) \quad \text{[Formula 16]}$$

and $$P(t)=\sqrt{x(t)^2+y(t)^2} \quad \text{[Formula 17]}$$

Here, a symbol t represents a time of the frequency signal.

Phase modification is performed by converting a value of the phase $\psi(t)$ of the frequency signal shown in FIG. 30 (*b*) to a value of the phase $\psi'(t)=\text{mod } 2\pi(\psi(t)-2\pi ft)$ (where f is the analysis-target frequency).

First, a reference time is determined. The details in FIG. 31 (*a*) are the same as those in FIG. 30 (*b*) and, in this example, a time t0 indicated by a filled circle in FIG. 31 (*a*) is determined as the reference time.

Next, a plurality of times of the frequency signals which are to be phase-modified are determined. In this example, five times (t1, t2, t3, t4, and t5) indicated by open circles in FIG. 31 (*a*) are determined as the times of the frequency signals which are to be phase-modified.

Here, note that the phase of the frequency signal at the reference time t0 is expressed as follows.

$$\phi(t_0)=\text{mod } 2\pi(\arctan(y(t_0)/x(t_0))) \quad \text{[Formula 18]}$$

Also note that the phases of the to-be-phase-modified frequency signals at the five times are expressed as follows.

$$\phi(t_i)=\text{mod } 2\pi(\arctan(y(t_0)/x(t_0)))(i=1,2,3,4,5) \quad \text{[Formula 19]}$$

The phases before modification are indicated by X in FIG. 31 (*a*). Also, the magnitudes of the frequency signals at the corresponding times can be expressed as follows.

$$P(t_i)=\sqrt{x(t_i)^2+y(t_i)^2}(i=1,2,3,4,5) \quad \text{[Formula 20]}$$

Next, a method for modifying the phase of the frequency at the time t2 is shown in FIG. 32. The details in FIG. 32 (*a*) are the same as those in FIG. 31 (*a*). FIG. 32 (*b*) shows that the phase cyclically varies from 0 up to 2π (radian) at an isometric speed at time intervals of 1/f (where f is the analysis-target frequency). Here, the modified phase is expressed as follows.

$$\phi(t_i)(i=0,1,2,3,4,5) \quad \text{[Formula 21]}$$

When the phases at the times t0 and t2 are compared in FIG. 32 (*b*), the phase at the time t2 is larger than the phase at the time to by Δψ as expressed below.

$$\Delta\phi=2\pi f(t_2-t_0) \quad \text{[Formula 22]}$$

With this being the situation, in order for the phase difference with the phase ψ(t) at the reference time t0 resulting from a time difference to be modified, ψ'(t2) is calculated by subtracting Δψ from the phase ψ (t2) at the time t2. This is the phase at the time t2 after the phase modification. Here, since the phase at the time t0 is the phase at the reference time, the value of the present phase is the same after the phase modification. To be more specific, the phase to be obtained after the phase modification is calculated by the following formulas:

$$\phi'(t_0)=\phi(t_0) \quad \text{[Formula 23]}$$

; and $$\phi'(t_i)=\text{mod } 2\pi(t_i)-2\pi f(t_i-t_0))(i=1,2,3,4,5) \quad \text{[Formula 24]}$$

The phases of the frequency signals obtained after the phase modification are indicated by X in FIG. 31 (*b*). The display manner in FIG. 31 (*b*) are the same as in FIG. 31 (*a*), and thus the detailed explanation is not repeated here.

Next, using the phase-modified frequency signals in the predetermined duration obtained by the phase modification unit 1501 (*j*), the to-be-extracted sound determination unit 1502 (*j*) calculates the phase distances between the frequency signal at the analysis-target time and the respective frequency signals at a plurality of times other than the analysis-target time. Here, the number of the frequency signals used for calculating the phase distances is equal to or larger than the first threshold value. Then, the frequency signal at the analysis-target time where the phase distance is equal to or smaller than the second threshold value is determined as the frequency signal 2408 of the to-be-extracted sound (step S1701 (*j*)).

First, the frequency signal selection unit 1600 (*j*) selects the frequency signals used by the phase distance determination unit 1601 (*j*) for calculating the phase distances, among from the phase-modified frequency signals in the predetermined duration obtained by the phase modification unit 1501 (*j*) (step S1800 (*j*)). In this example, the analysis-target time is t0, and the plurality of times of the frequency signals, where the phase distances with respect to the frequency signal at the time t0 are calculated, are t1, t2, t3, t4, and t5. Here, the number of the frequency signals (six in total, including t0 to t5) used in calculating the phase distances is equal to or larger than the first threshold value. This is because it would be difficult to determine the regularity of the time variation in the phase when the number of the frequency signals selected for the phase distance calculation is small. The time length of the predetermined duration is determined on the basis of the property of the time variation in the phase of the to-be-extracted sound.

Next, the phase distance determination unit 1601 (*j*) calculates the phase distances using the phase-modified frequency signals selected by the frequency signal selection unit 1600 (*j*) (step S1801 (*j*)). In this example, a phase distance S is a difference error of the phase and calculated as follows.

$$S=1/5\sum_{i=1}^{i=5}\sqrt{(\varphi'(t_0)-\varphi'(t_i))^2} \quad \text{[Formula 25]}$$

Also, in the case where the analysis-target time is t2 and the plurality of times at which the phase distances of frequency signals with respect to the frequency signal at the time t2 are calculated are t0, t1, t3, t4, and t5, the phase distance S is calculated as follows.

$$S=1/5\left(\sum_{i=0}^{i=1}\sqrt{(\varphi'(t_2)-\varphi'(t_i))^2}+\sum_{i=3}^{i=5}\sqrt{(\varphi'(t_2)-\varphi'(t_i))^2}\right) \quad \text{[Formula 26]}$$

It should be noted that the phase distance may be calculated, considering that the phase values are toroidally linked (0 (radian) and 2π (radian) are the same). For example, when the is phase distance is calculated using the difference error of the phases as represented by Formula 25, the phase distance may be calculated by representing the right-hand side as follows.

$$(\phi'(t_0)-\phi'(t_i))^2\equiv\min\{(\phi'(t_0)-\phi'(t_i))^2,(\phi'(t_0)-(\phi'(t_i)+2\pi))^2,(\phi'(t_0)-(\phi'(t_i)-2\pi))^2\} \quad \text{[Formula 27]}$$

In the present example, the frequency signal selection unit 1600 (*j*) selects the frequency signals used by the phase distance determination unit 1601 (*j*) for calculating the phase distances, among from the phase-modified frequency signals obtained by the phase modification unit 1501 (*j*). As another method, the frequency signal selection unit 1600 (*j*) may previously select the frequency signals to be phase-modified by the phase modification unit 1501 (*j*) and then the phase distance determination unit 1601 (*j*) may calculate the phase distances using these frequency signals whose phases have been modified by the phase modification unit 1501 (*j*). In this case, the phase modification is performed only on the frequency signals to be used for the phase distance calculation, thereby reducing the amount of throughput.

Next, the phase distance determination unit 1601 (*j*) determines each analysis-target frequency signal whose phase distances is equal to or smaller than the second threshold value as the frequency signal 2408 of the to-be-extracted sound (step S1802 (*j*)).

Lastly, the sound extraction unit 1503 (*j*) extracts the frequency signal determined as the frequency signal 2408 of the to-be-extracted sound by the to-be-extracted sound determination unit 1502 (*j*), so that the noise is eliminated.

Here, consideration is given to the phase of the frequency signals eliminated as noise. In this example, the phase distance refers to a difference error of the phase. Also, the second threshold value is set to π (radian), and the third threshold value is set to π (radian).

Figure 33:
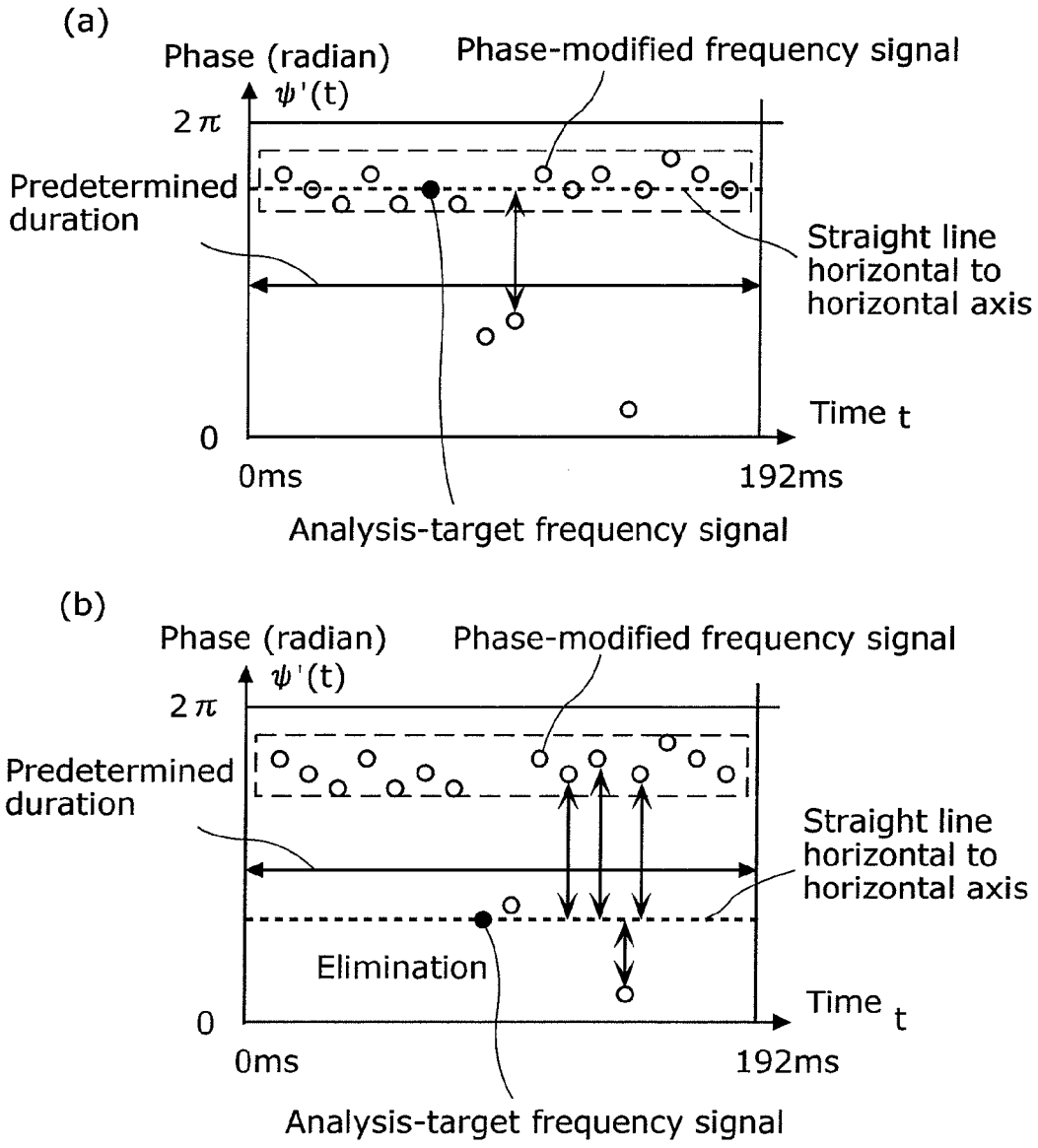
FIG. 33 is a schematic diagram showing phases of frequency signals of a mixed sound in a time range (a predetermined duration) where phase distances are to be calculated.

FIG. 33 is a schematic diagram showing the modified phase ψ'(t) of the frequency signal of the mixed sound in the predetermined duration (192 ms) where the phase distances are to be calculated. The horizontal axis represents the time t, and the vertical axis represents the modified phase ψ'(t). A filled circle indicates the phase of the analysis-target frequency signal, and open circles indicate the phases of the frequency signals whose phase distances with respect to the phase of the analysis-target frequency signal are to be calculated. As shown in FIG. 33 (*a*), obtaining the phase distance is the same as to obtaining a phase distance with respect to a straight line which passes through the modified phase of the analysis-target frequency signal and which has a slope parallel to the time axis. In FIG. 33 (*a*), the modified phases of the frequency signals whose phase distances are to be calculated are concentrated around this straight line. On account of this, the phase distance with respect to the respective frequency signals, the number of which is equal to or larger than the first threshold, is equal to or smaller than the second threshold value (π (radian)). Thus, the analysis-target frequency signal is determined as the frequency signal of the to-be-extracted sound. Moreover, as shown in FIG. 33 (*b*), when the frequency signals, whose phase distances are to be calculated, are hardly present around a straight line which passes through the modified phase of the analysis-target frequency signal and which has a slope parallel to the time axis, this means that the phase distance with respect to the respective frequency signals, the number of which is equal to or larger than the first threshold value, is larger than the second threshold value. Thus, the frequency signal is not determined as the frequency signal of the to-be-extracted sound and, therefore, is eliminated as noise.

Figure 34:
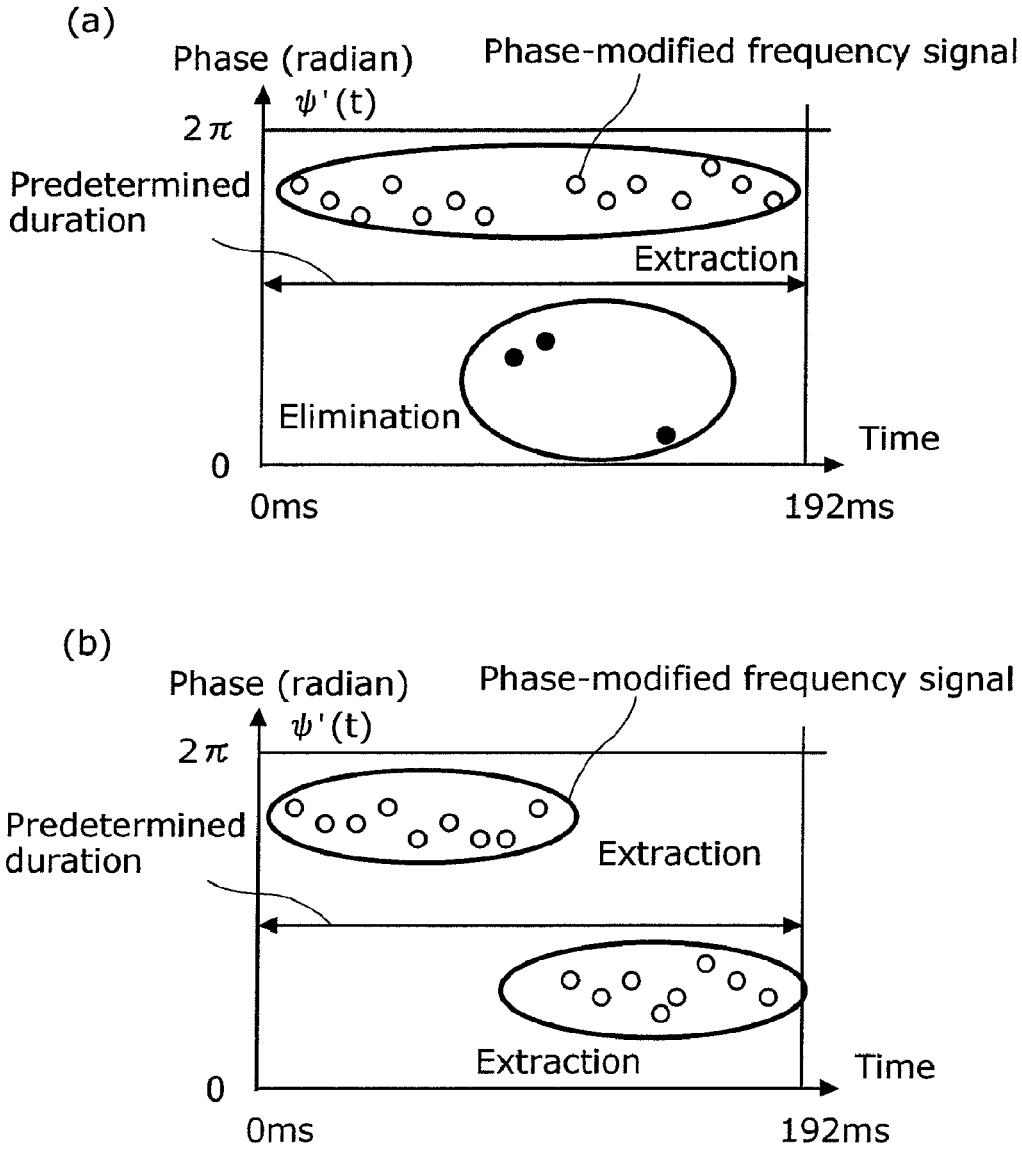
FIG. 34 is a schematic diagram showing the phases of the mixed sound in the predetermined duration.

FIG. 34 is another example schematically showing the phase of the mixed sound. The horizontal axis is a time axis, and the vertical axis is a phase axis. The modified phases of the frequency signals of the mixed sound are indicated by circles. The frequency signals enclosed by a solid line belong to the same cluster, which is a group the frequency signals whose phase distances each are equal to or smaller than the second threshold value (π (radian)). These clusters can be obtained using multivariate analysis. When the number of the frequency signals existing in a cluster is equal to or larger than the first threshold value, the frequency signals in this cluster are extracted, not eliminated. Meanwhile, when the number of the frequency signals existing in a cluster is less than the first threshold value, the frequency signal in this cluster are eliminated as noise. As shown in FIG. 34 (*a*), when a noise part is included only partially in the predetermined duration, the noise of this specific part can be eliminated. Also, as shown in FIG. 34 (*b*), when two kinds of to-be-extracted sounds exist, these two to-be-extracted sounds can be extracted as follows. When the phase distance is equal to or smaller than the second threshold value (π (radian)) among the frequency signals, the number of which is 40% of the signals existing in the predetermined duration (seven or more signals in this example), then these signals are extracted as the to-be-extracted sound. In this case, the phase distance between these clusters is equal to or larger than the third threshold value (π (radian)), the frequency signals are extracted as the to-be-extracted sounds of different kinds.

According to the configuration as described above, the modification based on $\psi'(t)=\mathrm{mod}\ 2\pi(\psi(t)-2\pi ft)$ is performed on the frequency signals at the time intervals shorter than the time intervals of 1/f (where f is the analysis-target frequency). Thus, the phase distances of the frequency signals at the time intervals shorter than the time intervals of 1/f (where f is the analysis-target frequency) can be easily calculated using ψ'(t). On account of this, as to the to-be-extracted sound in a low frequency band where the time interval of 1/f is longer, the frequency signal can be determined through easy calculation using ψ'(t) for each short time domain.

When the noise elimination device of the present invention is built in an audio output device, for example, clear audio can be reproduced after inverse frequency transform is performed following the determination of the audio frequency signal from a mixed sound for each time-frequency domain. Also, when the noise elimination device of the present invention is built in a sound source direction detection device, for example, a precise direction of a sound source can be obtained by extracting the frequency signal of the to-be-extracted sound after the noise elimination. Moreover, when the noise elimination device of the present invention is built in a sound recognition device, for example, a precise sound recognition can be performed even when noise is present in the surroundings, by extracting an audio frequency signal from a mixed sound for each time-frequency domain. Furthermore, when the noise elimination device of the present invention is built in a sound identification device, for example, a precise sound identification can be performed even when noise is present in the surroundings, by extracting an audio frequency signal from a mixed sound for each time-frequency domain. Also, when the noise elimination device of the present invention is built into a different vehicle detection device, for example, the driver can be notified of the approach of a vehicle when a frequency signal of an engine sound is extracted from a mixed sound for each time-frequency domain. Moreover, when noise elimination device of the present invention is applied to an emergency vehicle detection device, for example, the driver can be notified of the approach of an emergency vehicle when a frequency signal of a siren sound is detected from a mixed sound for each time-frequency domain.

Also, considering that a frequency signal of noise (a toneless sound) which is not determined as the to-be-extracted sound (a toned sound) is extracted according to the present invention, when the noise elimination device of the present invention is built in a wind sound level determination device, for example, a frequency signal of wind noise can be extracted from a mixed sound for each time-frequency domain and an output of the calculated magnitude of power can be provided. Moreover, when the noise elimination device of the present invention is built in a vehicle detection device, for example, a frequency signal of a traveling sound caused by tire friction can be extracted from a mixed sound for each time-frequency domain and the approach of a vehicle can be thus detected on the basis of the magnitude of power.

It should be noted that discrete Fourier transform, cosine transform, wavelet transform, or a band-pass filter may be used as the frequency analysis unit.

It should be noted that any window function, such as a Hamming window, a rectangular window, or a Blackman window, may be used as a window function of the frequency analysis unit.

The noise elimination device 1500 eliminates noises for all the (M number of) frequency bands obtained by the FFT analysis unit 2402. It should be noted, however, that some of the frequency bands where the noise elimination is desired are first selected and then the noise elimination may be performed on the selected frequency bands.

It should be noted that, without specifying the frequency signal which is to be analyzed, the phase distance of a plurality of frequency signals may be calculated at one time and compared to the second threshold, so that whether or not the plurality of the frequency signals as a whole is the frequency signal of the to-be-extracted sound can be determined at one time. In this case, an average time variation of the phase in the time domain is to be analyzed. For this reason, when it so happens that the phase of noise agrees with the phase of the to-be-extracted sound, the frequency signal of the to-be-extracted sound can be determined with stability.

Figure 35:
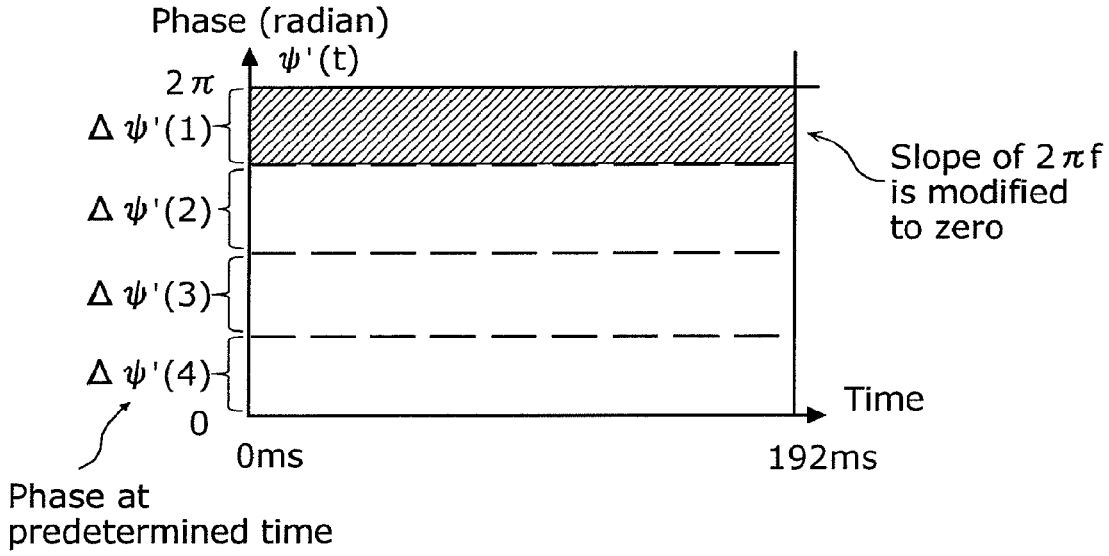
FIG. 35 is a diagram for explaining an example of a method for creating a histogram of a phase of a frequency signal.

It should be noted that the frequency signal of the to-be-extracted sound may be determined using a phase histogram of the frequency signal, as in the case of the second modification of the first embodiment. In this case, the histogram would be the one as shown in FIG. 35. The display manner is the same as in FIG. 24, and thus the detailed explanation is not repeated here. The area of $\Delta\psi'$ in the histogram is parallel to the time axis because of the phase modification, it becomes easier to calculate the occurrence frequency.

Using the modified phase $\psi'(t)$, $$x_t'=\cos(\phi'(t)) \quad \text{[Formula 28]}$$

and, $$y_t'=\sin(\phi'(t)) \quad \text{[Formula 29]}$$

may be calculated to obtain the real and the imaginary parts of the frequency signal normalized by the power, so that the frequency signal of the to-be-extracted sound may be determined using the phase distance (Formula 6, Formula 7, Formula 8, and Formula 9) as in the first embodiment.

Third Embodiment

Next, a vehicle detection device according to the third embodiment is explained. When it is determined that a frequency signal of an engine sound (a toned sound) is present in at least one of mixed sounds respectively received from a plurality of microphones, the vehicle detection device of the third embodiment provides an output of a to-be-extracted sound detection flag in order to notify a driver of the approach of a vehicle. Here, an analysis-target frequency appropriate to the mixed sound is obtained for each time-frequency domain in advance from an approximate straight line in a space represented by times and phases. Then, the phase distance of the obtained analysis-target frequency is calculated from a distance between the obtained straight line and the phase, and the frequency signal of the engine sound is determined.

Figure 36:
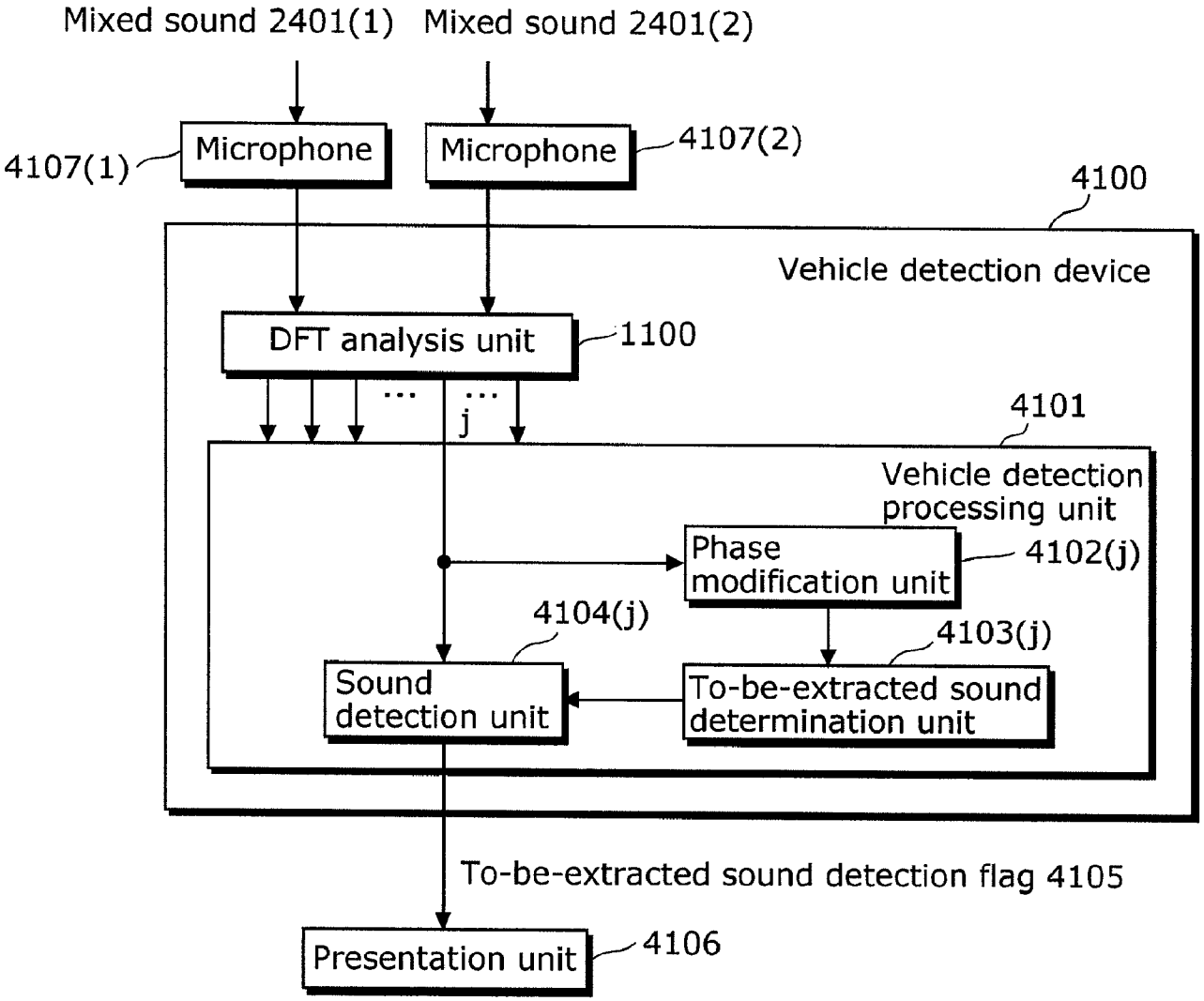
FIG. 36 is a block diagram showing an entire configuration of a vehicle detection device according to a third embodiment of the present invention.
Figure 37:
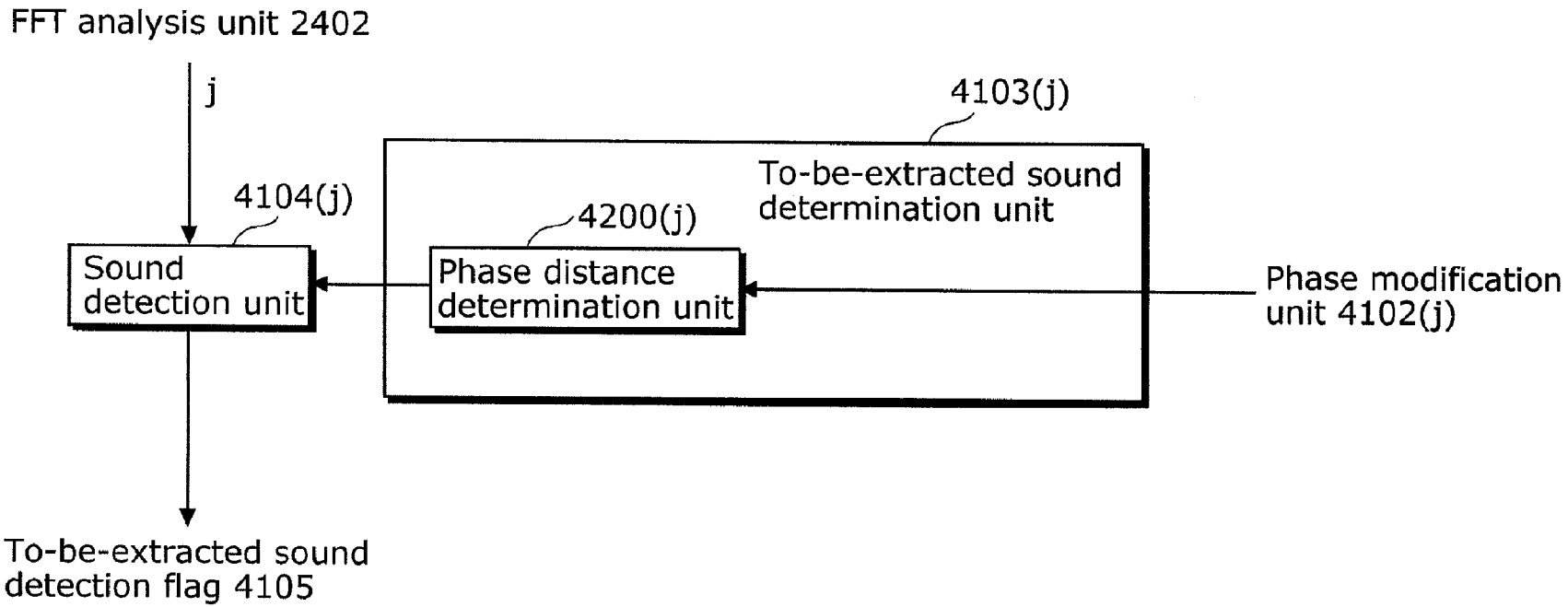
FIG. 37 is a block diagram showing a to-be-extracted sound determination unit 4103 (*j*) of the vehicle detection device according to the third embodiment of the present invention.

FIGS. 36 and 37 are block diagrams showing a configuration of the vehicle detection device according to the third embodiment of the present invention.

In FIG. 36, a vehicle detection device 4100 includes a microphone 4107 (1), a microphone 4107 (2), a DFT analysis unit 1100 (a frequency analysis unit), and a vehicle detection processing unit 4101, which includes a phase modification unit 4102 (*j*) (j=1 to M), a to-be-extracted sound determination unit 4103 (*j*) (j=1 to M), a sound detection unit 4104 (*j*) (j=1 to M), and a presentation unit 4106.

In FIG. 37, the to-be-extracted sound determination unit 4103 (*j*) (j=1 to M) includes a phase distance determination unit 4200 (*j*) (j=1 to M).

The microphone 4107 (1) receives a mixed sound 2401 (1) and the microphone 4107 (2) receives a mixed sound 2401 (2). In the present example, the microphone 4107 (1) and the microphone 4107 (2) are respectively set on left and right front bumpers. Each of the mixed sounds includes an engine sound and wind noise.

The DFT analysis unit 1100 performs the discrete Fourier transform processing on each of the mixed sound 2401 (1) and the mixed sound 2401 (2) to obtain the respective frequency signals of the mixed sound 2401 (1) and the mixed sound 2401 (2). In this example, the time window width is 38 ms. Moreover, the frequency signal is obtained per 0.1 ms. Hereinafter, the number of frequency bands obtained by the DFT analysis unit 1100 is represented as M and a number specifying a frequency band is represented as a symbol j (j=1 to M). In this example, a frequency band from 10 Hz to 300 Hz where an engine sound of a motorcycle exists is divided into 10-Hz intervals (M=30) to obtain the frequency signal.

The phase modification unit 4102 (*j*) (j=1 to M) is a processing unit which, when the phase of a frequency signal at a time t is $\psi(t)$ (radian), modifies the phase of the frequency signal of the frequency band j (j=1 to M) obtained by the DFT analysis unit 1100 to $\psi''(t)=\text{mod } 2\pi(\psi(t)-2\pi ft)$ (where f' is a frequency of the frequency band). The present example is different from the second embodiment in that $\psi(t)$ is modified not using the analysis-target frequency but using the frequency f' of the frequency band where the frequency signal is obtained.

The to-be-extracted sound determination unit 4103 (*j*) (j=1 to M) (the phase distance determination unit 4200 (*j*) (j=1 to M)) first obtains an analysis-target frequency appropriate to the frequency signal from the approximate straight line in the space represented by the times and the phases using the frequency signals at times in a time duration of 113 ms (a predetermined duration) for each of the mixed sounds (the mixed sound 2401 (1) and the mixed sound 2401 (2)) and then calculates the phase distances using the phases $\psi''(t)$ of the frequency signals modified by the phase modification unit 4102 (*j*) (j=1 to M). Moreover, the to-be-extracted sound determination unit 4103 (*j*) (j=1 to M) (the phase distance determination unit 4200 (*j*) (j=1 to M)) calculates the phase distance from the distance between the obtained approximate straight line and the phase, and then determines the frequency signal in the predetermined duration whose phase distance is equal to or smaller than the second threshold value as the frequency signal of the engine sound.

When the to-be-extracted sound determination unit 4103 (*j*) (j=1 to M) determines that the frequency signal of the engine sound (the to-be-extracted sound) exists in at least one of the mixed sound 2401 (1) and the mixed sound 2401 (2) at the same time, the sound detection unit 4104 (*j*) (j=1 to M) creates a to-be-extracted sound detection flag 4105 and provides an output of this flag.

When receiving the to-be-extracted sound detection flag 4105 from the sound detection unit 4104 (*j*) (j=1 to M), the presentation unit 4106 notifies the driver of the approach of the vehicle.

These processing units perform these processes while shifting the time of the predetermined duration.

Next, an explanation is given about an operation of the vehicle detection device 4100 configured as described so far.

A $j^{th}$ frequency band (the frequency of the frequency band is f') is explained as follows. The same processing is performed for the other frequency bands.

Figure 38:
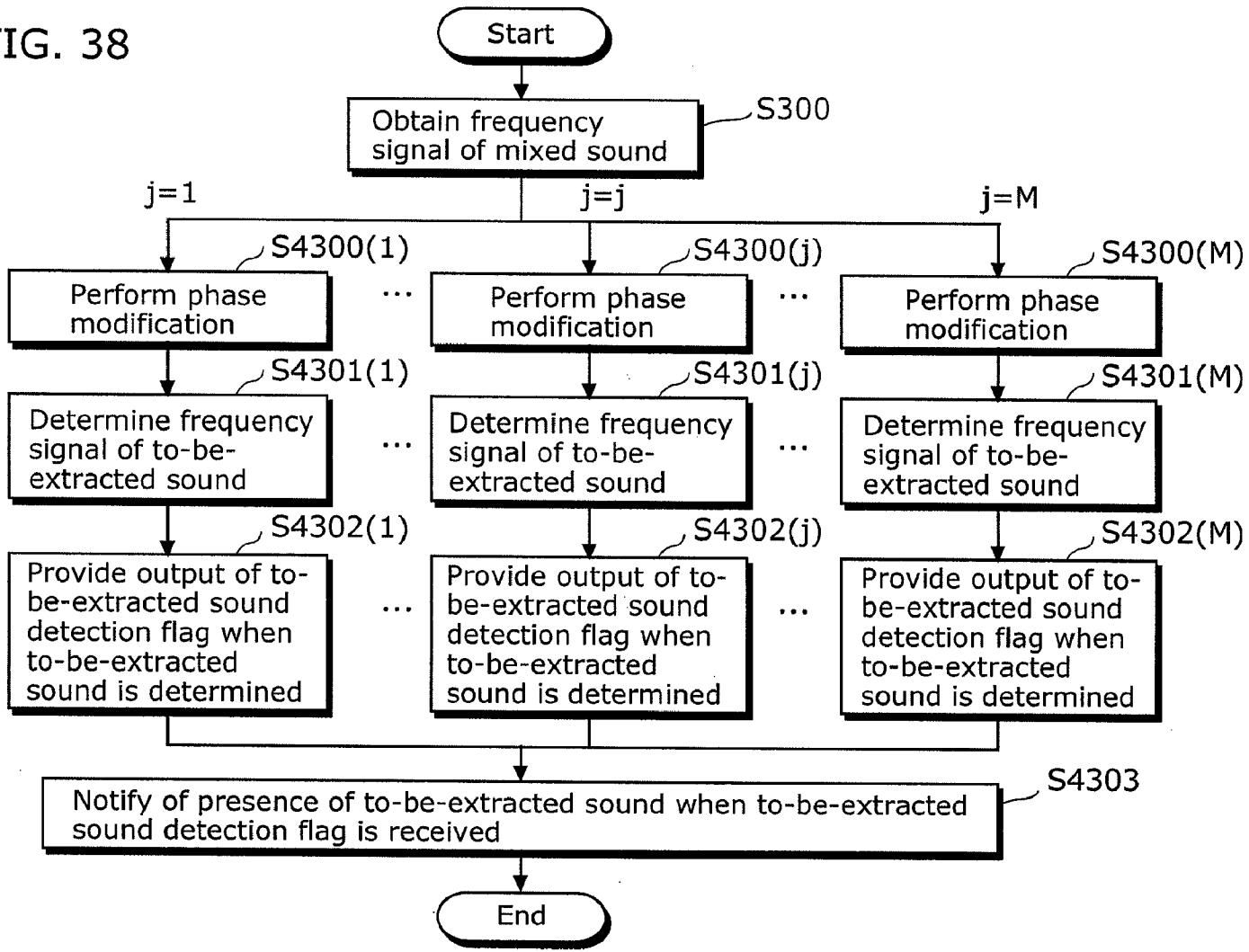
FIG. 38 is a flowchart showing an operation procedure performed by the vehicle detection device according to the third embodiment of the present invention.

FIG. 38 is a flowchart showing an operation procedure performed by the vehicle detection device 4100.

First, the DFT analysis unit 1100 receives the mixed sound 2401 (1) and the mixed sound 2401 (2) and performs the discrete Fourier transform processing on the mixed sound 2401 (1) and the mixed sound 2401 (2) to obtain the respective frequency signals of the mixed sound 2401 (1) and the mixed sound 2401 (2) (step S300).

Figure 39:
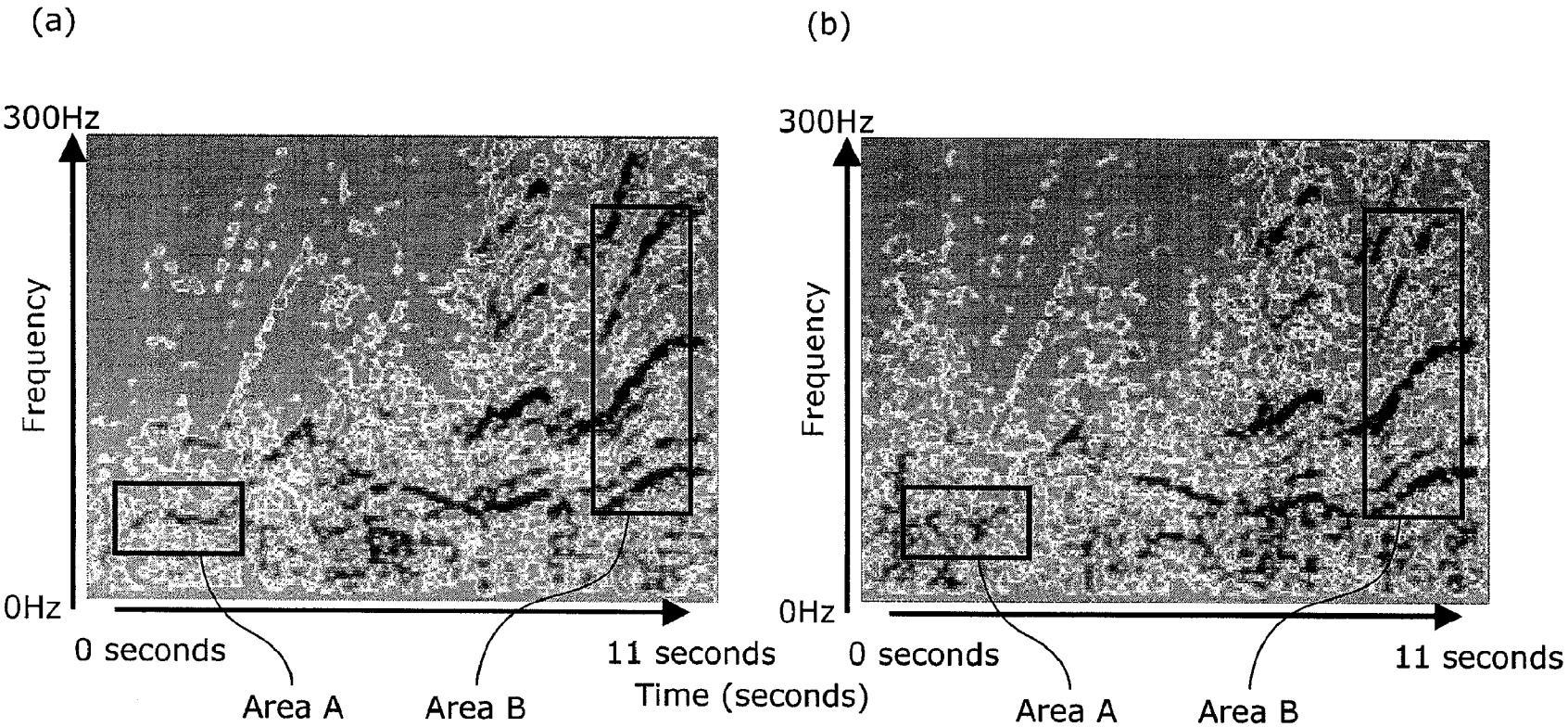
FIG. 39 is a diagram showing examples of spectrograms of a mixed sound 2401 (1) and a mixed sound 2401 (2).

FIG. 39 shows examples of spectrograms of the mixed sound 2401 (1) and the mixed sound 2401 (2). The display manner is the same as in FIG. 10, and thus the detailed explanation is not repeated here. FIGS. 39 (*a*) and 39 (*b*) are spectrograms of the mixed sound 2401 (1) and the mixed sound 2401 (2) respectively, and each includes an engine sound and wind noise. It can be seen from each area B of FIGS. 39 (*a*) and 39 (*b*) that a frequency signal of the engine sound appears in each mixed sound. Meanwhile, from each area A of FIGS. 39 (*a*) and 39 (*b*), it can be seen that although the engine sound appears in the mixed sound 2401 (1), the engine sound is buried due to the influence of the wind noise in the mixed sound 2401 (2). The states of the mixed sounds are different between the microphones in this way because wind noise varies depending on the positions of the microphones.

Next, the phase modification unit 4102 (*j*) performs phase modification, supposing that the phase of the frequency signal at the time t is ψ(t) (radian), on the frequency signal of the frequency band j (the frequency f') obtained by the DFT analysis unit 1100 by converting the phase to ψ" (t)=mod 2π(ψ(t)−2πf't) (where f' is the frequency of the frequency band) (step S4300 (*j*)). The present example is different from the second embodiment in that ψ(t) is modified not using the analysis-target frequency f but using the frequency f' of the frequency band where the frequency signal is obtained. The other conditions are the same as in the case of the second embodiment, and thus the detailed explanation is not repeated here.

Next, the to-be-extracted sound determination unit 4103 (*j*) (the phase distance determination unit 4200 (*j*)) sets the analysis-target frequency f using the phases ψ"(t) of the phase-modified frequency signals (the number of which is equal to or larger than the first threshold value that corresponds to 80% of the frequency signals in the predetermined duration) at all the times in the predetermined duration, for each of the mixed sounds (the mixed sound 2401 (1) and the mixed sound 2401 (2)). Using the set analysis-target frequency, the to-be-extracted sound determination unit 4103 (*j*) (the phase distance determination unit 4200 (*j*)) calculates the phase distances. Then, the to-be-extracted sound determination unit 4103 (*j*) (the phase distance determination unit 4200 (*j*)) determines the frequency signal in the predetermined duration whose phase distance is equal to or smaller than the second threshold value as the frequency signals of the engine sound (step S4301 (*j*)).

Figure 40:
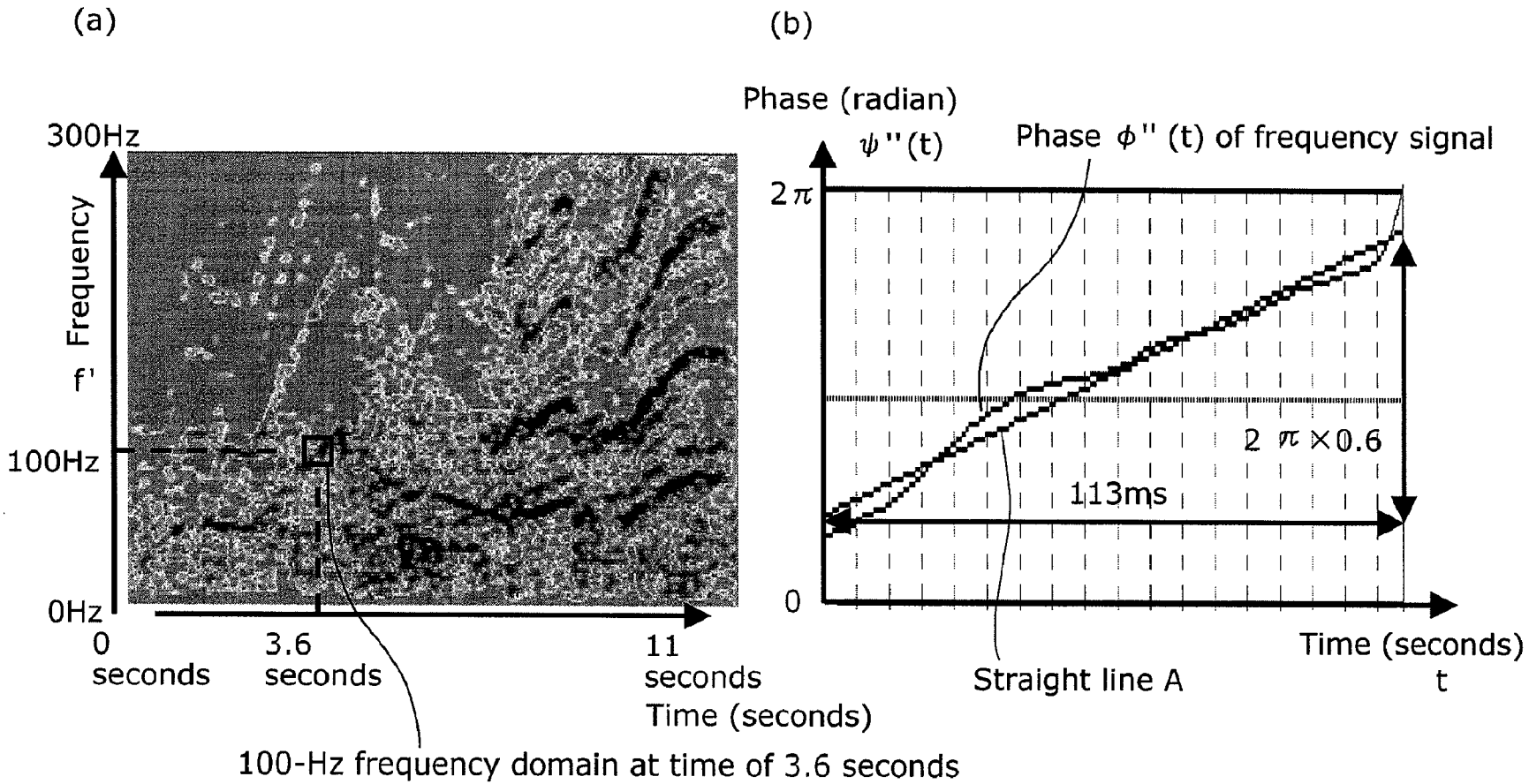
FIG. 40 is a diagram for explaining a method for setting an appropriate analysis-target frequency f.

FIG. 40 (*a*) shows a histogram of the mixed sound 2401 (1). The display manner is the same as in FIG. 39 (*a*), and thus the detailed explanation is not repeated here. In this example, an explanation is given as to a method for setting the appropriate analysis-target frequency f for a time-frequency domain of a 100-Hz frequency band at a 3.6-second time in the predetermined duration (113 ms) in FIG. 40 (*a*).

FIG. 40 (*b*) shows the phase ψ"(t) modified using the frequency f' of the frequency band in the time-frequency domain of the 100-Hz frequency band at the 3.6-second time in the predetermined duration (113 ms) as shown in FIG. 40 (*a*). The horizontal axis represents time, and the vertical axis represents the phase ψ"(t). In this example, the phase is modified to ψ"(t)=mod 2π(ψ(t)−2π*100*t) using the frequency (f'=100 Hz) of the frequency band. Moreover, FIG. 40 (*b*) shows a straight line (a straight line A) where the distances (corresponding to the phase distances) between these modified phases ψ" (t) and the straight line defined in a space represented by the times and the phases ψ" (t) are at a minimum.

This straight line can be obtained through a linear regression analysis. To be more specific, a time t (i) (i(i=1 to N) is an index when t is discretized) is an explanatory variable, and the modified phase ψ"(t(i)) is an objective variable. Then, when the modified phases ψ"(t(i)) (i=1 to N) at all the times in the time-frequency domain of the 100-Hz frequency band at the 3.6-second time in the predetermined duration (113 ms) are used as N pieces of data, the straight line A is calculated as follows.

$$\varphi''(t) = S_{t\varphi''} / S_{tt}(t - \bar{t}) + \bar{\varphi}'' \quad \text{[Formula 30]}$$

Here, $$\bar{t} = 1/N \sum_{i=1}^{i=N} t(i) \quad \text{[Formula 31]}$$

represents an average time.

$$\bar{\varphi}'' = 1/N \sum_{i=1}^{i=N} \varphi''(t(i)) \quad \text{[Formula 32]}$$

represents an average modified phase.

$$S_{tt} = 1/N \sum_{i=1}^{i=N} t(i)^2 - \bar{t}^2 \quad \text{[Formula 33]}$$

represents a variance of time.

$$S_{t\varphi''} = 1/N \sum_{i=1}^{i=N} t(i)\varphi''(t(i)) - \bar{t}\bar{\varphi}'' \quad \text{[Formula 34]}$$

represents a covariance of the time and the modified phase.

Figure 41:
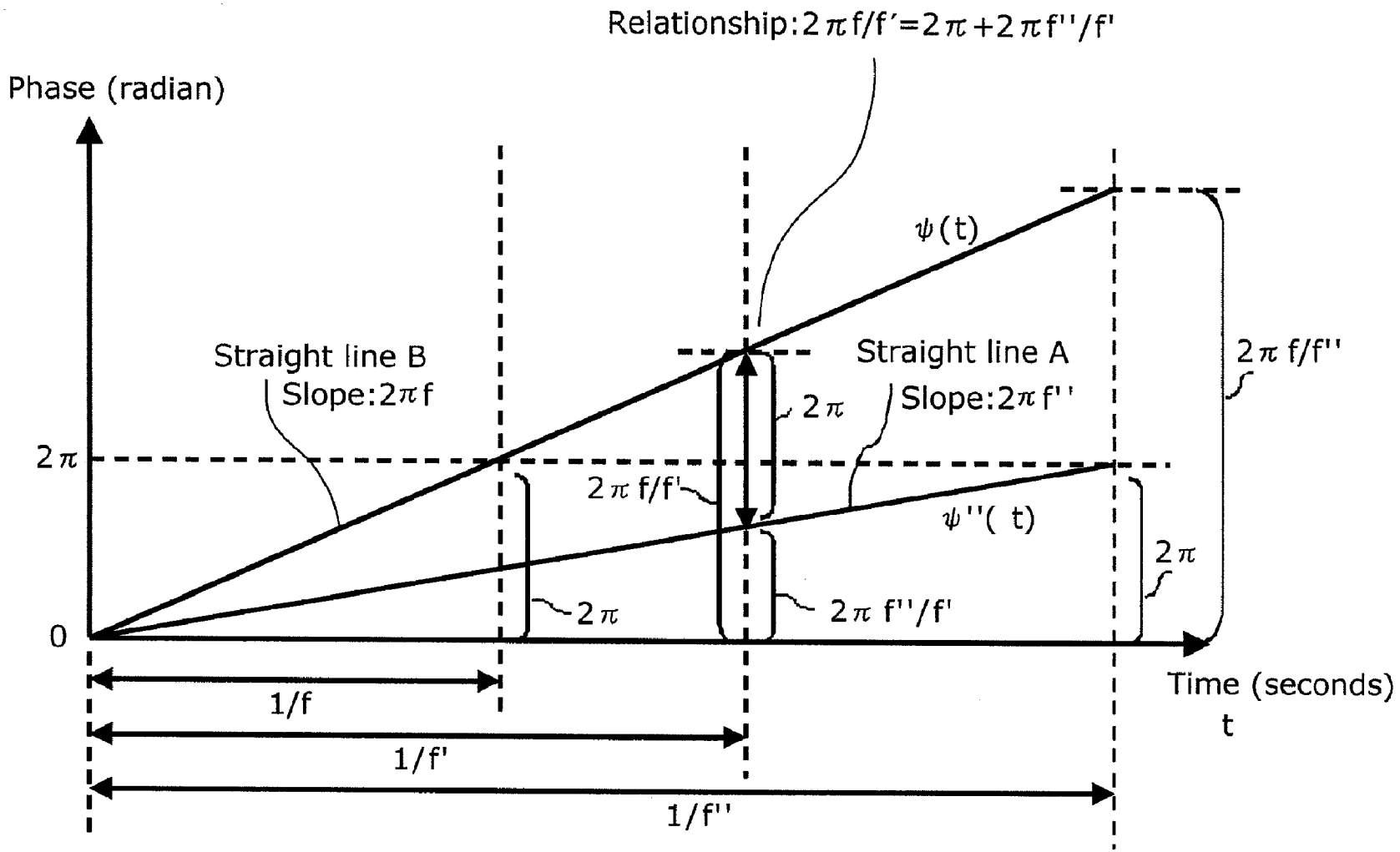
FIG. 41 is a diagram for explaining a method for setting an appropriate analysis-target frequency f.

Here, with reference to FIG. 41, an explanation is given as to how the analysis-target frequency can be obtained from a slope of the straight line A shown in FIG. 40 (*b*). Note here that the straight line A has a slope where ψ"(t) increases by 0 to 2π (radian) at time intervals of 1/f". To be more specific, the slope of the straight line A is 2πf".

The straight line A shown in FIG. 41 is the same as the straight line A shown in FIG. 40 (*b*). In FIG. 41, the horizontal axis is a time axis and the vertical axis is a phase axis. A straight line B shown in FIG. 41 that is defined by the time and ψ(t) is defined by the time and ψ(t) before the straight line A is phase-modified using the frequency f" (the frequency of the frequency band). To be specific, the straight line B is created by adding 2π (radian) to the straight line A for every 1/f' the time progresses. This straight line B can be considered as the phase ψ(t) of the to-be-extracted sound when the to-be-extracted sound exists in this time-frequency domain. The straight line B varies from 0 to 2π (radian) at an isometric speed at the time intervals of 1/f (where f is the analysis-target frequency). The frequency f corresponding to the slope (2πf) of this straight line B is the analysis-target frequency f which is to be obtained.

In this example, since the value of the frequency f' of the frequency band is smaller than the value of the analysis-target frequency f, the straight line A has a positive slope. Note that when the value of the analysis-target frequency f agrees with the value of the frequency f' of the frequency band, the slope of the straight line A is zero. Also note that when the value of the frequency f' of the frequency band is larger than the value of the analysis-target frequency f, the straight line A would have a negative slope.

From the relationship between the straight line A and the straight line B shown in FIG. 41, the following is derived.

$$2\pi(f/f')=2\pi+2\pi(f''/f') \quad \text{[Formula 35]}$$

From this, the following holds true.

$$f=(f'+f'') \quad \text{[Formula 36]}$$

To be more specific, it can be understood that the analysis-target frequency f is expressed by the sum of the frequency f' of the frequency band and the frequency f" corresponding to the slope (2πf") of the straight line A.

In the case of the straight line A shown in FIG. 40 (*b*), since it takes 0.113/0.6 (=1/f") (seconds) for the modified phase ψ" (t) to increase from 0 (radian) to 2π (radian), f"=5 (Hz), meaning that the analysis-target frequency f is 105 Hz (100 Hz+5 Hz).

Next, the phase distance (where ψ'(t)=mod 2π(ψ(t)−2πft) (where f is the analysis-target frequency)) is calculated using the set frequency f. The phase distance can be calculated using the distance between the modified phase ψ"(t) and the straight line A shown in FIG. 40 (*b*). This can be expressed as follows.

$$\begin{aligned}\varphi'(t) &= \text{mod } 2\pi(\varphi(t) - 2\pi f t) \quad \text{[Formula 37]}\\ &= \text{mod } 2\pi(\varphi(t) - 2\pi(f' + f'')t)\\ &= \text{mod } 2\pi((\varphi(t) - 2\pi f' t) - 2\pi f'' t)\\ &= \text{mod } 2\pi(\varphi''(t) - 2\pi f'' t)\end{aligned}$$

This is because the distance (the phase distance) between ψ(t) and the straight line (the straight line B) having the slope of 2πf agrees with the distance between ψ" (t) and the straight line (the straight line A) having the slope of 2πf".

In the present example, the phase distances are calculated using difference errors between the phases ψ" (t) of the phase-modified frequency signals at all the times in the predetermined duration and the straight line A.

It should be noted that the phase distances may be calculated, considering that the phase values are toroidally linked (0 (radian) and 2π (radian) are the same).

Here, when seen from another point of view, the straight line A is obtained in such a way that the phase distances would be at a minimum. For this reason, the analysis-target frequency f calculated from the frequency f" corresponding to the slope of the straight line A minimizes the phase distance. Thus, it can be understood that the analysis-target frequency f is appropriate to this time-frequency domain.

Next, the frequency signal in the predetermined duration whose phase distance is equal to or smaller than the second threshold value is determined as the frequency of the engine sound. In this example, the second threshold value is set to 0.17 (radian). Moreover, in this example, one phase distance of the whole frequency signal in the predetermined duration is calculated, and the frequency signal of the to-be-extracted sound is determined at one time for each time domain.

Figure 42:
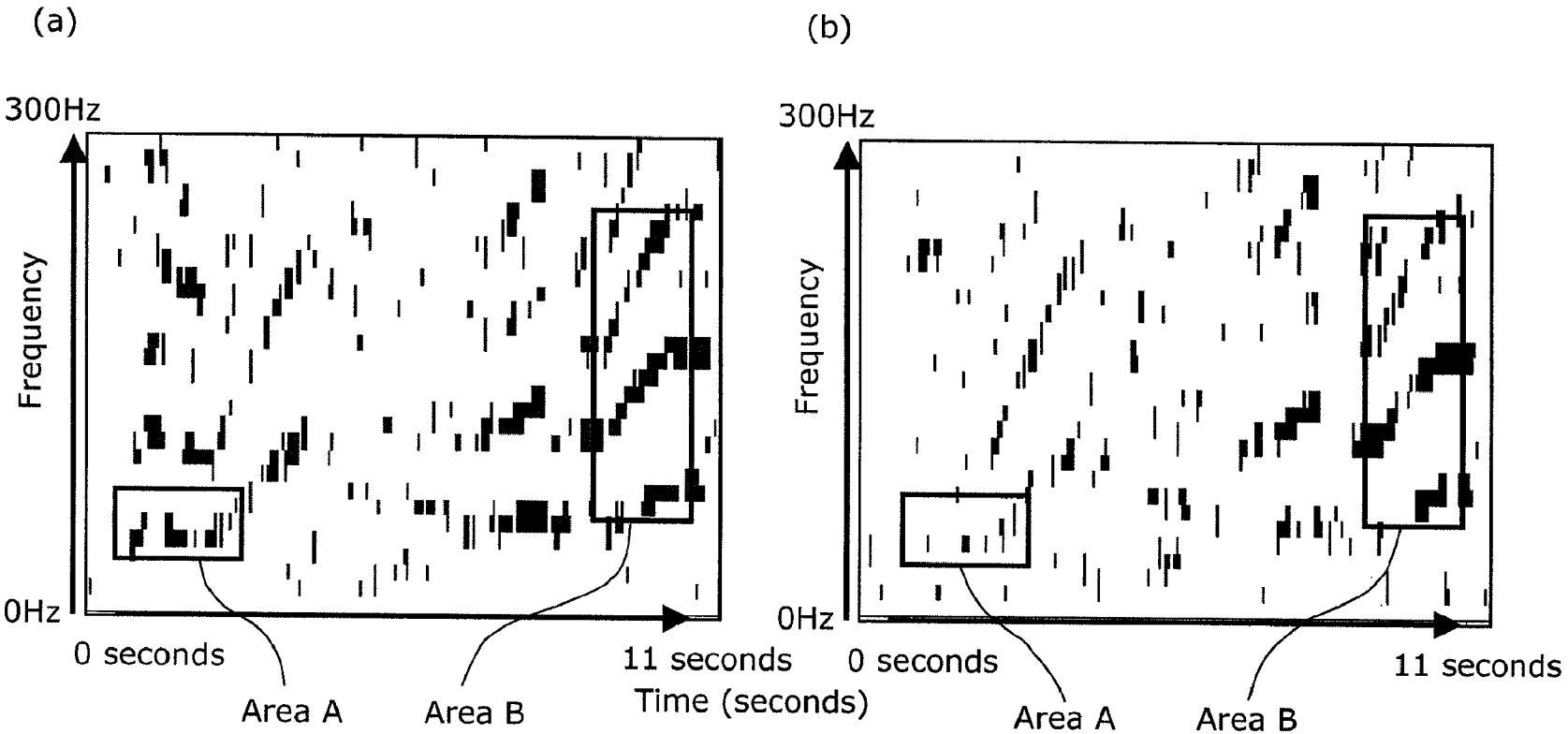
FIG. 42 is a diagram showing an example of a result obtained by determining a frequency signal of an engine sound.

FIG. 42 shows an example of results obtained by determining the frequency signals of the engine sound. These results are obtained by determining the frequency signals of the engine sound from the mixed sounds shown in FIG. 39. The time-frequency domains where the signals are determined as the frequency signals of the engine sound are indicated by black areas. FIG. 42 (*a*) shows the result obtained by determining the engine sound from the mixed sound 2401 (1) shown in FIG. 39 (*a*), and FIG. 42 (*b*) shows the result obtained by determining the engine sound from the mixed sound 2401 (2) shown in FIG. 39 (*b*). Each horizontal axis is a time axis and each vertical axis is a frequency axis. From each area B of FIGS. 42 (*a*) and 42 (*b*), the frequency signal of the engine sound is detected from each corresponding mixed sound. Meanwhile, it can be seen from respective areas A in FIGS. 42 (*a*) and 42 (*b*) that the frequency signal of the engine sound is detected in only a few time-frequency domains of the mixed sound 2401 (2) due to the influence of wind noise, and that the frequency signal of the engine sound is detected in many time-frequency domains of the mixed sound 2401 (1).

These processes are performed for each frequency band j (j=1 to M).

Next, at a time when the to-be-extracted sound determination unit 4103 (*j*) determines that the frequency signal of the engine sound exists in at least one of the mixed sound 2401 (1) and the mixed sound 2401 (2), the sound detection unit 4104 (*j*) creates the to-be-extracted sound detection flag 4105 and provides an output of this flag (step S4302 (*j*)).

Figure 43:
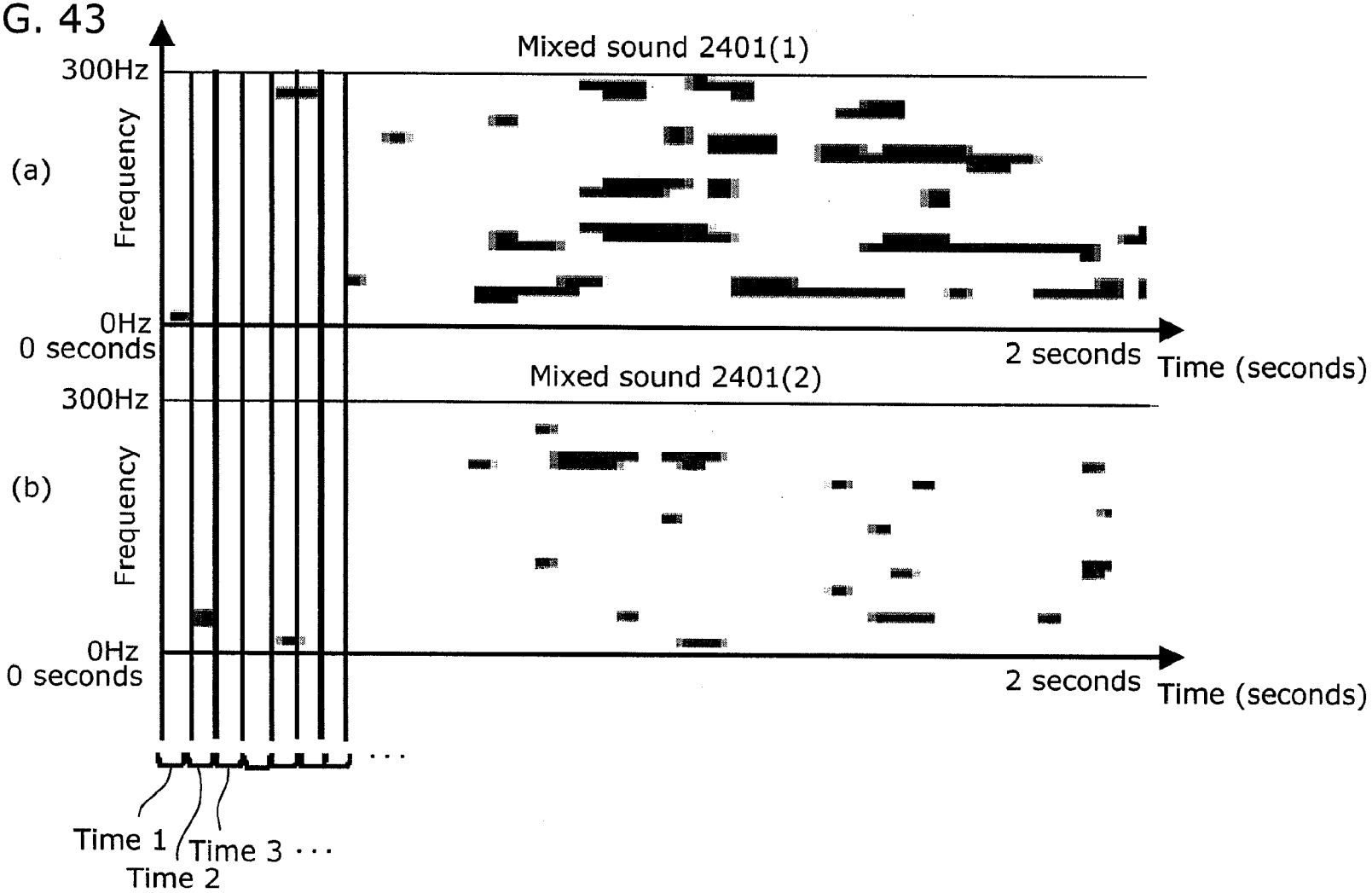
FIG. 43 is a diagram for explaining an example of a method for creating a to-be-extracted sound detection flag.

FIG. 43 shows an example of a method for creating the to-be-extracted sound detection flag 4105. In FIG. 43, parts from 0 seconds to 2 seconds in the respective determination results shown in FIGS. 42 (*a*) and 42 (*b*) are arranged one above the other, with the time axes being aligned (FIG. 42 (*a*) is shown above and FIG. 42 (*b*) is shown below). Each horizontal axis is a time axis, and each vertical axis is a frequency axis. The time-frequency domains where the signals are determined as the frequency signals of the engine sound are indicated by black areas. In the present example, using the determination results, as a whole, obtained for the frequency bands from 10 Hz to 300 Hz where the engine sound of the motorcycle exists, whether or not the to-be-extracted sound detection flag 4105 is created and an output of the flag is provided is determined for each predetermined duration (113 ms) which is a unit of time in which the phase distances have been calculated.

At a time 1 in FIG. 43, the frequency signal of the engine sound is detected from the mixed sound 2401 (1) of FIG. 43 (*a*). On the other hand, the frequency signal of the engine sound is not detected from the mixed sound 2401 (2) of FIG. 43 (*b*). In this case, since the frequency signal of the engine sound is detected at least from the mixed sound 2401 (1) of FIG. 43 (*a*), it can be understood that there is a vehicle in the vicinity. Thus, the to-be-extracted sound detection flag 4105 is created and an output of this flag is provided.

At a time 2 in FIG. 43, the frequency signal of the engine sound is not detected from the mixed sound 2401 (1) of FIG. 43 (*a*). On the other hand, the frequency signal of the engine sound is detected from the mixed sound 2401 (2) of FIG. 43 (*b*). In this case, since the frequency signal of the engine sound is detected at least from the mixed sound 2401 (2) of FIG. 43 (*b*), it can be understood that there is a vehicle in the vicinity. Thus, the to-be-extracted sound detection flag 4105 is created and an output of this flag is provided.

At a time 3 in FIG. 43, the frequency signal of the engine sound is not detected from the mixed sound 2401 (1) of FIG. 43 (*a*). The frequency signal of the engine sound is not detected from the mixed sound 2401 (2) of FIG. 43 (*b*) either. In this case, it is judged that there is no vehicle in the vicinity. Thus, the to-be-extracted sound detection flag 4105 is not created.

As another method for creating the to-be-extracted sound detection flag 4105, there is a method whereby whether or not the to-be-extracted sound detection flag 4105 is created and an output of this flag is provided is determined for each of times set independently of the predetermined duration that is a unit of time in which the phase distances have been calculated. For example, in the case where whether or not the to-be-extracted sound detection flag 4105 is created and an output of this flag is provided is determined every interval (one second, for example) longer than the predetermined duration, the to-be-extracted sound detection flag 4105 can be created and an output of this flag can be provided with stability even when there are times at which the frequency signal of the engine sound could not be detected momentarily due to the influence of noise. Accordingly, the vehicle detection can be performed with precision.

Finally, when receiving the to-be-extracted sound detection flag 4105, the presentation unit 4106 notifies the driver of the approach of the vehicle (step S4303).

These processes are performed while the time of the predetermined duration is being shifted.

According to the configuration as described above, the analysis-target frequency appropriate for determining the to-be-extracted sound can be obtained in advance. That is, the to-be-extracted sound does not need to be determined after the phase distances of a great number of analysis-target frequencies are calculated, thereby reducing the amount of throughput required to calculate the phase distances.

Also, the analysis-target frequency appropriate for determining the to-be-extracted sound can be obtained in advance using an approximate straight line. That is, the to-be-extracted sound does not need to be determined after the phase distances of a great number of analysis-target frequencies are calculated, thereby reducing the amount of throughput required to calculate the phase distances.

Moreover, since the detailed analysis-target frequency is obtained, the detailed frequency of the to-be-extracted sound can be obtained when the frequency signal of the to-be-extracted sound is determined from the mixed sound.

Furthermore, even when a to-be-extracted sound cannot be detected, due to the influence of noise, from a mixed sound collected by one microphone, there is an increased possibility for the to-be-extracted sound to be detected by another microphone. This can reduce detection errors. In this example, a mixed sound collected by a microphone less affected by wind noise, the influence of which depends on the position of the microphone, can be used. On account of this, the engine sound as the to-be-extracted sound can be detected with accuracy, and the driver can be accordingly notified of the approach of a vehicle. Additionally, although two microphones are used in this example, the to-be-extracted sound may be determined using three or more microphones.

Also, the phase distance of a plurality of frequency signals is calculated at one time and compared to the second threshold, so that whether or not the plurality of the frequency signals as a whole is the frequency signal of the to-be-extracted sound can be determined at one time. Thus, when it so happens that the phase of noise agrees with the phase of the to-be-extracted sound, the frequency signal of the to-be-extracted sound can be determined with stability.

It should be noted that the to-be-extracted sound determination unit of the first or second embodiment may be used in the vehicle detection device of the third embodiment. Also note that the to-be-extracted sound determination unit of the third embodiment may be used in the first and second embodiments.

Lastly, methods for determining a frequency signal of a to-be-extracted sound from a different mixed sound are summarized.

(I) A method for determining a 200-Hz sine wave (a 200-Hz frequency signal) from a mixed sound of the 200-Hz sine wave and white noise is described.

Figure 44:
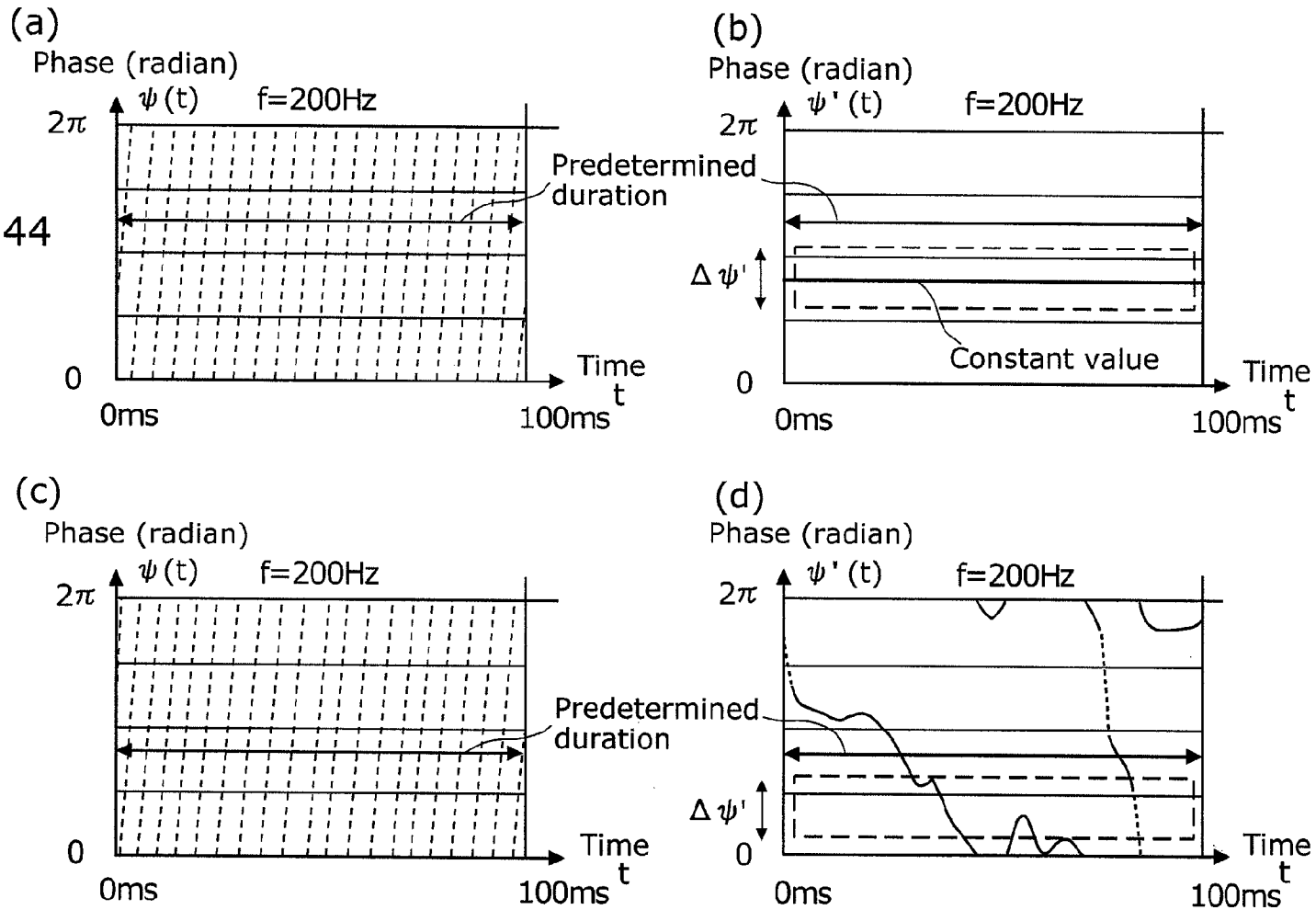
FIG. 44 is a diagram used for considering the time variation in the phase.
Figure 45:
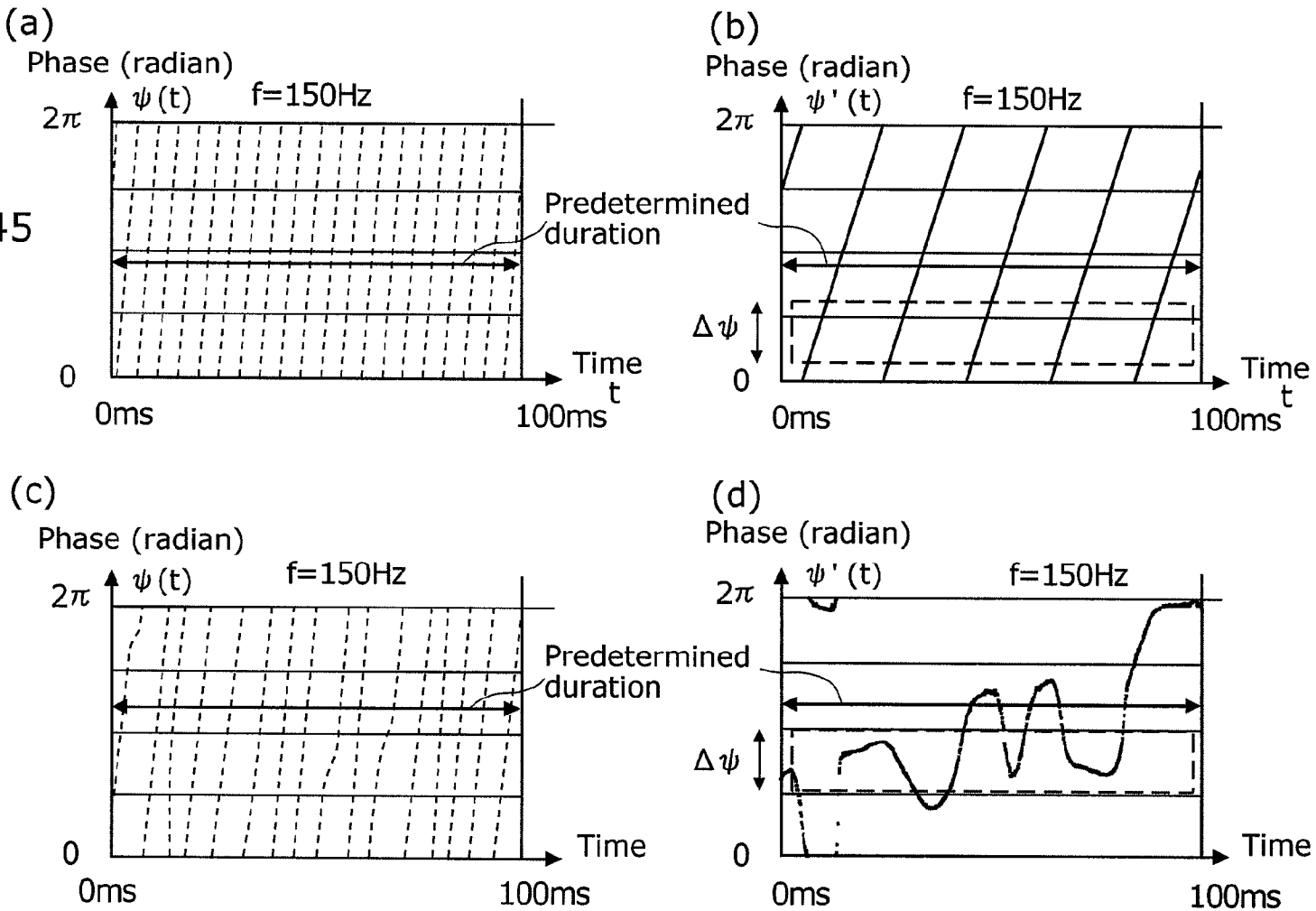
FIG. 45 is a diagram used for considering the time variation in the phase.

FIG. 44 shows a result obtained by analyzing the time variation in the phase when the analysis-target frequency f is 200 Hz in the frequency band where the center frequency f is 200 Hz. FIG. 45 shows a result obtained by analyzing the time variation in the phase when the analysis-target frequency f is 150 Hz in the frequency band where the center frequency f is 150 Hz. In these examples, the predetermined duration used for calculating the phase distances is set to 100 ms, and the time variation in the phase in the time duration of 100 ms is analyzed. Each of FIGS. 44 and 45 shows the analysis result obtained using the 200-Hz sine wave and the white noise.

FIG. 44 (*a*) shows the time variation of the phase $\psi(t)$ (the phase modification is not performed) of the 200-Hz sine wave. In this time duration, the phase $\psi(t)$ of the 200-Hz sine wave cyclically varies at a slope of $2\pi*200$ with respect to the time. FIG. 44 (*b*) shows that the phase $\psi(t)$ shown in FIG. 44 (*a*) is modified to $\psi'(t)=\mathrm{mod}\ 2\pi(\psi(t)-2\pi*200*t)$ (where the analysis-target frequency is 200 Hz). It can be seen that the phase $\psi'(t)$ of the 200-Hz sine wave after the phase modification remains constant regardless of the time. On account of this, the phase distance in a distance space defined by $\psi'(t)=\mathrm{mod}\ 2\pi(\psi(t)-2\pi*200*t)$ (where the analysis-target frequency is 200 Hz) in this time duration is small.

FIG. 44 (*c*) shows the time variation of the phase $\psi'(t)$ (the phase modification is not performed) of the white noise. In this time duration, the phase $\psi(t)$ of the white noise seems to cyclically vary at a slope of $2\pi*200$ with respect to the time. However, the phase does not cyclically vary in a precise sense. FIG. 44 (*d*) shows that the phase $\psi'(t)$ shown in FIG. 44 (*c*) is modified to $\psi'(t)=\mathrm{mod}\ 2\pi(\psi(t)-2\pi*200*t)$ (where the analysis-target frequency is 200 Hz). It can be seen that the phase $\psi'(t)$ of the white noise after the phase modification varies between 0 and $2\pi$ (radian) over the course of time. On account of this, the phase distance in a distance space defined by $\psi'(t)=\mathrm{mod}\ 2\pi(\psi(t)-2\pi*200*t)$ (where the analysis-target frequency is 200 Hz) in this time duration is large as compared with the phase distance of the 200-Hz sine wave shown in FIG. 44 (*a*) or FIG. 44 (*b*).

FIG. 45 (*a*) shows the time variation of the phase $\psi(t)$ (the phase modification is not performed) of the 200-Hz sine wave. In this time duration, the phase $\psi(t)$ of the 200-Hz sine wave does not vary at a slope of $2\pi*150$ with respect to the time (but does vary at a slope of $2\pi*200$ with respect to the time). FIG. 45 (*b*) shows that the phase $\psi(t)$ shown in FIG. 45 (*a*) is modified to $\psi'(t)=\mathrm{mod}\ 2\pi(\psi(t)-2\pi*150*t)$ (where the analysis-target frequency is 150 Hz). It can be seen that the phase $\psi'(t)$ of the 200-Hz sine wave after the phase modification cyclically varies between 0 and $2\pi$ (radian) over the course of time. On account of this, the phase distance in a distance space defined by $\psi'(t)=\mathrm{mod}\ 2\pi(\psi(t)-2\pi*150*t)$ (where the analysis-target frequency is 150 Hz) in this time duration is large as compared with the phase distance of the 200-Hz sine wave shown in FIG. 44 (*a*) or FIG. 44 (*b*).

FIG. 45 (*c*) shows the time variation of the phase ψ(t) (the phase modification is not performed) of the white noise. In this time duration, the phase ψ(t) of the white noise does not vary at a slope of 2π*150 with respect to the time. FIG. 45 (*d*) shows that the phase ψ (t) shown in FIG. 45 (*c*) is modified to ψ'(t)=mod 2π(ψ(t)−2π*150*t) (where the analysis-target frequency is 150 Hz). It can be seen that the phase ψ'(t) of the white noise after the phase modification varies between 0 and 2π (radian) over the course of time. On account of this, the phase distance in a distance space defined by ψ'(t)=mod 2πt (ψ(t)−2π*150*t) (where the analysis-target frequency is 150 Hz) in this time duration is large as compared with the phase distance of the 200-Hz sine wave shown in FIG. 45 (*a*) or FIG. 45 (*b*).

From the analysis results shown in FIGS. 44 and 45, when the 200-Hz sine wave and the white noise are discriminated and the frequency signal of the 200-Hz sine wave is thus determined, the second threshold value is set so as to be: larger than the phase distance of the 200-Hz sine wave shown in FIG. 44 (*a*) or FIG. 44 (*b*); smaller than the phase distance of the white noise shown in FIG. 44 (*c*) or FIG. 44 (*d*); smaller than the phase distance of the 200-Hz sine wave shown in FIG. 45 (*a*) or FIG. 44 (*b*); and smaller than the phase distance of the white noise shown in FIG. 45 (*c*) or FIG. 45 (*d*). For example, it can be understood that the second threshold value may be set to Δψ'=π/6 to π/2 (radian) as shown in FIG. 44 (*b*), FIG. 44 (*d*), FIG. 45 (*b*), and FIG. 45 (*d*). Here, the frequency signal which is not determined as the to-be-extracted sound is the frequency signal of the white noise.

It should be noted that the 200-Hz frequency signal of the to-be-extracted sound can be determined from a mixed sound of the frequency band (including the 200-Hz frequency) where the center frequency is 150 Hz. The only procedure to follow is to make the analysis-target frequency at 200 Hz in FIG. 45 (*a*) and to determine the phase distance in the case where ψ'(t)=mod 2π(ψ(t)−2π*200*t) (where the analysis-target frequency is 200 Hz).

(II) A method for determining a frequency signal of a motorcycle sound from a mixed sound of the motorcycle sound (the engine sound) and background noise is described. In this example, the second threshold value is set to π/2.

Figure 46:
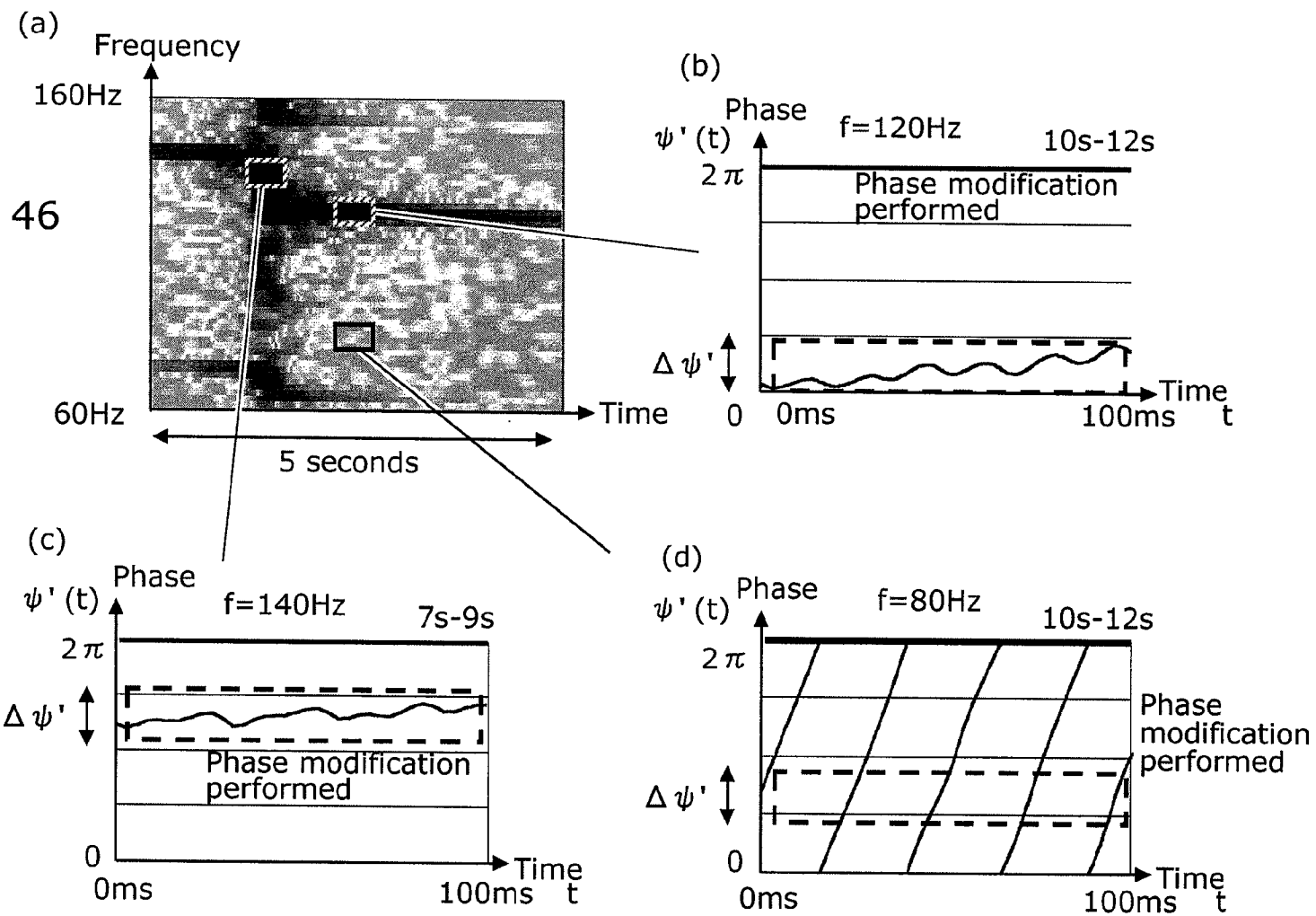
FIG. 46 is a diagram showing a result obtained by analyzing the time variation of the phase of a motorcycle sound.

FIG. 46 shows a result obtained by analyzing the time variation of the phase of the motorcycle sound. FIG. 46 (*a*) shows a spectrogram of the motorcycle sound, darker parts indicating the frequency signal of the motorcycle sound. The Doppler shift heard when the motorcycle is passing by is shown. Each of FIGS. 46 (*b*), 46 (*c*), and 46 (*d*) shows the time variation of the phase ψ'(t) when the phase modification is performed.

FIG. 46 (*b*) shows an analysis result obtained when the analysis-target frequency is set to 120 Hz using the frequency signal of the 120-Hz frequency band. The phase distance of the phase ψ'(t) at this time in a time duration of 100 ms (the predetermined duration) is equal to or smaller than the second threshold value. Thus, the frequency signal of this time-frequency domain is determined as the frequency signal of the motorcycle sound. Moreover, since the analysis-target frequency is 120 Hz, the frequency of the determined frequency signal of the motorcycle sound can be identified as 120 Hz.

FIG. 46 (*c*) shows an analysis result obtained when the analysis-target frequency is set to 140 Hz using the frequency signal of the 140-Hz frequency band. The phase distance of the phase ψ'(t) at this time in a time duration of 100 ms (the predetermined duration) is equal to or smaller than the second threshold value. Thus, the frequency signal of this time-frequency domain is determined as the frequency signal of the motorcycle sound. Moreover, since the analysis-target frequency is 140 Hz, the frequency of the determined frequency signal of the motorcycle sound can be identified as 140 Hz.

FIG. 46 (*d*) shows an analysis result obtained when the analysis-target frequency is set to 80 Hz using the frequency signal of the 80-Hz frequency band. The phase distance of the phase ψ'(t) at this time in the time duration of 100 ms (the predetermined duration) is larger than the second threshold value. Thus, it is determined that the frequency signal of this time-frequency domain is not the frequency signal of the motorcycle sound.

(III) With reference to FIGS. 44 and 46, explanations are given about: a method for determining a frequency signal of a 200-Hz sine wave and a motorcycle sound from a mixed sound of the motorcycle sound (the engine sound), the 200-Hz sine wave, and white noise; a method for determining a frequency signal of the 200-Hz sine wave from the mixed sound; a method for determining a frequency signal of the motorcycle sound from the mixed sound; and a method for determining a frequency signal of the white noise. In this example, the predetermined duration is set to 100 ms.

First, the method for determining the frequency signal of the 200-Hz sine wave and the motorcycle sound, in distinction from the white noise, is described. In this example, the second threshold value is set to π/2 (radian).

Here, from the analysis result shown in FIG. 44 and the analysis result shown in FIG. 46, the phase distance of the white noise is larger than the second threshold value, and each phase distance of the 200-Hz sine wave and the motorcycle sound is equal to or smaller than the second threshold value. This makes it possible to determine the frequency signal of the 200-Hz sine wave and the motorcycle sound, in distinction from the white noise.

Next, the method for determining the frequency signal of the 200-Hz sine wave, in distinction from the white noise and the motorcycle sound, is described. In this example, the second threshold value is set to π/6 (radian).

Here, from the analysis result shown in FIG. 44, the phase distance of the white noise is larger than the second threshold value, and the phase distance of the 200-Hz sine wave is equal to or smaller than the second threshold value. This makes it possible to determine the frequency signal of the 200-Hz sine wave, in distinction from the white noise. Moreover, from the analysis result shown in FIG. 46, the phase distance of the motorcycle sound is larger than the second threshold value in this example. This makes it possible to determine the frequency signal of the 200-Hz sine wave, in distinction from the motorcycle sound.

Next, the method for determining the frequency signal of the motorcycle sound, in distinction from the white noise and the 200-Hz sine wave, is described. In this example, the second threshold value is set to π/6 (radian) and the third threshold value is set to π/2 (radian).

First, the second threshold value is set to π/2 (radian). Then, the frequency signal including both the motorcycle sound and the 200-Hz sine wave is determined from the analysis result shown in FIG. 44 and the analysis result shown in FIG. 46. Next, the second threshold value is set to π/6 (radian). Then, the frequency signal of the 200-Hz sine wave is determined from the analysis result shown in FIG. 44 and the analysis result shown in FIG. 46. Lastly, by removing the frequency signal determined as the 200-Hz sine wave from the frequency signal including both the motorcycle sound and the 200-Hz sine wave, the frequency signal of the motorcycle sound is determined.

Finally, the method for determining the frequency signal of the white noise, in distinction from the 200-Hz sine wave and the motorcycle sound, is described. In this example, the second threshold value is set to 2π (radian).

Here, from the analysis result shown in FIG. 44 and the analysis result shown in FIG. 46, the phase distance of the white noise is larger than the second threshold value, and each phase distance of the 200-Hz sine wave and the motorcycle sound is equal to or smaller than the second threshold value. Thus, by extracting the frequency signal whose phase distance is larger than the second threshold value, the frequency signal of the white noise can be determined.

(IV) A method for determining a frequency signal of a siren sound from a mixed sound of the siren sound and background noise is described.

In this example, the frequency signal of the siren sound is determined for each time-frequency domain, using the same method as described in the third embodiment. A DFT time window is 13 ms in the present example. Also, the frequency signal is obtained by dividing the frequency band from 900 Hz to 1300 Hz into 10-Hz intervals. In this example, the predetermined duration is set to 38 ms, and the second threshold value is set to 0.03 (radian). The first threshold value is the same as in the third embodiment.

Figure 47:
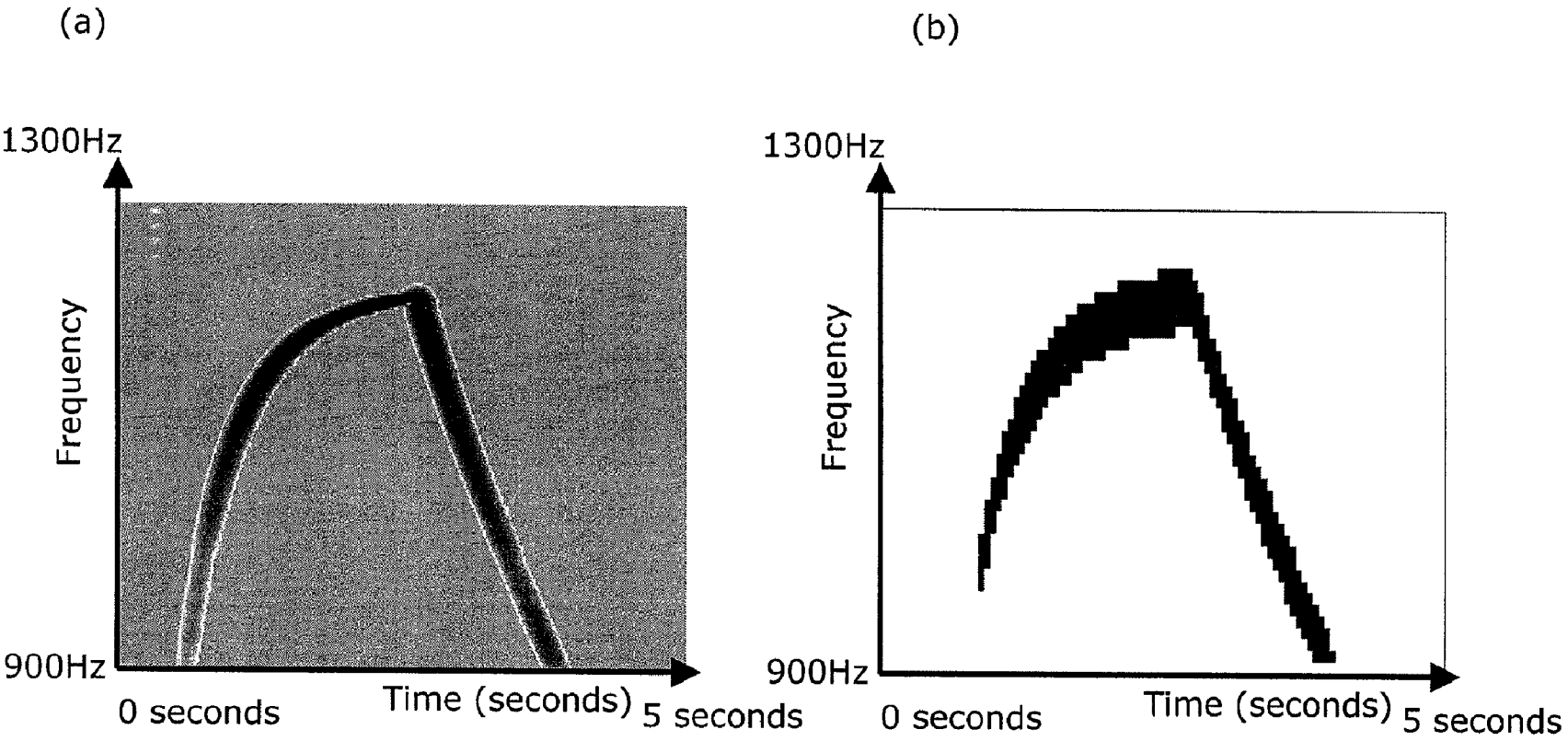
FIG. 47 is a diagram showing an example of a result obtained by determining a frequency signal of a siren sound.

FIG. 47 (*a*) shows a spectrogram of the mixed sound of the siren sound and the background sound. The display manner in FIG. 47 (*a*) is the same as in FIG. 40 (*a*), and thus the detailed explanation is not repeated here. FIG. 47 (*b*) shows a result obtained by determining the siren sound from the mixed sound shown in FIG. 47 (*a*). The display manner in FIG. 47 (*b*) is the same as in FIG. 42 (*a*), and thus the detailed explanation is not repeated here. From the result shown in FIG. 47 (*b*), it can be seen that the frequency signal of the siren sound is determined for each time-frequency domain.

(V) A method for determining a frequency signal of a voice from a mixed sound of the voice and background noise is described.

In this example, the frequency signal of the voice is determined using the same method as described in the third embodiment. A DFT time window in the present example is 6 ms. Also, the frequency signal is obtained by dividing the frequency band from 0 Hz to 1200 Hz into 10-Hz intervals. In this example, the predetermined duration is set to 19 ms, and the second threshold value is set to 0.09 (radian). The first threshold value is the same as in the third embodiment.

Figure 48:
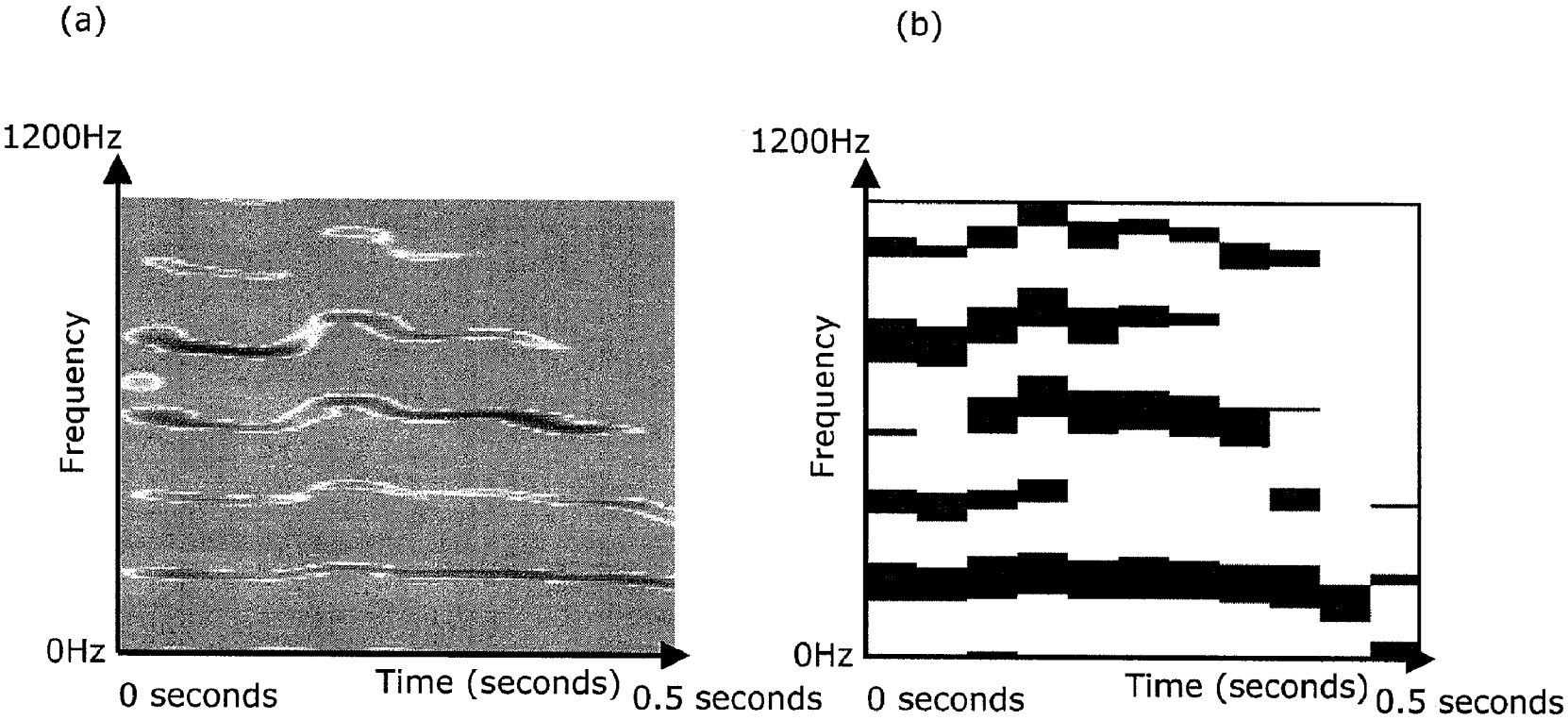
FIG. 48 is a diagram showing an example of a result obtained by determining a frequency signal of a voice.

FIG. 48 (*a*) shows a spectrogram of the mixed sound of the voice and the background sound. The display manner in FIG. 48 (*a*) is the same as in FIG. 40 (*a*), and thus the detailed explanation is not repeated here. FIG. 48 (*b*) shows a result obtained by determining the voice from the mixed sound shown in FIG. 48 (*a*). The display manner in FIG. 48 (*b*) is the same as in FIG. 42 (*a*), and thus the detailed explanation is not repeated here. From the result shown in FIG. 48 (*b*), it can be seen that the frequency signal of the voice is determined for each time-frequency domain.

(VI) A result obtained by determining a frequency signal of a 100-Hz sine wave and white noise is described.

Figure 49A:
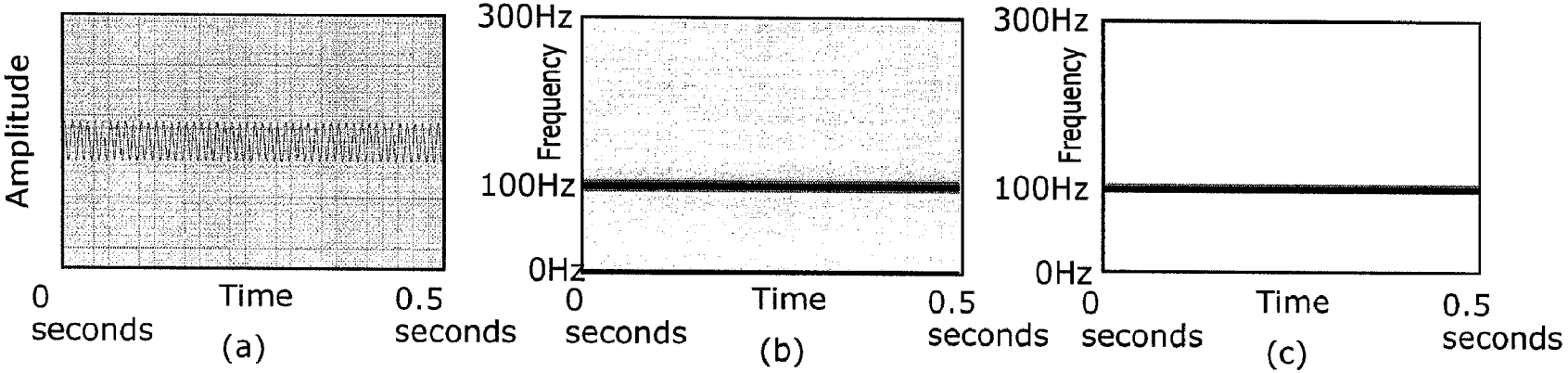
FIG. 49A is a diagram showing a result of detection when a 100-Hz sine wave is received.

FIG. 49A shows a detection result in the case where the 100-Hz sine wave is received. FIG. 49A (a) shows a graph of the received sound waveform. The horizontal axis represents time, and the vertical axis represents amplitude. FIG. 49A (b) shows a spectrogram of the sound waveform shown in FIG. 49A (a). The display manner is the same as in FIG. 10, and thus the detailed explanation is not repeated here. FIG. 49A (c) is a graph showing the detection result obtained when the sound waveform shown in FIG. 49A (a) is received. The display manner is the same as in FIG. 42 (*a*), and thus the detailed explanation is not repeated here. From FIG. 49A (c), it can be seen that the frequency signal of the 100-Hz sine wave is detected.

Figure 49B:
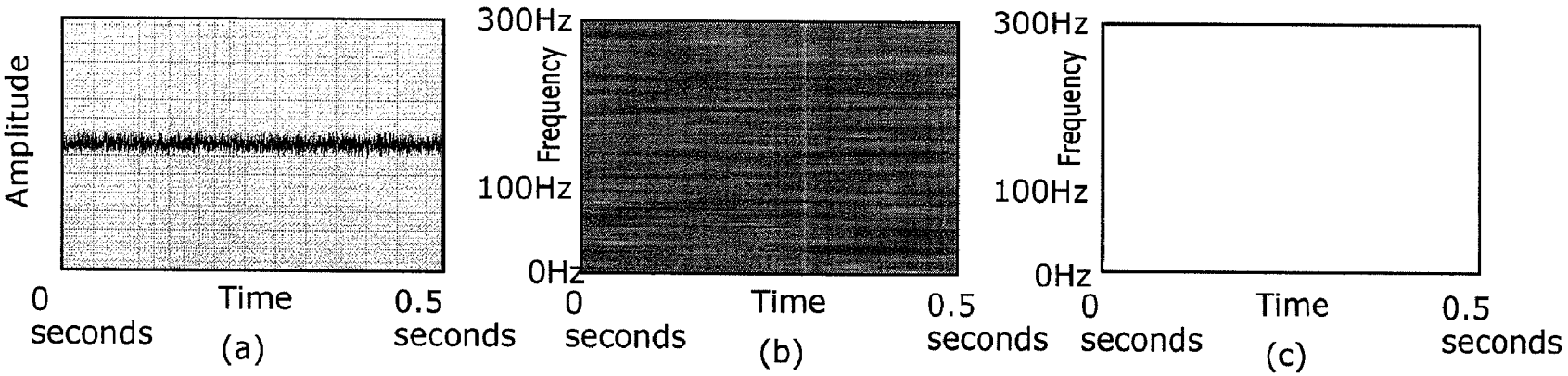
FIG. 49B is a diagram showing a result of detection when white noise is received.

FIG. 49B shows a detection result in the case where the white noise is received. FIG. 49B (a) shows a graph of the received sound waveform. The horizontal axis represents time, and the vertical axis represents amplitude. FIG. 49B (b) shows a spectrogram of the sound waveform shown in FIG. 49B (a). The display manner is the same as in FIG. 10, and thus the detailed explanation is not repeated here. FIG. 49B (c) is a graph showing the detection result obtained when the sound waveform shown in FIG. 49B (a) is received. The display manner is the same as in FIG. 42 (*a*), and thus the detailed explanation is not repeated here. From FIG. 49B (c), it can be seen that the white noise is not detected.

Figure 49C:
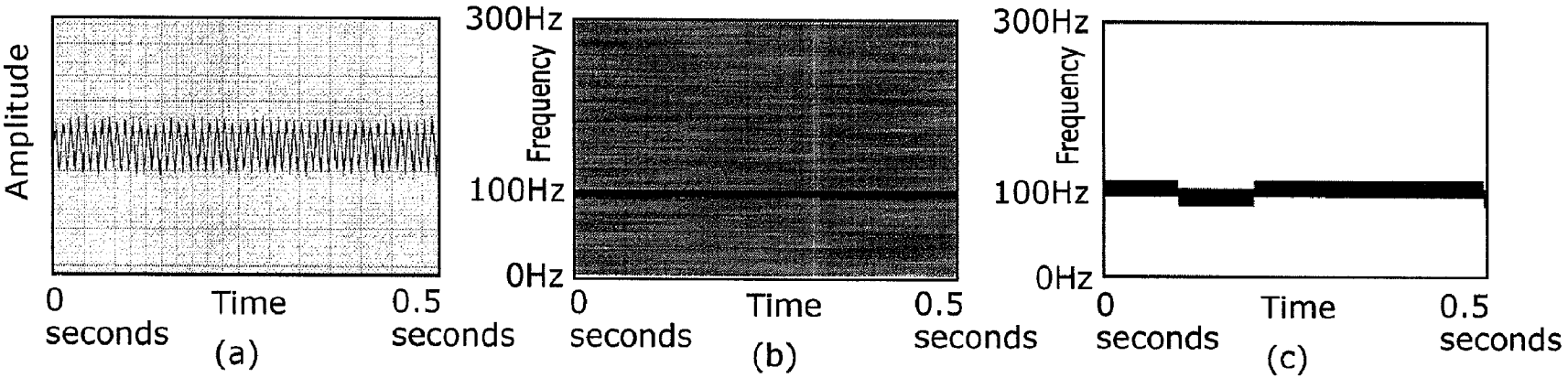
FIG. 49C is a diagram showing a result of detection when a mixed sound of the 100-Hz waveform and the white noise are received.

FIG. 49C shows a detection result in the case where a mixed sound of a 100-Hz sine wave and white noise are received. FIG. 49C (a) shows a graph of the received mixed-sound waveform. The horizontal axis represents time, and the vertical axis represents amplitude. FIG. 49C (b) shows a spectrogram of the sound waveform shown in FIG. 49C (a). The display manner is the same as in FIG. 10, and thus the detailed explanation is not repeated here. FIG. 49C (c) is a graph showing the detection result obtained when the sound waveform shown in FIG. 49C (a) is received. The display manner is the same as in FIG. 42 (*a*), and thus the detailed explanation is not repeated here. From FIG. 49C (c), it can be seen that the frequency signal of the 100-Hz sine wave is detected and the white noise is not detected.

Figure 50A:
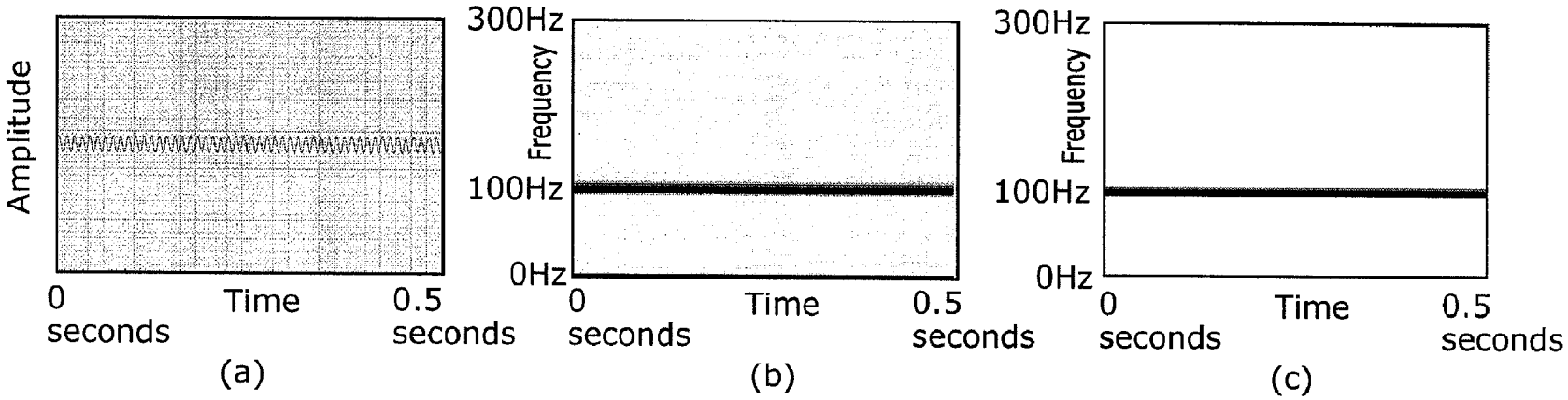
FIG. 50A is a diagram showing a result of detection when a 100-Hz sine wave is received.

FIG. 50A shows a detection result in the case where a 100-Hz sine wave which is smaller in amplitude than the wave shown in FIG. 49A is received. FIG. 50A (a) shows a graph of the received sound waveform. The horizontal axis represents time, and the vertical axis represents amplitude. FIG. 50A (b) shows a spectrogram of the sound waveform shown in FIG. 50A (a). The display manner is the same as in FIG. 10, and thus the detailed explanation is not repeated here. FIG. 50A (c) is a graph showing the detection result obtained when the sound waveform shown in FIG. 50A (a) is received. The display manner is the same as in FIG. 42 (*a*), and thus the detailed explanation is not repeated here. From FIG. 50A (c), it can be seen that the frequency signal of the 100-Hz sine wave is detected. As compared with the result shown in FIG. 49A, it can be seen that the frequency signal of the sine wave can be detected independently of the amplitude of the received sound waveform.

Figure 50B:
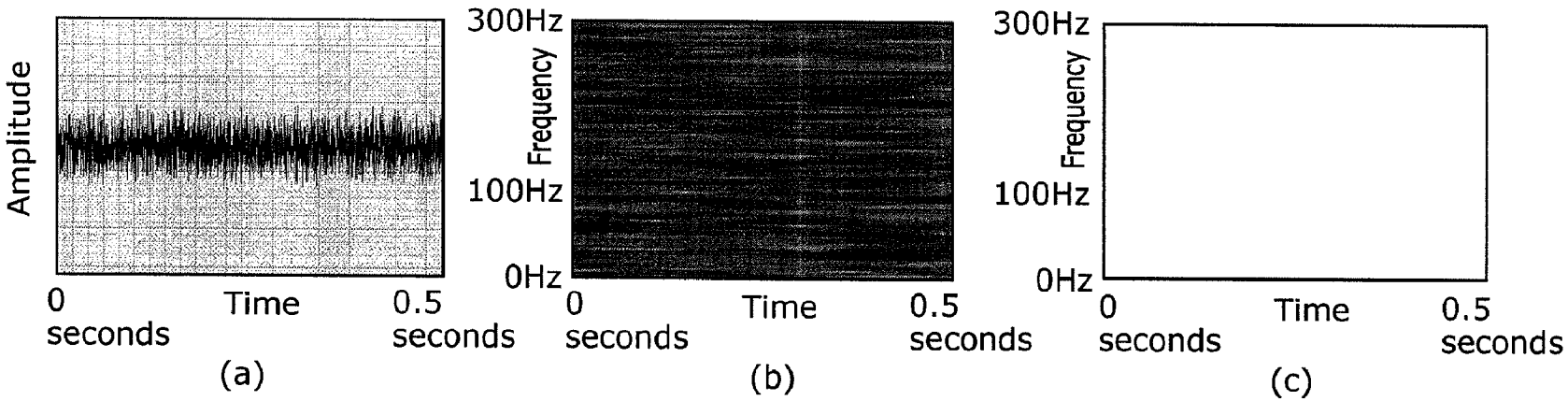
FIG. 50B is a diagram showing a result of detection when white noise is received.

FIG. 50B shows a detection result in the case where white noise which is larger in amplitude than the white noise shown in FIG. 49B is received. FIG. 50B (a) shows a graph of the received sound waveform. The horizontal axis represents time, and the vertical axis represents amplitude. FIG. 50B (b) shows a spectrogram of the sound waveform shown in FIG. 50B (a). The display manner is the same as in FIG. 10, and thus the detailed explanation is not repeated here. FIG. 50B (c) is a graph showing the detection result obtained when the sound waveform shown in FIG. 50B (a) is received. The display manner is the same as in FIG. 42 (*a*), and thus the detailed explanation is not repeated here. From FIG. 50B (c), it can be seen that the white noise is not detected. As compared with the result shown in FIG. 49A, it can be seen that the white noise is not detected independently of the amplitude of the received sound waveform.

Figure 50C:
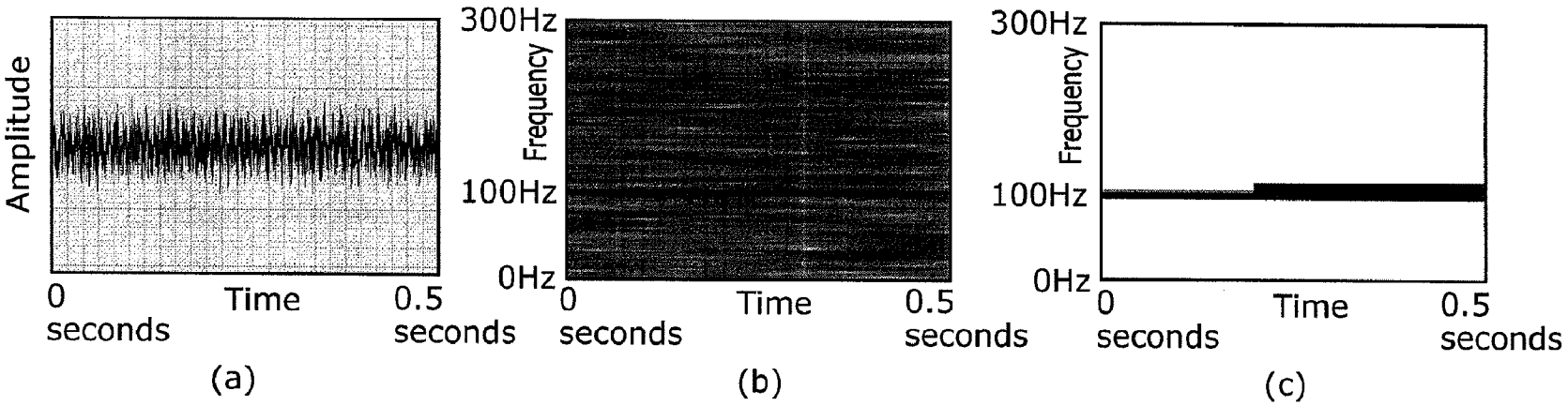
FIG. 50C is a diagram showing a result of detection when a mixed sound of the 100-Hz waveform and the white noise are received.

FIG. 50C shows a detection result in the case where a mixed sound of a 100-Hz sine wave and white noise whose S/N ratio is different from the ratio shown in FIG. 49B are received. FIG. 50C (a) shows a graph of the sound waveform of the received mixed sound. The horizontal axis represents time, and the vertical axis represents amplitude. FIG. 50C (b) shows a spectrogram of the sound waveform shown in FIG. 50C (a). The display manner is the same as in FIG. 10, and thus the detailed explanation is not repeated here. FIG. 50C (c) is a graph showing the detection result obtained when the sound waveform shown in FIG. 50C (a) is received. The display manner is the same as in FIG. 42 (*a*), and thus the detailed explanation is not repeated here. From FIG. 50C (c), it can be seen that the frequency signal of the 100-Hz sine wave is detected and the white noise is not detected. As compared with the result shown in FIG. 49A, it can be seen that the frequency signal of the sine wave can be detected independently of the amplitude of the received sound waveform.

It should be understood that the exemplary embodiments of the present invention disclosed so far are described only as examples in all respects and are not intended in any way to limit the scope of the present invention. The scope of the present invention is to be defined not by the above description but by the appended claims. The meanings equivalent to the scope of the present invention and all modifications made within the scope of the present invention are intended to be included herein.

INDUSTRIAL APPLICABILITY

Using the sound determination device included in the present invention, a frequency signal of a to-be-extracted sound included in a mixed sound can be determined for each time-frequency domain. In particular, discrimination is made between a toned sound, such as an engine sound, a siren sound, and a voice, and a toneless sound, such as wind noise, a sound of rain, and background noise, so that a frequency signal of the toned sound (or, the toneless sound) can be determined for each time-frequency domain.

Accordingly, the present invention can be applied to an audio output device which receives a frequency signal of a sound determined for each time-frequency domain and provides an output of a to-be-extracted sound through reverse frequency conversion. Also, the present invention can be applied to a sound source direction detection device which receives a frequency signal of a to-be-extracted sound determined for each time-frequency domain for each of mixed sounds received from two or more microphones, and then provides an output of a sound source direction of the to-be-extracted sound. Moreover, the present invention can be applied to a sound identification device which receives a frequency signal of a to-be-extracted sound determined for each time-frequency domain and then performs sound recognition and sound identification. Furthermore, the present invention can be applied to a wind-noise level determination device which receives a frequency signal of wind noise determined for each time-frequency domain and provides an output of the magnitude of power. Also, the present invention can be applied to a vehicle detection device which: receives a frequency signal of a traveling sound that is caused by tire friction and determined for each time-frequency domain; and detects a vehicle from the magnitude of power. Moreover, the present invention can be applied to a vehicle detection device which detects a frequency signal of an engine sound determined for each time-frequency domain and notifies of the approach of a vehicle. Furthermore, the present invention can be applied to an emergency vehicle detection device or the like which detects a frequency signal of a siren sound determined for each time-frequency domain and notifies of the approach of an emergency vehicle.

The invention claimed is:

1. A sound determination device, comprising:

a frequency analysis unit configured to receive a mixed sound including a to-be-extracted sound and a noise, and to obtain a frequency signal of the mixed sound at each of a plurality of time slices of the mixed sound over a predetermined duration; and a to-be-extracted sound determination unit configured to determine, when the number of the frequency signals of the plurality of time slices is equal to or larger than a first threshold value and when a phase distance between the frequency signals of the plurality of time slices is equal to or smaller than a second threshold value, each of the frequency signals with the phase distance as a frequency signal of the to-be-extracted sound, wherein the phase distance is a distance between phases of the frequency signals of the plurality of time slices when a phase of a frequency signal at a time t is $\psi(t)$ (radian) and the phase is represented by $\psi'(t)=\mathrm{mod}\ 2\pi(\psi(t)-2\pi ft)$ (where f is an analysis-target frequency).

2. The sound determination device according to claim 1, wherein said to-be-extracted sound determination unit is configured: to create a plurality of groups of frequency signals, each of the groups including the frequency signals in a number that is equal to or larger than the first threshold value and the phase distance between the frequency signals in each of the groups being equal to or smaller than the second threshold value; and to determine, when the phase distance between the groups of the frequency signals is equal to or larger than a third threshold value, the groups of the frequency signals as groups of frequency signals of to-be-extracted sounds of different kinds.

3. The sound determination device according to claim 1, wherein said to-be-extracted sound determination unit is configured to select frequency signals at times at intervals of 1/f (where f is the analysis-target frequency) from the frequency signals of the plurality of time slices, and to calculate the phase distance using the selected frequency signals at the times.

4. The sound determination device according to claim 1, further comprising a phase modification unit configured to modify the phase $\psi(t)$ (radian) of the frequency signal at the time t to $\psi'(t)=\mathrm{mod}\ 2\pi(\psi(t)-2\pi ft)$ (where f is the analysis-target frequency), wherein said to-be-extracted sound determination unit is configured to calculate the phase distance using the modified phase $\psi'(t)$ of the frequency signal.

5. The sound determination device according to claim 1, wherein said to-be-extracted sound determination unit is configured to obtain an approximate straight line of the phases of the frequency signals of the plurality of time slices in a space represented by the times and the phases using the frequency signals of the plurality of time slices, and to calculate the phase distances between the approximate straight line and the frequency signals at the plurality of times respectively.

6. A sound detection device, comprising:

said sound determination device described in claim 1; and a sound detection unit configured to create a to-be-extracted sound detection flag and to provide an output of the to-be-extracted sound detection flag when a frequency signal included in frequency signals of a mixed sound is determined as a frequency signal of a to-be-extracted sound by said sound determination device.

7. The sound detection device according to claim 6, wherein said frequency analysis unit is configured to receive a plurality of mixed sounds collected by a plurality of microphones respectively, and to obtain a frequency signal for each of the mixed sounds at each of a plurality of time slices of the mixed sound, wherein said to-be-extracted sound determination unit is configured to determine a to-be-extracted sound for each of the mixed sounds, and wherein said sound detection unit is configured to create the to-be-extracted sound detection flag and to provide the output of the to-be-extracted sound detection flag when a frequency signal included in the frequency signals of at least one of the mixed sounds is determined as the frequency signal of the to-be-extracted sound.

8. A sound extraction device, comprising:

said sound determination device described in claim 1; and a sound extraction unit configured to provide, when a frequency signal included in frequency signals of a mixed sound is determined as a frequency signal of a to-be-extracted sound by said sound determination device, an output of the frequency signal determined as the frequency signal of the to-be-extracted sound.

9. A sound determination method, comprising:

receiving a mixed sound including a to-be-extracted sound and a noise and obtaining a frequency signal of the mixed sound a teach of a plurality of time slices of the mixed sound over a predetermined duration; and determining, when the number of the frequency signals of the plurality of time slices is equal to or larger than a first threshold value and when a phase distance between the frequency signals of the plurality of time slices is equal to or smaller than a second threshold value, each of the frequency signals with the phase distance as a frequency signal of the to-be-extracted sound, wherein the phase distance is a distance between phases of the frequency signals of the plurality of time slices when a phase of a frequency signal at a time t is $\psi(t)$ (radian) and the phase is represented by $\psi'(t)=\mathrm{mod}\ 2\pi(\psi(t)-2\pi ft)$ (where f is an analysis-target frequency).

10. A non-transitory computer readable recording medium having stored thereon a sound determination program, wherein, when executed, said sound determination program causes a computer to execute a method comprising:

receiving a mixed sound including a to-be-extracted sound and a noise and obtaining a frequency signal of the mixed sound a teach of a plurality of time slices of the mixed sound over a predetermined duration; and determining, when the number of the frequency signals of the plurality of time slices is equal to or larger than a first threshold value and when a phase distance between the frequency signals of the plurality of time slices is equal to or smaller than a second threshold value, each of the frequency signals with the phase distance as a frequency signal of the to-be-extracted sound, wherein the phase distance is a distance between phases of the frequency signals of the plurality of time slices when a phase of a frequency signal at a time t is $\psi(t)$ (radian) and the phase is represented by $\psi'(t)=\mathrm{mod}\ 2\pi(\psi(t)-2\pi ft)$ (where f is an analysis-target frequency).

* * * * *